US007913945B2

(12) United States Patent
Friesen et al.

(10) Patent No.: US 7,913,945 B2
(45) **Date of Patent: *Mar. 29, 2011**

(54) DUAL ROLL TOILET TISSUE DISPENSER

(75) Inventors: Matthew Friesen, White Rock (CA); Bradley Friesen, Vancouver (CA); John Friesen, Vancouver (CA); Andrew Jackman, Langley (CA); Alexander Tramploski, Richmond (CA)

(73) Assignee: Dispensing Dynamics International, Ltd,, Surrey, BC (CA)

( * ) Notice: Subject to any disclaimer, the term of this patent is extended or adjusted under 35 U.S.C. 154(b) by 207 days.

This patent is subject to a terminal disclaimer.

(21) Appl. No.: 12/110,723

(22) Filed: Apr. 28, 2008

(65) Prior Publication Data

US 2009/0266930 A1 Oct. 29, 2009

(51) Int. Cl.
*B65H 19/10* (2006.01)

(52) U.S. Cl. ..... 242/559.4; 242/560; 242/561; 242/563.2; 242/588.6; 242/597.8

(58) Field of Classification Search ..... 242/558, 242/559, 560, 561, 588, 588.3, 588.6, 591, 242/597, 597.8, 563.2, 559.4, 559.3, 560.3
See application file for complete search history.

(56) References Cited

U.S. PATENT DOCUMENTS

| | | | | |
|---|---|---|---|---|
| 3,211,504 | A | 10/1965 | Bump | |
| 3,214,014 | A | 10/1965 | Perrin | |
| 3,381,909 | A | 5/1968 | Tucker et al. | |
| 3,387,902 | A | 6/1968 | Perrin et al. | |
| 3,770,222 | A | 11/1973 | Jespersen | |
| 4,340,195 | A * | 7/1982 | DeLuca | 242/560 |
| 4,662,664 | A | 5/1987 | Wendt et al. | |
| 5,628,474 | A | 5/1997 | Krueger et al. | |
| 5,865,395 | A | 2/1999 | Wei | |
| 5,868,335 | A * | 2/1999 | Lebrun | 242/560.3 |
| 5,873,542 | A | 2/1999 | Perrin et al. | |
| 5,954,256 | A | 9/1999 | Niada | |
| 6,145,779 | A | 11/2000 | Johnson et al. | |
| 6,202,956 | B1 | 3/2001 | Grasso et al. | |
| 6,237,871 | B1 | 5/2001 | Morand et al. | |
| 6,508,432 | B2 | 1/2003 | Krivulin | |
| 7,182,288 | B2 | 2/2007 | Denen et al. | |
| 2008/0078855 | A1 * | 4/2008 | Forman et al. | 242/560 |

* cited by examiner

*Primary Examiner* — William E Dondero

(74) *Attorney, Agent, or Firm* — Dwayne E. Rogge; Hughes Law Firm, PLLC

(57) ABSTRACT

A two-roll dispenser is disclosed for a plurality of rolls of products, in one embodiment a plurality of toilet paper rolls. The operation of resetting the device to accept replacement rolls of product is achieved by opening the casing. The seer mechanism is also disclosed in one form maintaining a secondary roll of product in a reserve position until a primary roll of product is substantially consumed. The seer mechanism is also disclosed in another form maintaining a casing door in a reserve position until a primary roll of product is substantially consumed. In one form, rolls of product having a partial or split core are utilized to achieve the objects of this disclosure.

18 Claims, 50 Drawing Sheets

DUAL ROLL TOILET TISSUE DISPENSER

BACKGROUND OF THE DISCLOSURE a) Field of the Disclosure

This disclosure relates to the field of dispensing sheet product, and in particular to dispensing rolls of toilet tissue. One form of the disclosure pertains to dual-roll dispensers wherein a plurality of rolls of product are disposed on a plurality of cores. In one example, the disclosure relates to dispensers wherein a primary roll is at a fixed position and a secondary roll is repositioned from a reserve position to a usable position when a primary roll is substantially consumed. In another example, the disclosure relates to dispensers wherein each roll is at a fixed position and the door is provided to allow access to a secondary roll when a primary roll is substantially consumed.

b) Background Art

Several dual-roll paper product dispensers have been conceived. These prior art references have varying degrees of applicability and varying degrees of success in restricting access to a secondary roll until a primary roll is substantially consumed, and often require many steps to gain access to consumed rolls to facilitate restocking.

SUMMARY OF THE DISCLOSURE

In general, the object of this disclosure is a paper product dispenser for dispensing a toilet paper roll wherein a first roll or primary roll of product can be accessed by a user and a secondary roll of product is held in reserve until the primary roll is substantially consumed. Whereas it was sometimes possible in prior applications to be able to access the secondary roll before the primary roll was completely consumed, this often resulted in undesired waste of product and in waste of time as a janitor or other person responsible for replacing the paper product would have to do so prematurely.

A mechanism is disclosed wherein a swing arm extends from a portion of the interior of the dispenser which engages the outer surface of the primary roll of product. In one embodiment, this swing arm includes a portion configured to frictionally rest upon the outer radius of the primary roll of product until the roll is completely consumed, at which point this portion extends radially inward beyond the outer radius of the core of the product and a release latch or seer mechanism is activated which allows a user to access the secondary roll of product.

In one embodiment, a casing door is provided which is a movable portion of the casing which in one position prohibits access to the secondary roll of product and a second position allows access to the secondary roll of product. As the release latch or seer mechanism is activated, the casing door repositions from the first position to the second position.

Another advantage of the embodiments disclosed herein is an option wherein the entire apparatus is reset as the casing comprises a portion which is pivotally mounted to a frame and connected to a mechanism which resets the casing door previously discussed from the second position back to the first position and in one embodiment simultaneously resets the swing arm to allow the primary roll of product to be replaced without necessitating a separate motion to reset the casing door and/or reset the swing arm. This is much more convenient for a janitor or other service personnel and also saves time, which could reduce costs or allow the service personnel to be engaged in more needed responsibilities.

The paper product dispenser in one embodiment is a dispenser for dispensing toilet paper. The dispenser utilizes a primary roll of product having an outer surface accessible to a user, and a secondary roll of product which is not accessible to a user until the primary roll is consumed. The dispenser has a frame comprising a face side; a lateral extension having a face side, a back side, and a first end, the lateral extension coupled at the first end to the face side of the frame; a primary roll support fixedly coupled to the lateral extension and extending transversely from the face side of the lateral extension, operatively configured to support the primary roll; and a secondary roll support coupled to the lateral extension, configured to support the secondary roll. In one embodiment, the secondary roll support extends transversely from the face side of the lateral extension. In one form, the swing arm extends transversely from the lateral extension and is configured to engage the outer surface of the primary roll of product which is positioned upon the primary roll support. As the primary roll is consumed, the swing arm repositions toward the center of the primary roll of product as the product disposed upon the primary roll is consumed. Once the primary roll is substantially consumed, a release latch releases. The release latch is coupled to the swing arm and is operatively configured to deny a user access to the secondary roll until the primary roll is substantially consumed.

In another embodiment, the secondary roll support is movably coupled to a vertical channel disposed on the lateral extension. The secondary roll support extends transversely from the face of the lateral extension so that a new roll may be installed easily. The secondary roll support includes a release latch which allows it do drop to an accessible position when the seer latch is activated. The casing of the dispenser is arranged such that the swing arm is repositioned to a reserve position as the casing is opened. The action of opening the casing may also function to reposition the secondary roll support to a reserve position, effectively resetting the dispenser automatically. This saves the time and effort of the service person replacing the product rolls.

In one embodiment, a casing door is provided to deny access to the secondary roll of product until the primary roll of product is substantially consumed. In this embodiment, the secondary roll support may remain in a stable position. The casing door may include a release latch, which releases the door when the primary roll of product is consumed. This would then allow a user access to the secondary roll of product. This embodiment may also include a mechanism configured such that the swing arm is operatively configured to be repositioned to a reserve position when the casing is opened. Additionally, opening the casing may also reposition the casing door to a reserve position, functionally resetting the dispenser automatically.

The paper product dispenser in one form includes a mechanism, such that a swing arm, that is rotatably coupled to the frame at a first end of the lower member via a lower member pivot and the lower member further comprises a channel. This channel is substantially at the second end of the lower member and is configured to slidably engage the upper member wherein the channel of the lower member directly engages the swing arm. In one form, the swing arm extends transversely from the upper member through a surface defining a channel disposed upon the lateral extension. Additionally, the swing arm may include an engagement portion operatively configured to engage the outer surface of the primary product roll until the primary product roll is substantially consumed. Once the primary roll is consumed, the seer latch is released and the secondary product roll is repositioned to a usable position. To accomplish this, in one form the swing arm further includes an engagement portion operatively configured to release the seer latch, and thus release the vertically sliding member. This operates to release the secondary roll product roll to an operational position only after the primary roll is completely consumed.

The paper product dispenser in another embodiment includes an upper member which is rotatably coupled to the back side of the lateral extension. This upper member includes a cam surface which slidably engages the release latch and releases the seer mechanism when the primary roll is substantially consumed. The upper member includes a cam surface and a seer point which are configured to slidably engage the seer latch while the primary product roll is not substantially consumed, and disengage from the seer latch when the primary roll is substantially consumed. To accomplish this automatic reset, the casing is rotatably attached to the frame at a casing pivot. A repositioning tab is provided, operatively configured to engage a repositioning surface on the first end of the lower member when the casing is opened to a substantially fully open position. Once the casing is opened, pressure against the repositioning surface of the lower member by the repositioning tab will rotate the lower member about the lower member pivot. This pressure will in turn rotate the upper member about the upper member pivot, operatively resetting the dispenser. Additionally, the paper product dispenser may be configured such that the lifting member is configured to exert force against a vertically sliding member, repositioning the secondary roll support to a reserve position. Thus a new secondary roll of product can be installed without additional movements. Once the rolls have been replaced, the door is re-closed and the lifting member engages the outer surface of the primary roll.

The paper product dispenser may also be configured such that the swing arm further includes an engagement portion operatively configured to engage the outer surface of the primary product roll until the primary product roll is substantially consumed. This engagement portion may be formed as part of the swing arm, or may be an additional structure coupled to the swing arm. Once the primary roll is consumed, the seer latch is released and a casing door is repositioned to an open position.

In one form, a lifting member is provided which is coupled at a first end to a lifting member pivot and extends from the lateral extension, the lifting member comprising an engagement surface substantially positioned at the second end of the lifting member which is operatively configured to slidably engage the vertically sliding member, and comprises a surface defining a channel positioned between the lifting member pivot and the engagement surface operatively configured to engage a sliding bar extending transversely from the upper member.

Another embodiment is disclosed wherein the seer mechanism is coupled to the casing and is operatively configured to reset from a position wherein the secondary product roll is accessible, to a position wherein the secondary product roll is inaccessible when the casing is substantially opened. Furthermore, a swing arm may be coupled to the seer mechanism, configured to engage the outer surface of the primary roll while the primary roll is being utilized. The swing arm is operatively configured to engage the seer mechanism and release the secondary roll support only when the primary roll is substantially consumed. This may be facilitated by a lower member coupled to the frame and engaging a portion of the casing. The lower member is configured to reposition the swing arm when the casing is substantially opened.

A paper product dispenser in one form for dispensing products is disclosed wherein the dispenser includes a swing arm coupled to the frame and configured to engage the outer surface of a primary roll of product while the primary roll is being utilized. The swing arm may be further coupled to the casing and operatively configured to reset to a first position when the casing is opened.

In one form a method is disclosed including the steps of first opening the casing of the dispenser. This operates the reset mechanism which is configured to automatically reset the secondary oil support and the release latch automatically. Next, the service person would remove any remaining cores on the primary roll support, and would then replace the consumed core with a substantially full roll of product; and finally, close the casing of the dispenser.

DESCRIPTION OF THE PREFERRED EMBODIMENTS

Figure 1:
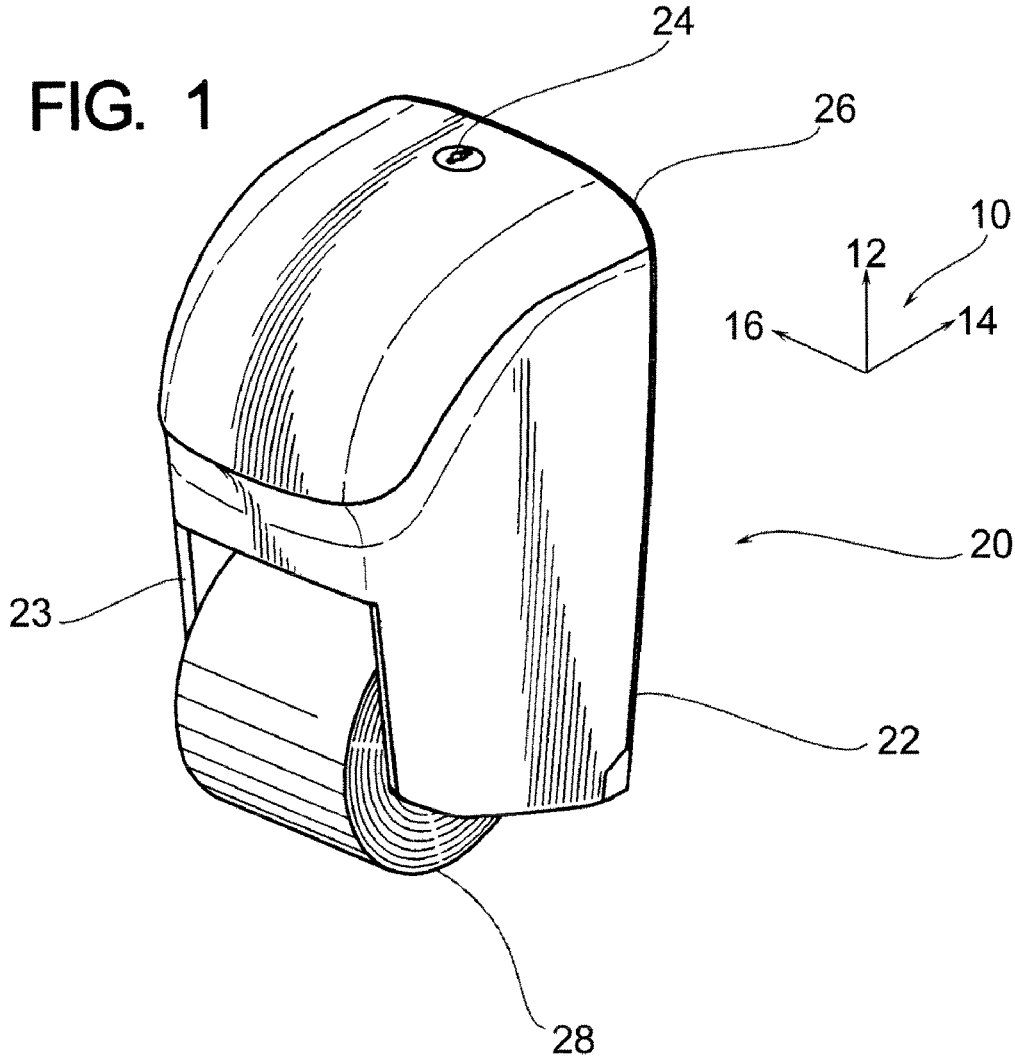
FIG. 1 is an isometric view of one embodiment of the disclosure in a closed and operational position.
Figure 2:
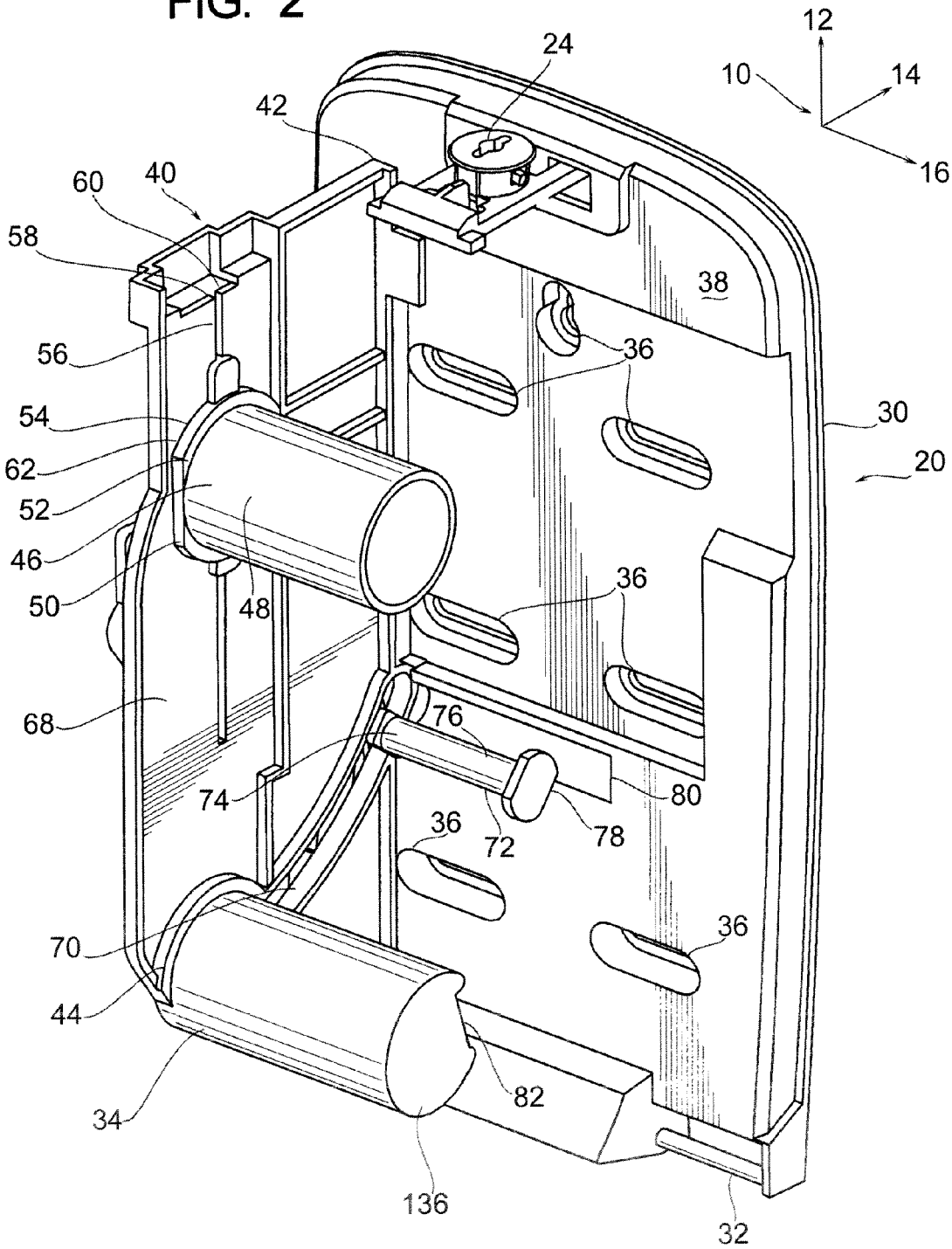
FIG. 2 is an isometric view of one embodiment of the disclosure with the casing and product rolls removed to show the mechanism.

To simplify the description and improve understanding, an axis system 10 is disclosed in FIG. 1 and again in FIG. 2 showing a vertical axis 12, a lateral axis 14, and a transverse axis 16. The arrow indicated at 12 generally shows an upward vertical direction and the arrow at 16 generally shows a rightward direction. Of course, this axis system and the disclosed orientations are for understanding of the apparatus and should in no way be construed as limiting.

Looking at FIG. 1, there is shown one embodiment of a dispenser 20, including a casing 22 and a latching mechanism 24. As shown, the dispenser 20 is in the closed position and is ready for operation. The back side 26 of the casing 22 could be attached to a structure such as a wall or door. A product roll 28 is shown which in one form is a roll of toilet paper. Obviously, the dispenser 20 can be scaled to fit other rolls such as paper towels or the like.

Looking at FIG. 2, there is shown the dispenser 20 in one form with the casing 22 and product roll 28 removed. The casing 22 in one form could normally be rotatably attached to the frame 30 at the casing pivot 32. In one form the casing pivot 32 is at the vertically lowermost extreme of the frame 30. The product roll 28 of FIG. 1 could be disposed upon the primary roll support 34. As previously mentioned, a latching mechanism 24 is shown at the vertically upward portion of the frame 30. As such latching mechanisms are known in the art, many such latching mechanisms could be made to operate as desired. A plurality of mounting holes 36 are shown which could be utilized to couple the frame 30 to a structure such as a wall or door by way of fasteners such as screws, nails and the like.

One embodiment of the frame 30 includes a face side 38. Attached to the face side 38 of the frame 30 is a lateral extension 40. The lateral extension is substantially a vertical wall-like structure having a first end 42 coupled to the face side 38 of frame 30. The lateral extension 40 may be coupled to the face side 38 by way of frictional engagements or adhesive, or may conceivably be formed as a unitary structure. The lateral wall extension 40 provides a structure for supporting the primary roll support 34. The primary roll support 34 may be formed as part of the lateral extension 40 or may be attached thereto by way of frictional engagements or adhesives. A plurality of gussets 44 may be provided to add rigidity to the lateral extension 40 where the primary roll support 34 couples thereto.

Figure 3:
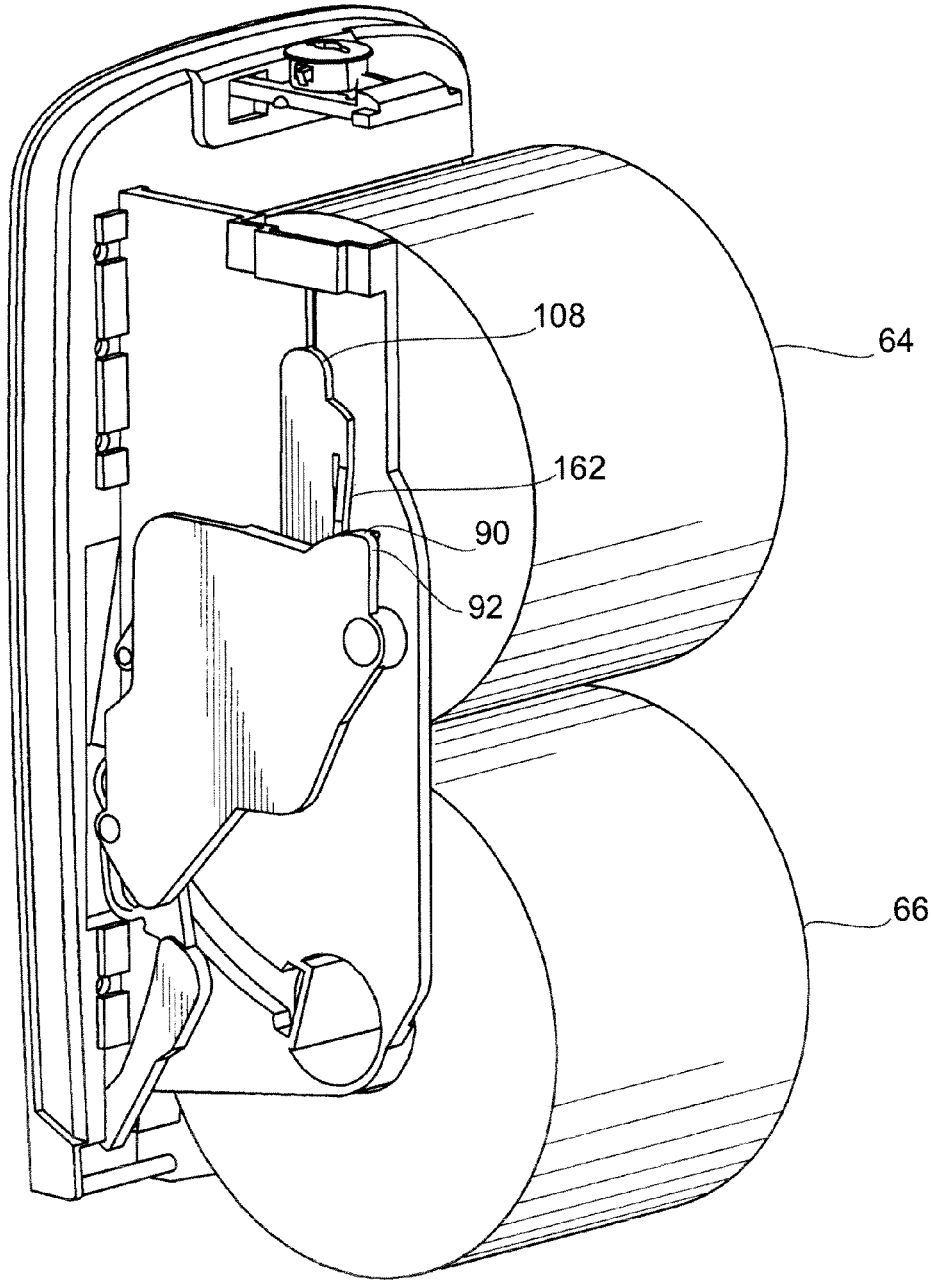
FIG. 3 is an isometric view of one embodiment of the disclosure with the casing removed and the primary and secondary product rolls in place and complete.

A secondary roll support 46 is also provided in one form which extends transversely from the lateral extension 40 and in one form is substantially a cylinder. The secondary roll support 46 includes an extension 48 which is coupled to a secondary roll support base 50 at a first end 52. The secondary roll support base 50 further includes a second face 54 which frictionally and slidably engages the lateral extension 40 at a vertical channel 56. The vertical channel 56 is comprised of a plurality of surfaces 58 and 60, disposed within the lateral extension 40. As shown in FIG. 2, the secondary roll support 46 is in a reserve position 62 wherein it is configured to support a secondary product roll 64 as shown in FIG. 3. Similarly, the primary roll support 34 is configured to support a primary product roll 66. Referring back to FIG. 2, the second face 54 of the secondary roll support 46 engages the lateral extension 40 on a face side 68 of the lateral extension 40. A plurality of surfaces defining a channel 70 are also disposed in the lateral extension 40 configured to allow passage and movement of a swing arm 72. The swing arm 72 has a first end 74 substantially close to the face side 68 of lateral extension 40, and a second end 76 substantially distant from the face 68 of lateral extension 40. The swing arm 72 furthermore has an engagement portion 78 configured to ride on the outer surface of the primary product roll 66 as the primary product roll 66 is being used. The frame 30 may also include a recess 80 configured to accept the swing arm 72 when it is in position furthermost from the primary roll support 34.

The primary roll support 34 of one embodiment may also include a channel 82 configured to receive a portion of the swing arm 72 when the swing arm 72 is in position closest to the primary roll support 34. As will be discussed later, when a primary product roll 66 is used having a partial or split core as is known in the art, the engagement portion 78 of the swing arm 72 will ride along on the outer portion of the primary product roll 66 until the primary product roll 66 is substantially consumed at which point the engagement portion 78 will press past the end of the partial core and set substantially within or beyond the channel 82. The end result of this operation will be discussed in detail.

Figure 6:
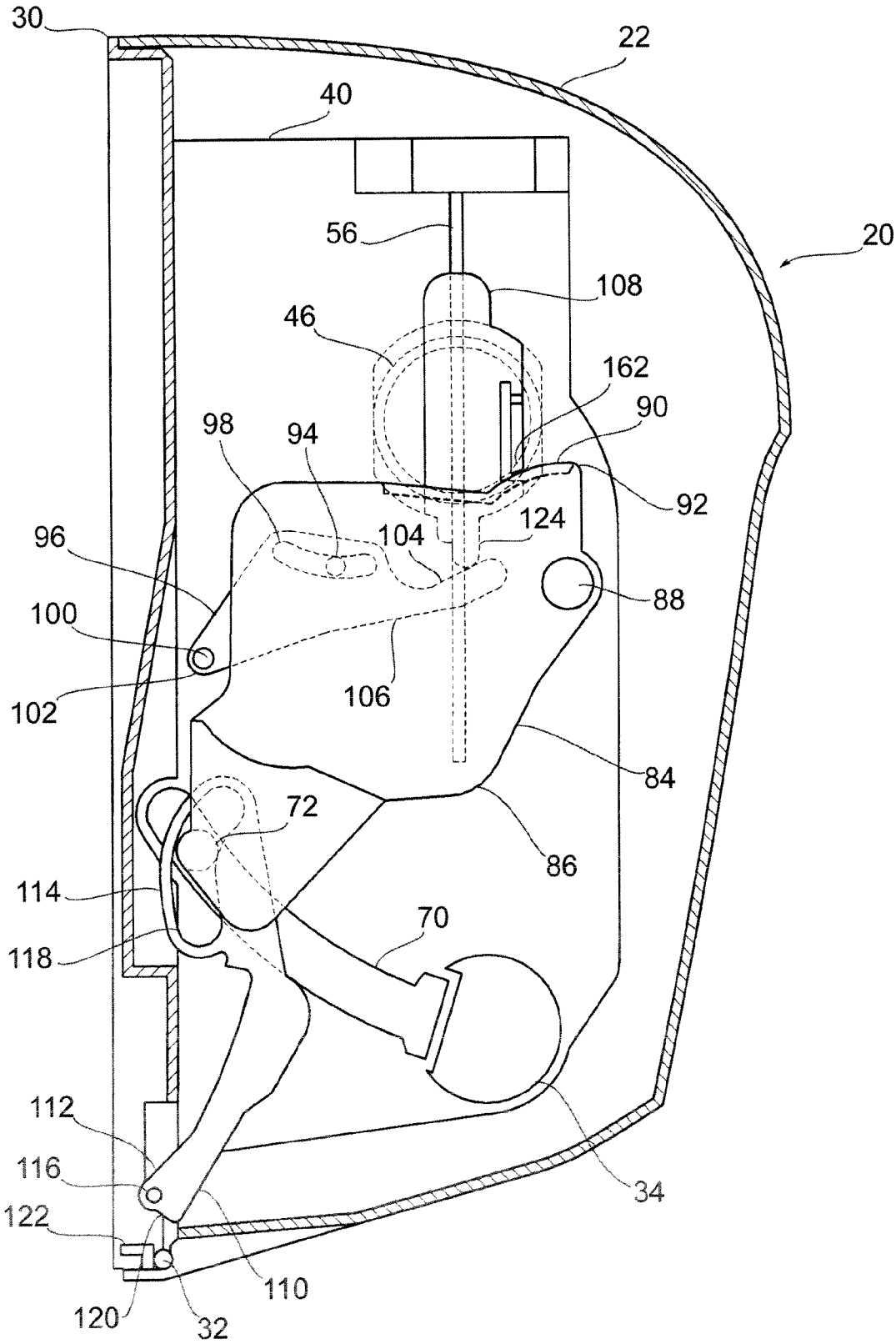
FIG. 6 is a cutaway side view of the right side of one embodiment of the disclosure in a closed and operational position with the primary and secondary rolls removed to show the operational mechanism.
Figure 7:
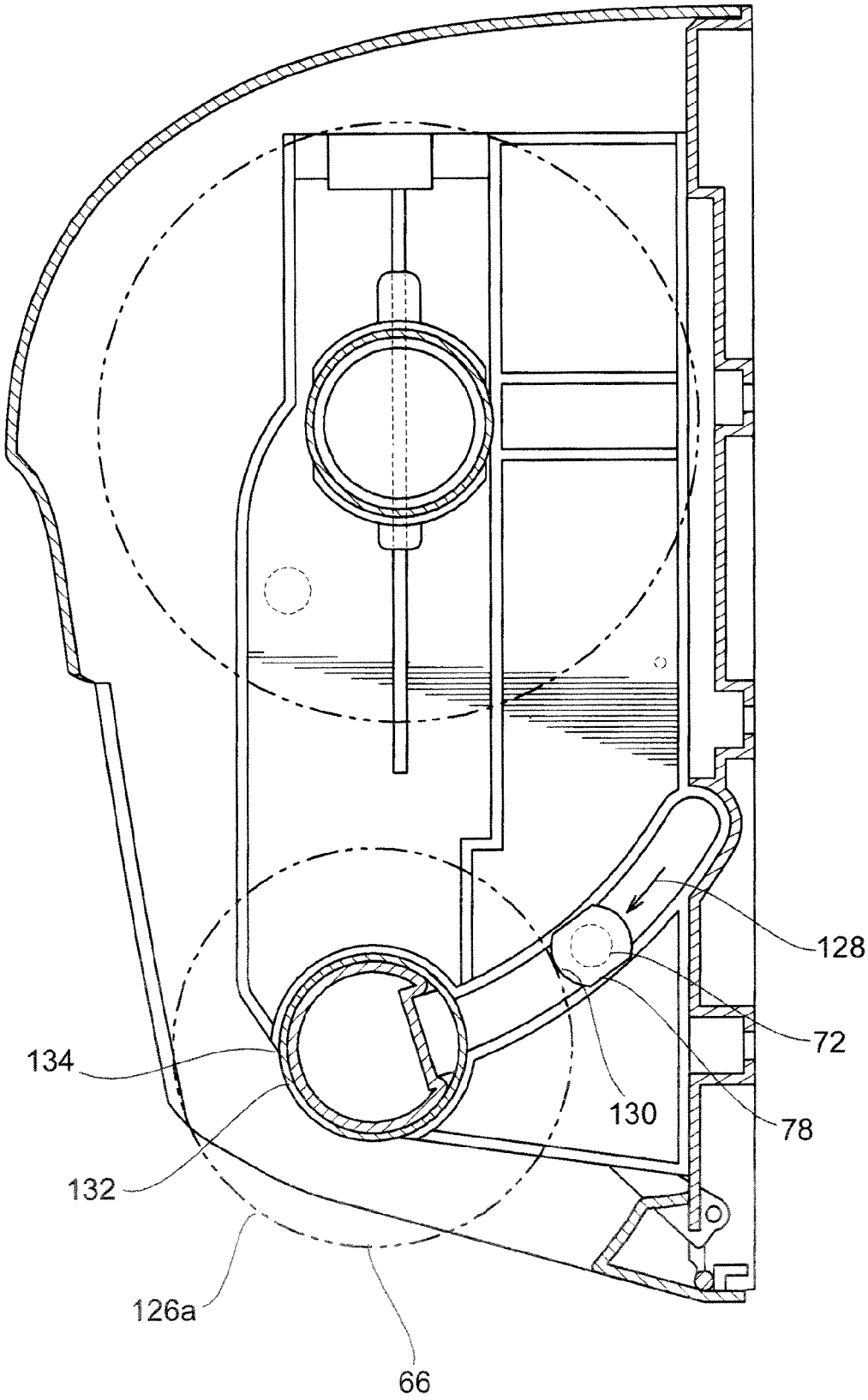
FIG. 7 is a cutaway side view of the left side of one embodiment of the disclosure in a closed and operational position with the primary roll partially utilized.
Figure 14:
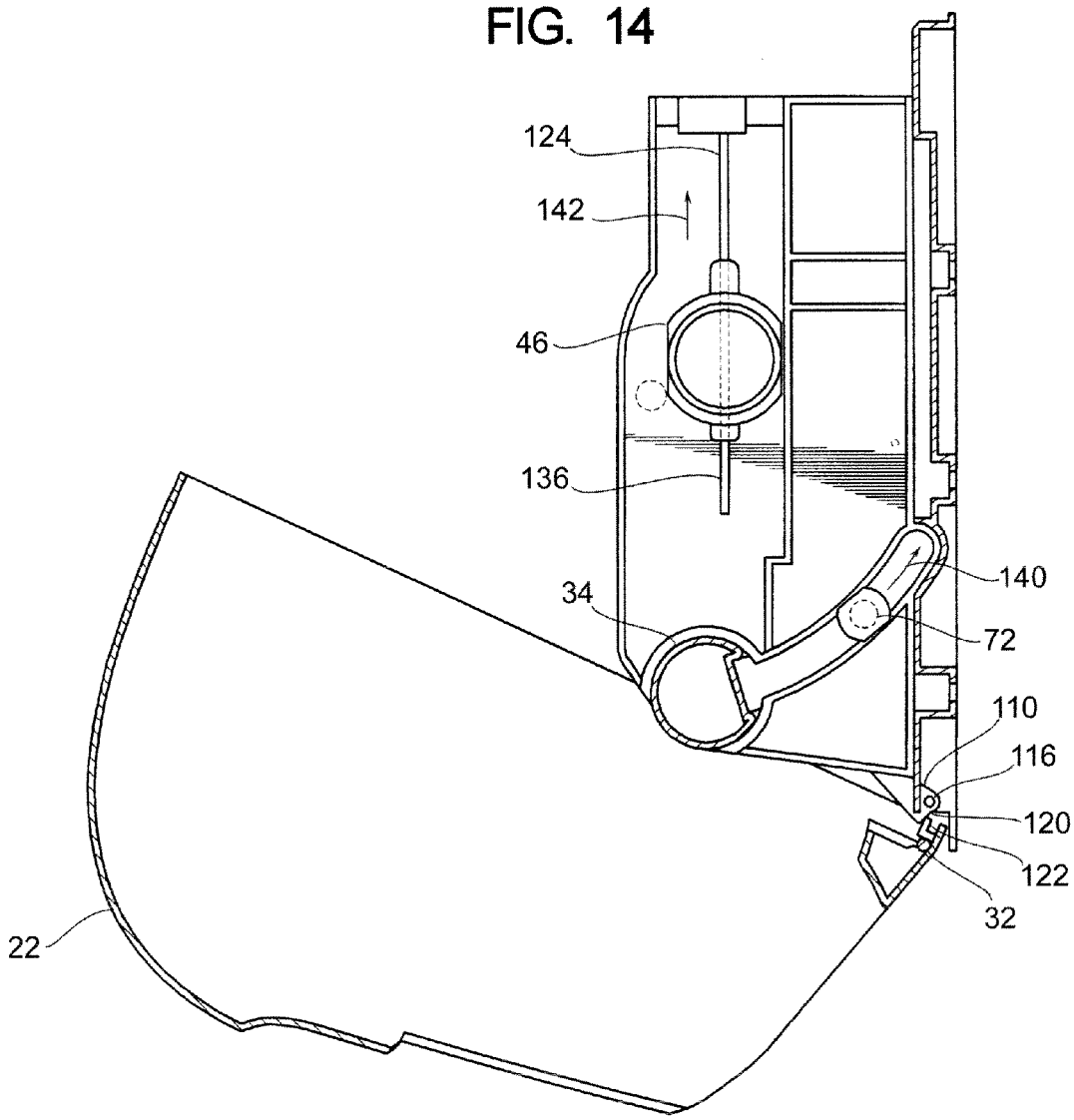
FIG. 14 is a hidden-line side view of the left side of one embodiment of the disclosure in a substantially open position with the secondary lifting mechanisms partially reset.
Figure 15:
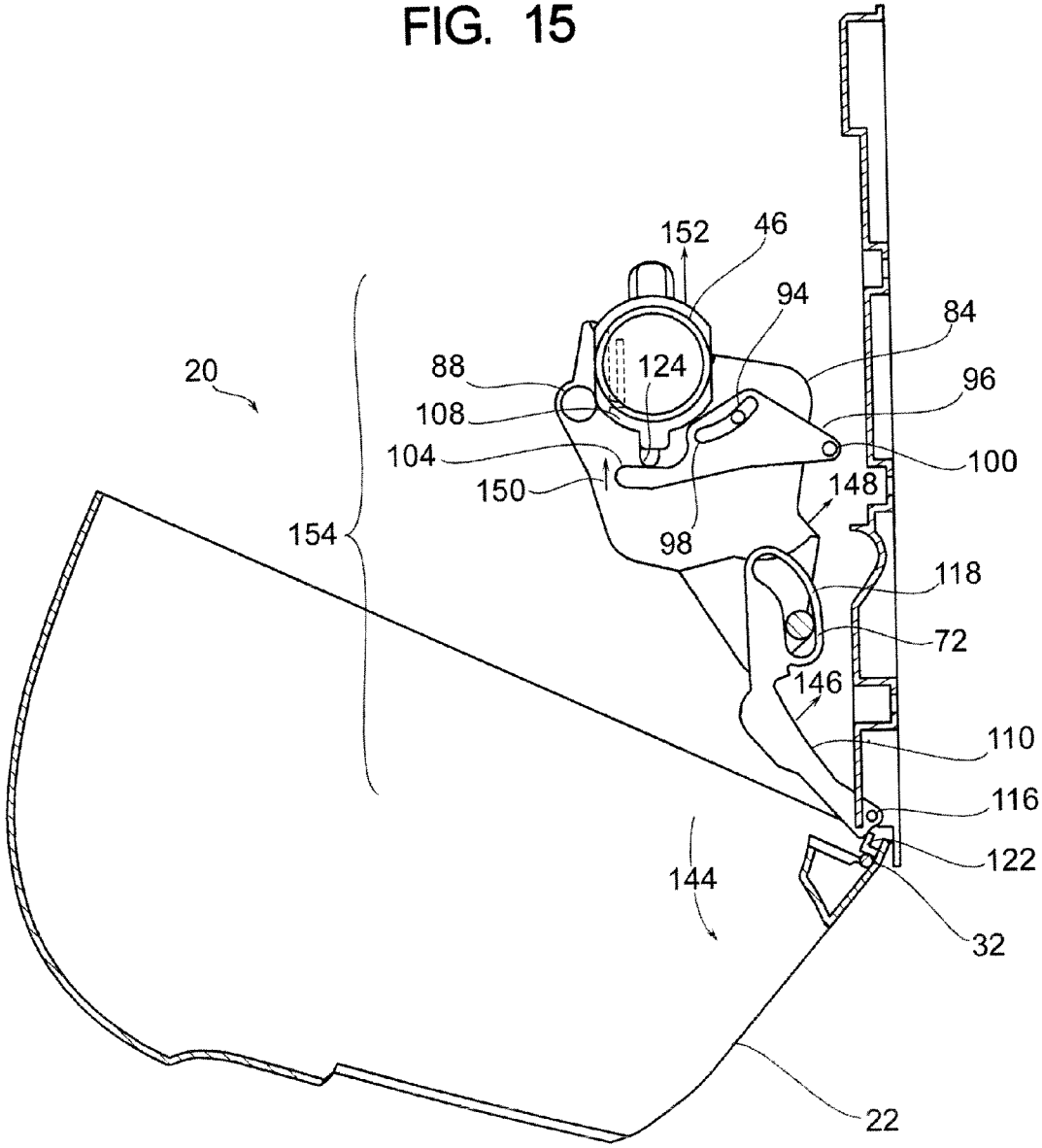
FIG. 15 is a cutaway side view of the left side of one embodiment of the disclosure and a substantially open position with the secondary lifting mechanisms partially reset showing the secondary lifting mechanisms in detail.
Figure 16:
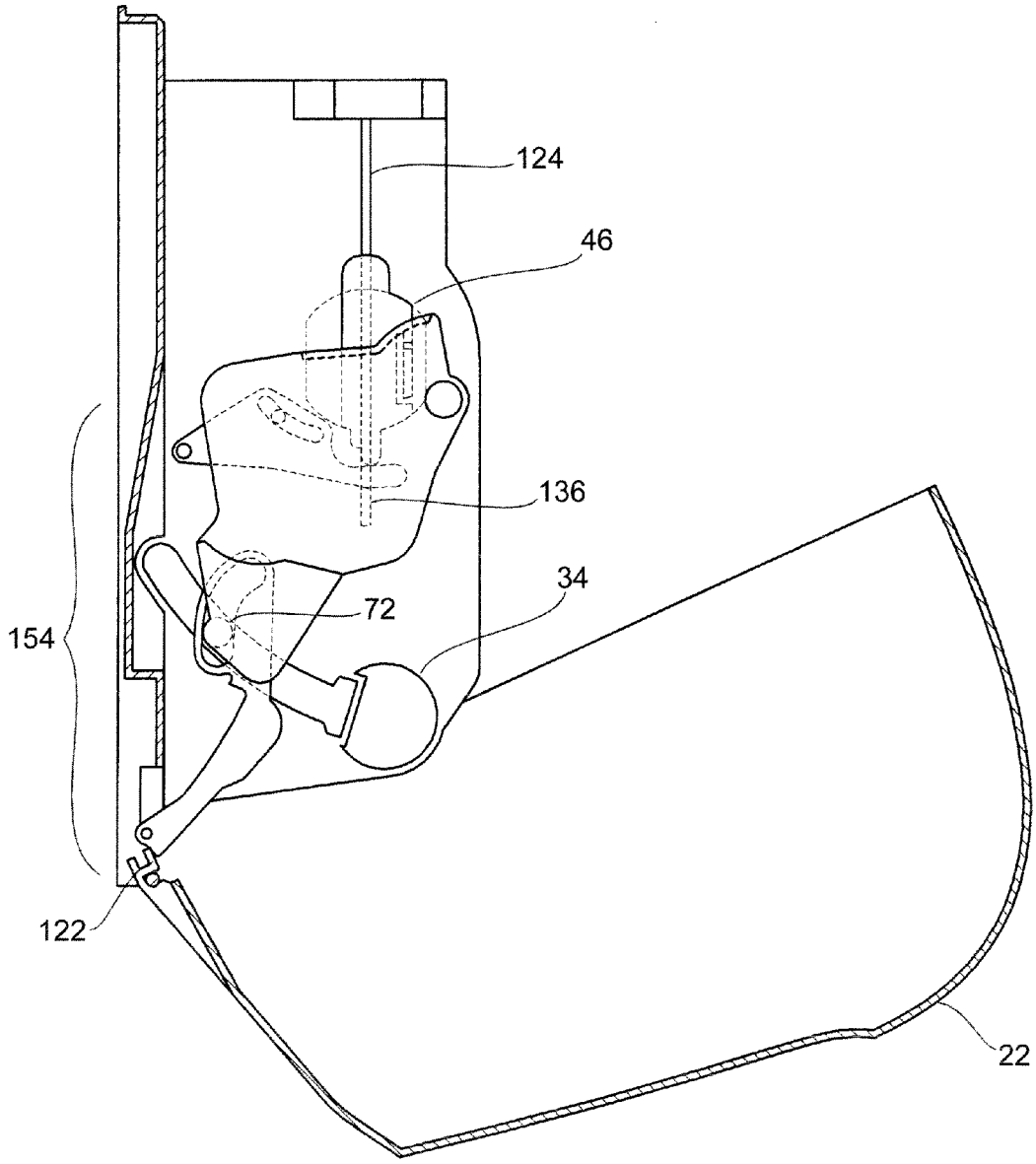
FIG. 16 is a cutaway side view of the right side of one embodiment of the disclosure in a substantially open position with the secondary lifting mechanisms partially reset.

Now looking at FIG. 6, a cutaway view of one embodiment of the dispenser 20 is shown including the casing 22, and the frame 30. As stated before, as the primary product roll 66 is consumed, the swing arm 72 will slide along channel 70 towards the primary roll support 34. The swing arm 72 extends transversely from the upper member 84 to ride against the primary roll of product. The upper member 84 is shown in a reserve position 86, and is coupled to the lateral extension 40 at an upper member pivot 88. The upper member 84 further includes a cam surface 90 and a seer point 92. These can also be seen in FIG. 3 from a different angle. The upper member 84 in one form also includes a sliding bar 94 extending from the upper member 84. The sliding bar 94 is coupled to the upper member 84 and engages a lifting member 96 at a channel 98 disposed within the lifting member 96. The lifting member 96 is coupled to the lateral extension 40 at a lifting member pivot 100. The lifting member pivot 100 is substantially at a first end 102 of the lifting member 96. An engagement surface 104 is substantially at the second end 106 of the lifting member 96 and is configured to engage a vertically sliding member 108. The vertically sliding member 108 is coupled through the vertical channel 56 within the lateral extension 40 to the secondary roll support 46. The engagement surface 104 is configured to engage the vertically sliding member 108 as to reposition it. A lower member 110 is also disclosed having a first end 112 and a second end 114. The lower member 110 is coupled to the frame 30 at a lower member pivot 116. The lower member 110 could also be coupled to the lateral extension 40. The lower member 110 in one form further comprises a channel 118 configured to engage the swing arm 72. Furthermore, the lower member 110 may comprise a reset surface 120 configured to frictionally engage the reset tab 122 of the casing 22 when the casing is substantially opened as is shown in FIGS. 14-16.

Many prior art product roll dispensers require that a person attempting to restock one or more of the product rolls would first need to reset a release (seer) latch which provides access to the secondary roll of product, and then replace either the primary or the primary and the secondary roll(s) of product. In one embodiment of this disclosure as shown in FIG. 6, a dispenser 20 is provided wherein releasing the latching mechanism 24 (see FIG. 1) and opening the casing 22 about the casing pivot 32 engages the reset tab 122 against the reset surface 120 of the lower member pivot 116 as shown in FIG. 14. This force upon the lower member 110 will rotate it away from the primary roll support 34 in direction of travel 140, thus moving the swing arm 72 away from the primary roll support 34 and allowing the primary roll to be replaced without necessitating an additional movement of a user, manually repositioning the swing arm 72. Additionally, as shown in FIG. 15, the dispenser 20 can be configured such that the movement of the swing arm 72 rotates the upper member 84 about the upper member pivot 88. As the upper member 84 rotates, the sliding bar 94 exerts pressure upon the lifting member 96, rotating it about the lifting member pivot 100. This motion positions the engagement surface 102 against the surface 124 of the vertically sliding member 108. As the engagement surface 104 puts pressure upon the surface 124 of the vertically sliding member 108, it tends to reposition upwardly in direction of travel 150 along the vertical channel 56 (see FIG. 6) to a reserve position. As such, if the secondary product roll 64 is substantially consumed, a user could replace it with a new unused roll. At this point the casing 22 could be closed, reengaging the latch mechanism 24 at which point the apparatus is once again ready for use. This reset mechanism would save a considerable amount of time and effort as a single motion of opening the casing 22 repositions the seer mechanism and the secondary roll support 46.

Figure 9:
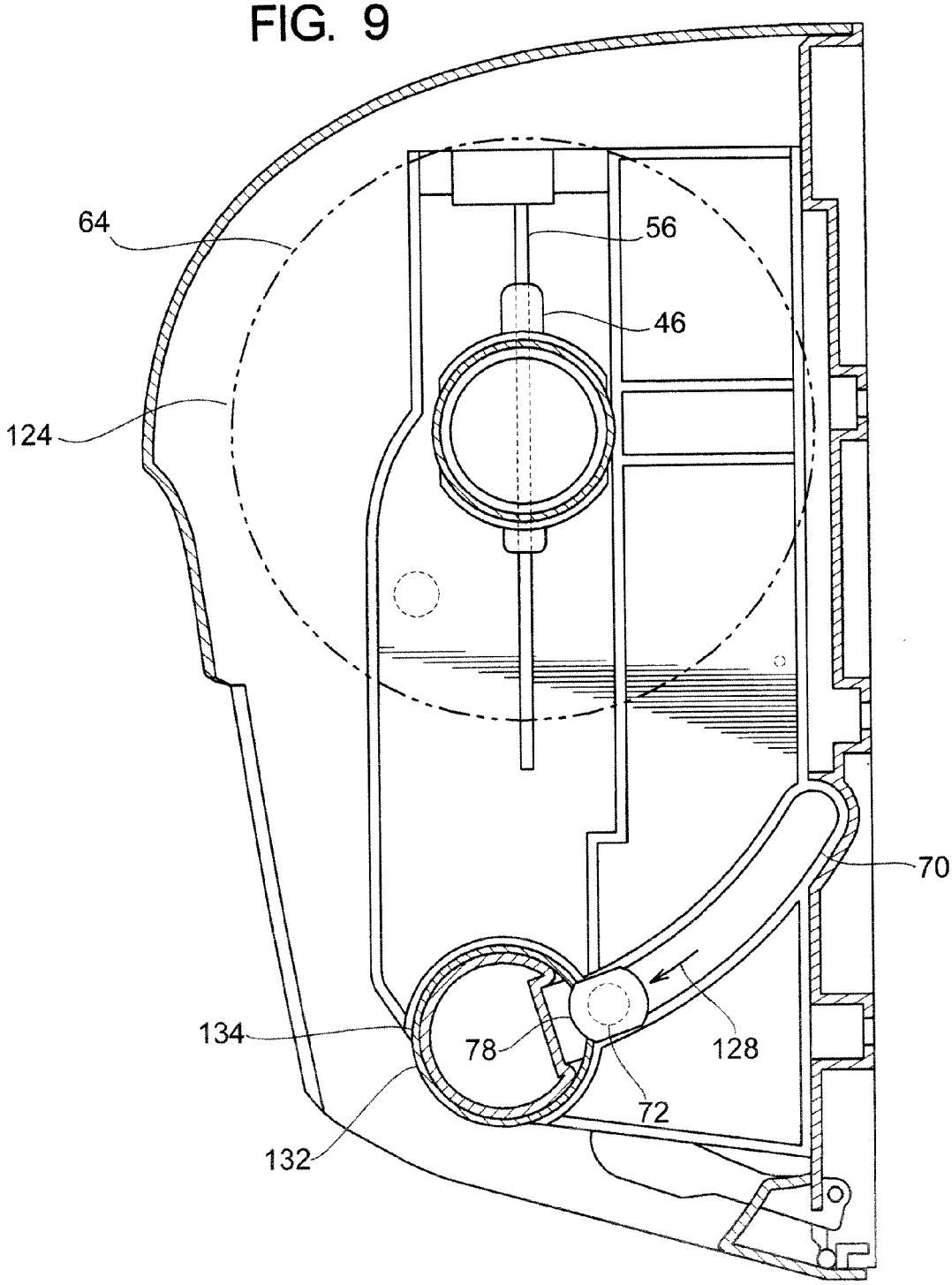
FIG. 9 is a cutaway side view of the left side of one embodiment of the disclosure in a closed and operational position with the primary roll substantially utilized.

Looking at FIGS. 4, 7, 9, 12, 14, and 15, a progression of one embodiment is shown wherein the primary product roll 66 is consumed, the mechanisms are engaged, and upon complete consumption of the primary product roll 66, the casing 22 is opened, resetting the apparatus of the dispenser 20. Looking at FIG. 4, a primary product roll 66 is shown being a substantially new roll. Similarly, the secondary product roll 64 is in a reserve position 124 and is not available for use by a consumer. Also shown is the swing arm 72 including the engagement portion 78 which is in position to frictionally engage the outer surface 126 of the primary product roll 66. Obviously, friction reducing agents such as Teflon, plastic, a wheel, or other mechanisms can also be employed to reduce friction between the swing arm 72 and the outer surface 126 of the primary product roll 66. Looking at FIG. 7, it can be seen how the swing arm 72 moves in the direction of travel 128 as the outer surface 126*a* reduces in diameter when the primary product roll 66 is consumed. As shown, the engagement portion 78 is engaging the outer surface 126*a* of the primary roll 66 at engagement point 130. As shown, the primary product roll 66 includes a core 132 having an outer diameter 134. In one form, the core 132 is a partial or split core, wherein one portion of the core is supported by the primary roll support 34 and any other portions of the core extend from the transverse end 136 of the primary roll support 34 as shown in FIG. 2. Thus, as shown in FIG. 9 wherein the secondary product roll 64 is still in the reserve position 124, the swing arm 72 has traveled in the direction of travel 128 along channel 70 beyond the outer diameter 134 of the core 132. The majority of the swing arm 72 would, not move beyond the outer diameter 134 of the core 132; however, the engagement portion 78 could move beyond the outer diameter 134.

Figure 12:
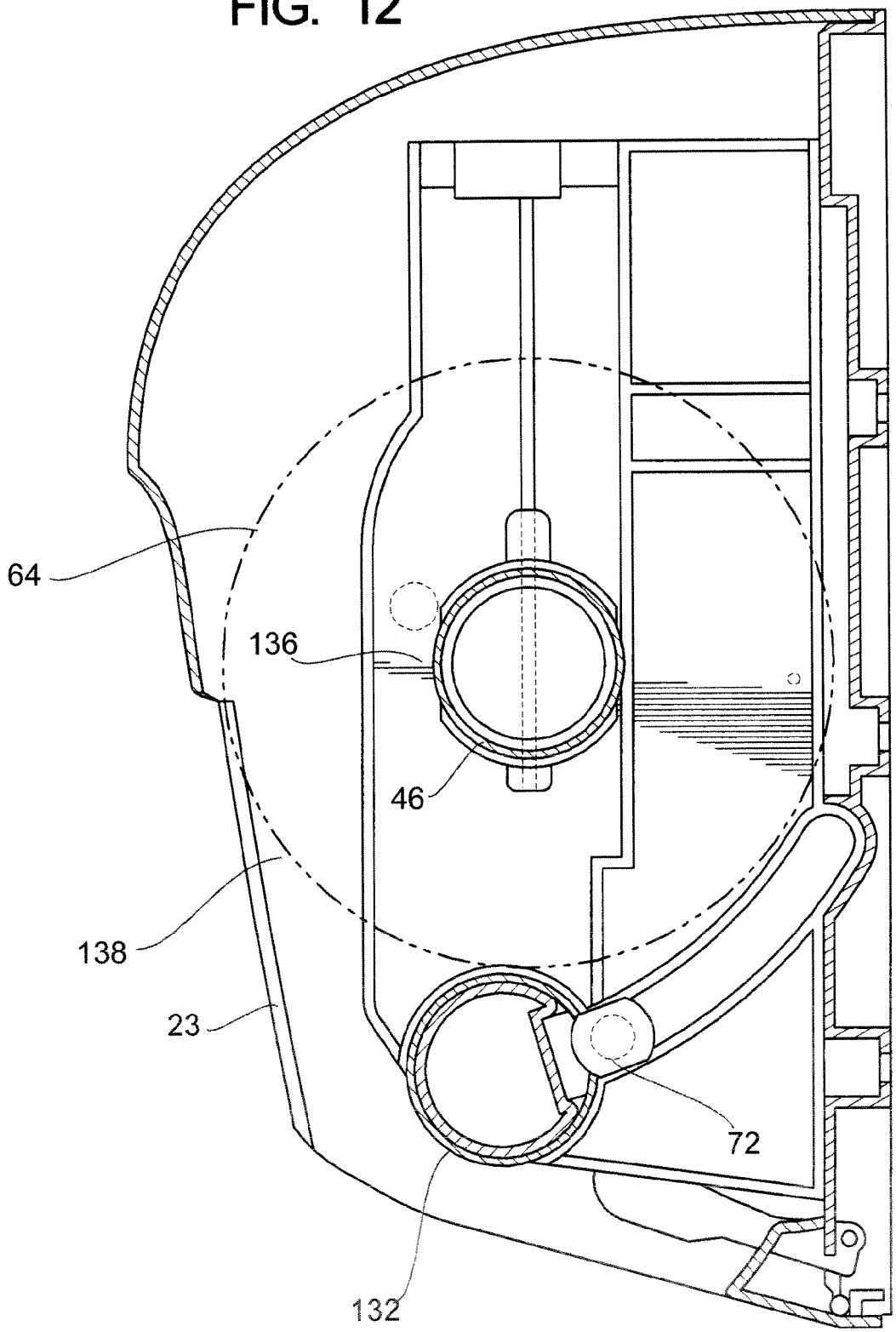
FIG. 12 is a cutaway side view of the left side of one embodiment of the disclosure in a closed and operational position with the primary roll removed and the secondary roll in a position to be utilized.

As the primary product roll 66 of one embodiment of the disclosure is substantially consumed, the secondary roll 64 is released, and the secondary roll support 46 slides along the vertical channel 56 from the reserve position 124 as shown in FIG. 9 to an operational position 136 as shown in FIG. 12. In this position, a consumer would have access to the outer surface 138 of the secondary product roll 64 through the opening 23 as further shown in FIG. 1.

Obviously, at this stage it would be inconvenient to replace the primary product roll core 132 with a new roll even after the casing 22 were opened, as the secondary product roll 64, the secondary roll support 46, and the swing arm 72 could interfere with such action. Thus, an embodiment is disclosed wherein as shown in FIG. 14, as the casing 22 is opened about pivot point 32, the reset tab 122 engages the reset surface 120 of the lower member 110, which forces the lower member 110 to pivot about the lower member pivot 116 and repositions the swing arm 72 in the direction of travel as shown at 140. In one embodiment, opening the casing 22 as described also repositions the secondary roll support 46 from an operational position 136 to a reserve position 124 in the direction indicated at 142.

The specific sequence as shown in FIG. 15, of one embodiment of the disclosure, is that as the casing 22 rotates about the case pivot 32 in the direction as indicated at 144, pressure is put upon the lower member 110. The pressure exerted by the casing 22 against the lower member 110 rotates the lower member 110 about the lower member pivot 116 in the direction as indicated at 146. This rotation and movement of the lower member 110 exerts force against the swing arm 72 by way of the channel 118. As the swing arm 72 is connected to the upper member 84, this force tends to rotate the upper member 84 about the upper member pivot 88 in the direction as indicated at 148. This rotation of the upper member 84 about the upper member pivot 88 exerts force against the lifting member 96 by way of the sliding bar 94 engaging the surfaces of the channel 98. The sliding bar 94 is coupled to the upper member 84. This force against the lifting member 96 tends to rotate the lifting member 96 about lifting member pivot 100 in the direction as indicated at 150. This exerts force from the lifting member 96 upon the secondary roll support 46 as previously discussed. This force tends to move the secondary roll support 46 in the direction as indicated at 152. Thus, the two operations of the reset mechanism 154 are achieved. These operations are: repositioning the swing arm 72 such that a new roll can be placed upon the primary roll support with a minimum of effort, and also ensuring that the secondary roll support 46 is moved from an operational position 136 to a reserve position 124 as shown in FIG. 14. Should the secondary product roll 64 need to be replaced, that can easily be achieved at this point.

It is also conceived that whereas it may be beneficial to provide the primary product roll with a split or partial core, it may also be desirable to provide the secondary product roll 64 with a full-length core.

Figure 5:
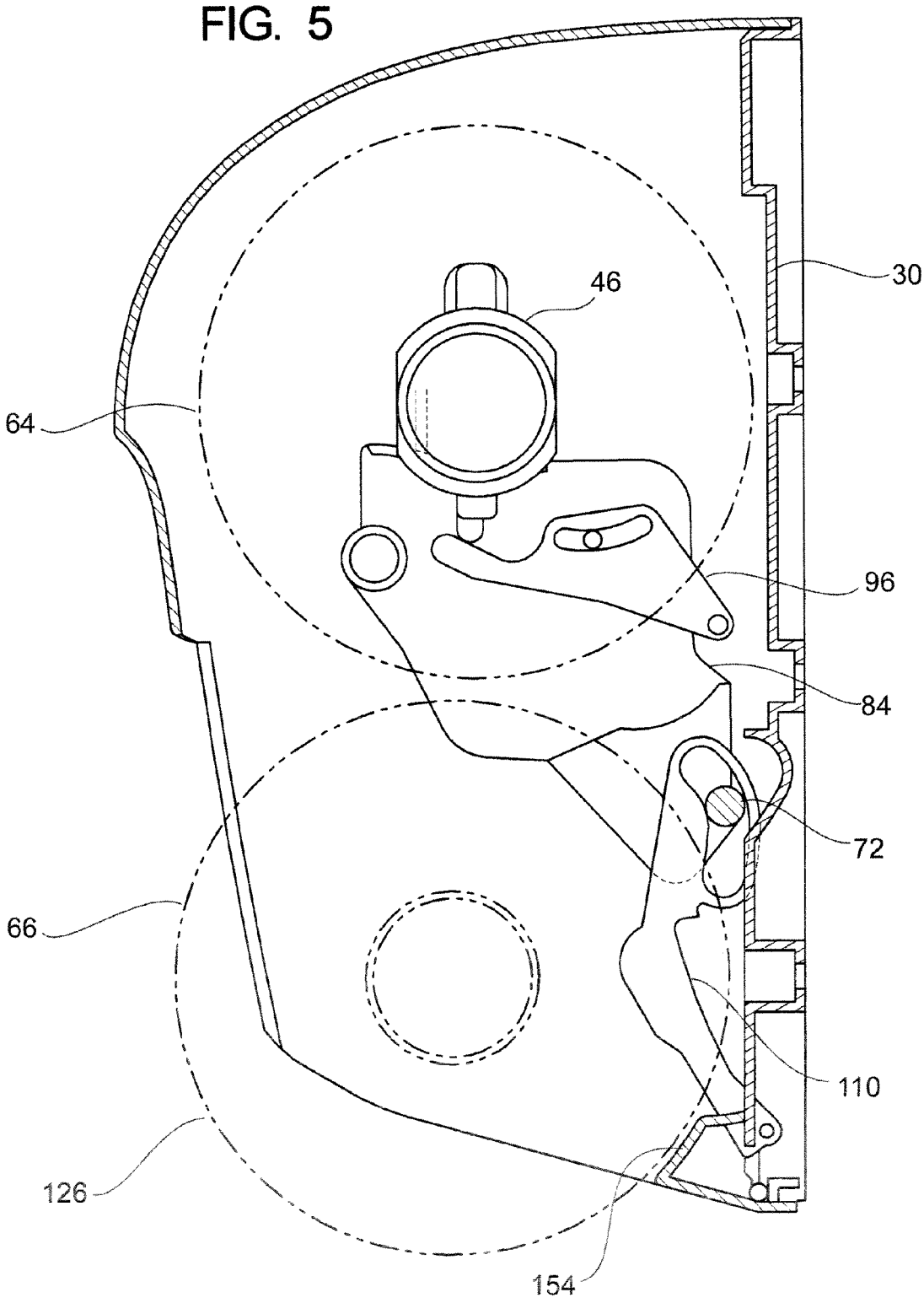
FIG. 5 is a cutaway view of the left side of one embodiment of the disclosure in a closed and operational position showing the secondary lifting mechanism.
Figure 8:
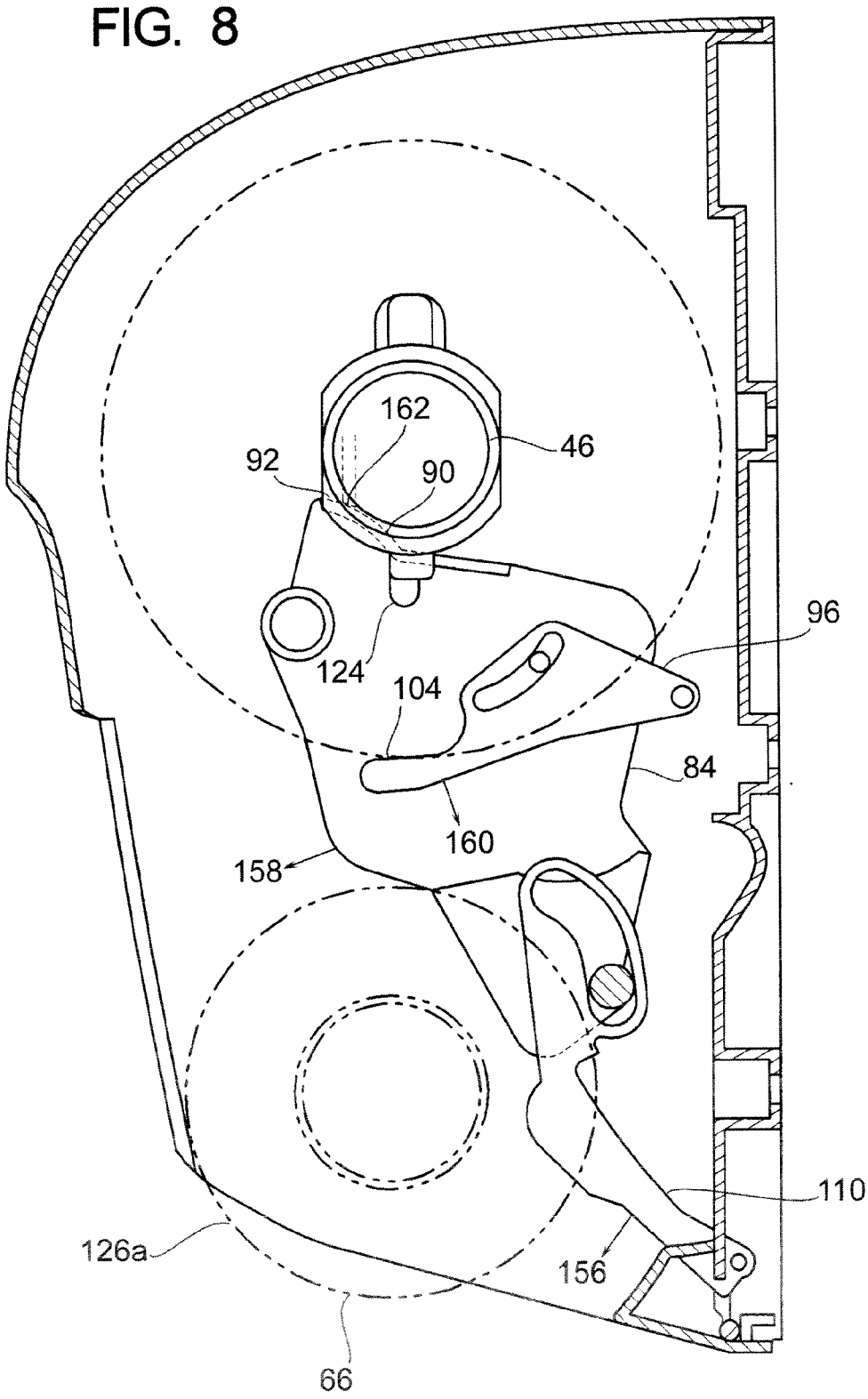
FIG. 8 is a cutaway side view of the left side of one embodiment of the disclosure in a closed and operational position with the primary roll partially utilized showing the secondary lifting mechanism.
Figure 10:
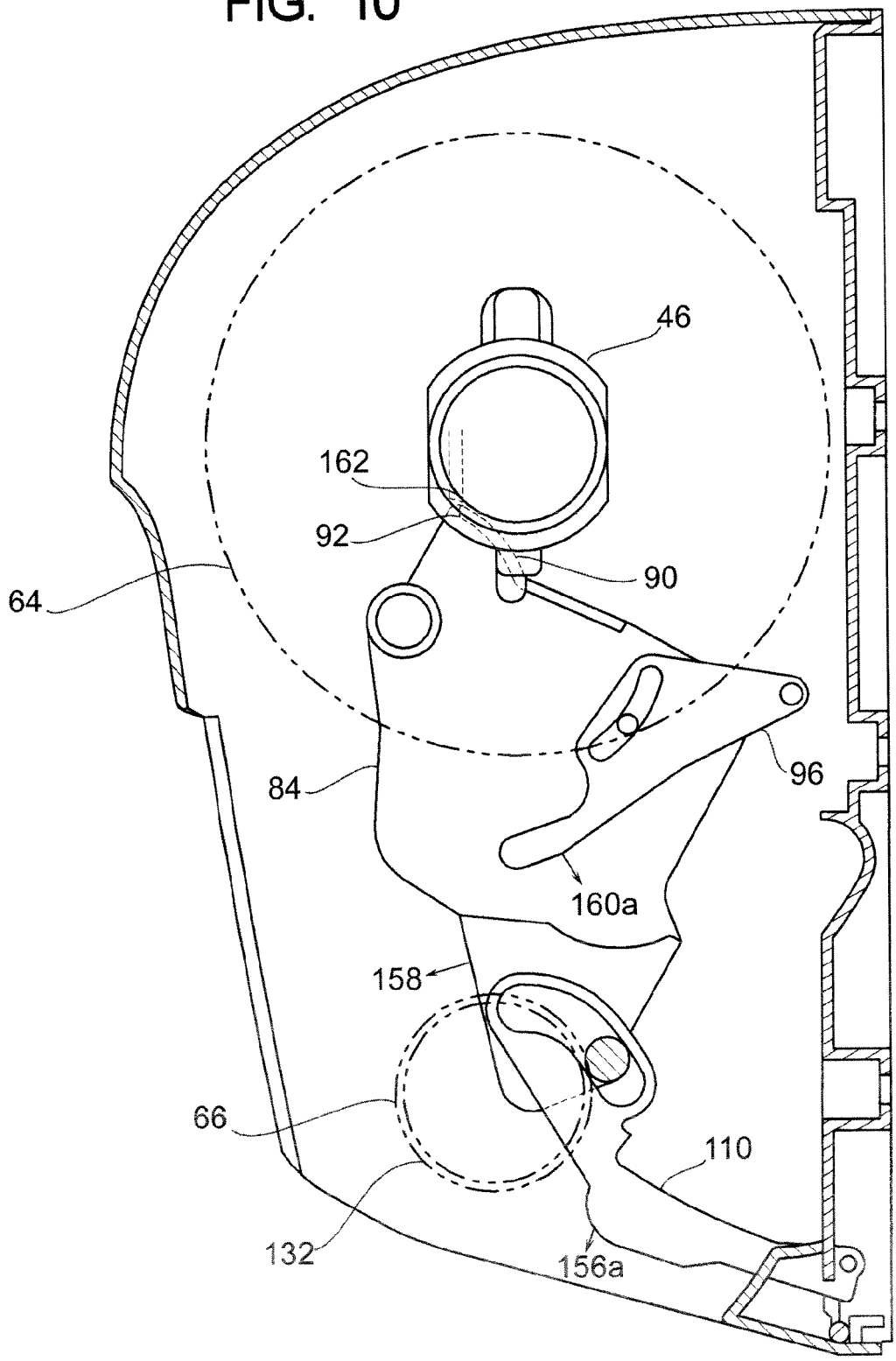
FIG. 10 is a cutaway side view of the left side of one embodiment of the disclosure in a closed and operational position with the primary roll substantially removed showing the secondary lifting mechanism.

Now looking at FIGS. 5, 8, and 10, it can be seen how the same sequence is achieved in views showing the reset mechanism 154 of one embodiment. Once again, FIG. 5 shows a primary roll 66 as a substantially new roll wherein the outer surface 126 comes very close to its maximum position against the frame at the position indicated at 154. The secondary roll support 46 is in its uppermost reserve position. The lower member 110 is shown positioned very near the frame 30 and the upper member 84 is in its position to engage the secondary support 46. However, the seer point 92 has not passed beyond the seer latch 162. Now moving on to FIG. 8, it can be seen how the outer surface 126*a* of the primary roll 66 has a substantially reduced diameter and the lower member 110 has pivoted in a direction as indicated at 156. Thus, in turn, the upper member 84 has pivoted in the direction as shown at 158, and the lifting member 96 has pivoted in the direction as shown at 160 wherein the engagement surface 104 of the lifting member 96 is no longer in contact with the surface 124 of the secondary roll support 46. Moving on to FIG. 10 the core 132 of the primary roll 66 is substantially consumed, exposing the core 132, and the lower member 110 has rotated in direction 156*a* to its furthest position. Thus, the upper member 84 has rotated to its furthermost position as indicated in direction 158 and the lifting member 96 has rotated to its furthest position as indicated in direction 160*a*. Looking closely at the point where the upper member 84 comes in contact with the secondary roll support 46, it can be seen that the seer latch 162 is still in contact with the cam surface 90 of the upper member 84. In one embodiment, as the upper member 84 rotates such that the cam surface 90 is no longer in contact with the seer latch 162, to be more specific the seer point 92 has passed beyond the edge of the seer latch 162, it can be seen how the secondary roll support 46 will then drop down, exposing the secondary product roll 64 through the opening 23 to an operational position.

Figure 11:
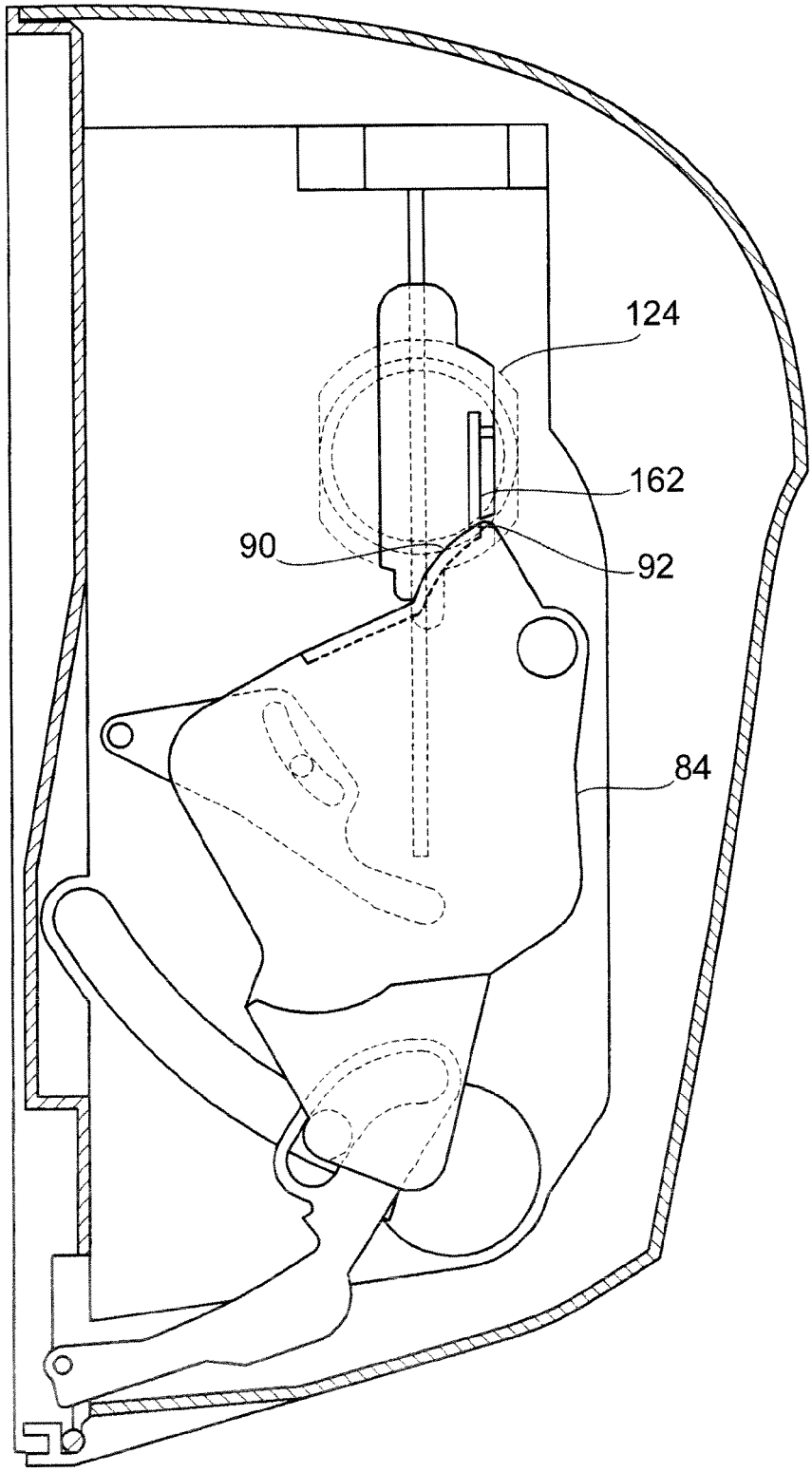
FIG. 11 is a cutaway side view of the right side of one embodiment of the disclosure in a closed and operational position with the primary roll substantially utilized.
Figure 13:
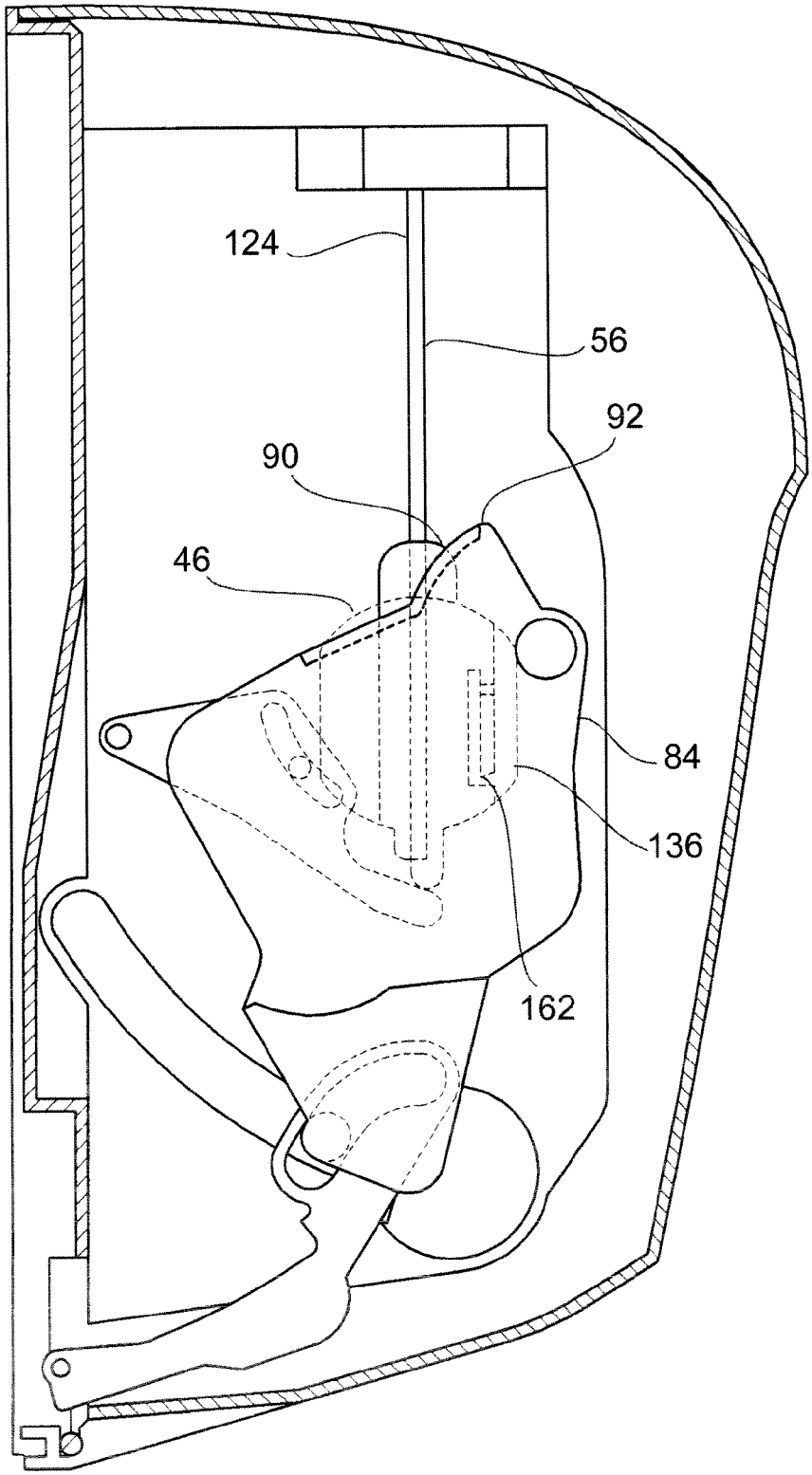
FIG. 13 is a cutaway side view of the right side of one embodiment of the disclosure in a closed and operational position with the primary roll removed and the secondary roll in position to be utilized.

This particular embodiment of a seer mechanism can further be seen in FIGS. 11 and 13, wherein at FIG. 11 the primary roll is not completely consumed and the secondary roll is still in its reserve position. In FIG. 13 however, the seer latch 162 is no longer in contact with the cam surface 90, and the upper member 84 is rotated such that the seer point 92 has passed beyond the seer latch 162 and the secondary roll support 46 has dropped along the vertical channel 56 from the reserve position 124 to the operational position 136.

Now looking at FIG. 16, the reset series as previously discussed is shown from the left transverse side, showing once again the reset mechanism 154. As has been previously discussed, as the casing 22 is rotated to an open position, forces are exerted upon the lower member and other associated portions of the reset mechanism 154 to reposition the swing arm 72 to a position furthest from the primary roll support 34, and in one embodiment, substantially simultaneously reposition the secondary roll support 46 from the operational position 136 to the reserve position 124.

Figure 3A:
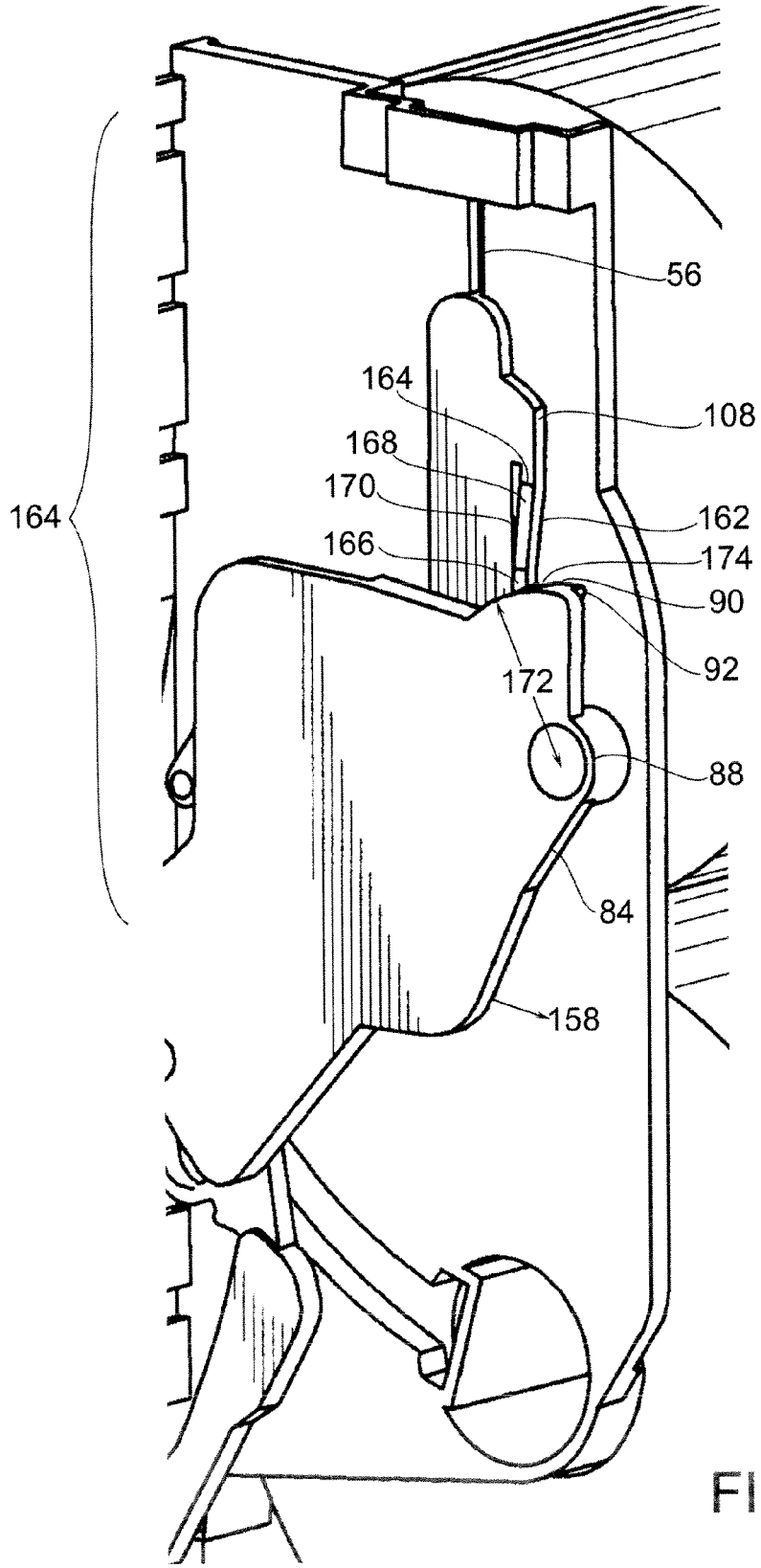
FIG. 3*a* is a detail view of a release mechanism of FIG. 3.
Figure 4:
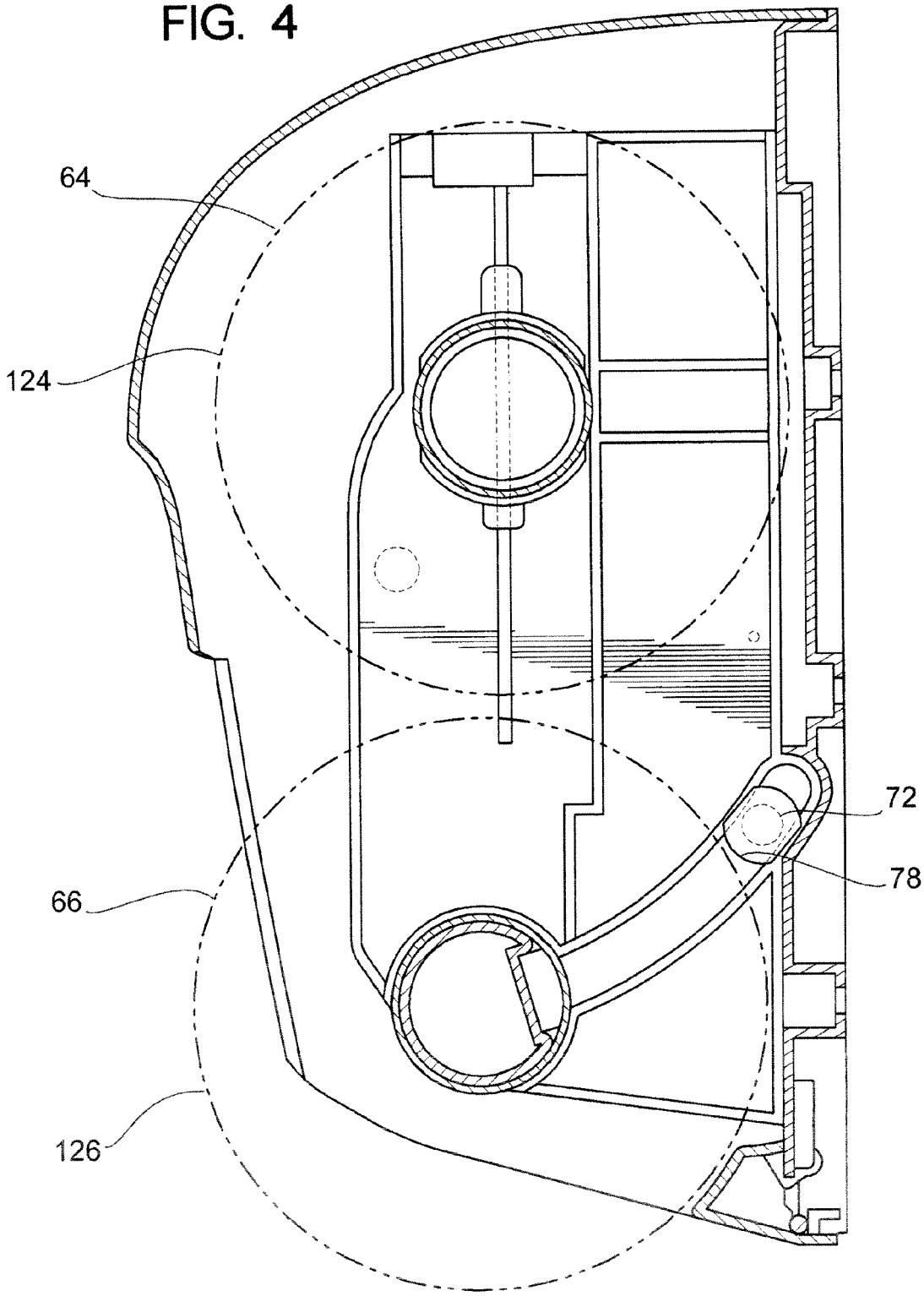
FIG. 4 is a cutaway side view of the left side of one embodiment of the disclosure in a closed and operational position with the primary and secondary rolls complete.

Now looking at FIG. 3*a*, a detailed view of the release system 164 in one form can be seen. As previously discussed, the vertical sliding member 108 rides substantially within the vertical channel 56, which allows it to move vertically but hinders any rotation or lateral or transverse motion. The seer latch 162 in this embodiment is comprised as a portion of the vertically sliding member 108. As can be seen, the seer latch 162 comprises a first end 164 and a second end 166. Furthermore, the seer latch 162 comprises a back side or surface 168 and generally consists of a spring portion 170. The second end 166 of the spring portion 170 rides along the cam surface 90 of the upper member 84. As the primary product roll is consumed, the upper member 84 is caused to rotate about the upper member pivot 88 in the direction indicated at the arrow 158. As can be seen, the radius 172 between the center of the upper member pivot 88 and the cam surface 90 allows the second end 166 to ride along the cam surface 90 with no substantial movement of the vertical sliding member 108. Once, however, the upper member 84 rotates such that the second end 166 of the seer latch 162 passes the seer point 92, the entire secondary roll support 46 is released downward from the reserve position to an operational position.

In this embodiment, one advantage of the spring portion 170 is that as the casing is opened, resetting the device as previously discussed, the upper member 84 tends to rotate prior to repositioning the vertically sliding member 108. Thus, as the vertically sliding member 108 is repositioned upwardly along the vertical channel 56, the spring portion 170 deforms and the back surface 168 rides against the transverse inward edge 174 of the cam surface 90. Once the second end 166 passes vertically beyond the cam surface 90, the spring portion 170 reforms to its original orientation and as the vertically sliding member is released. The second end 166 once again engages the cam surface 90 and the process begins again.

Figure 17:
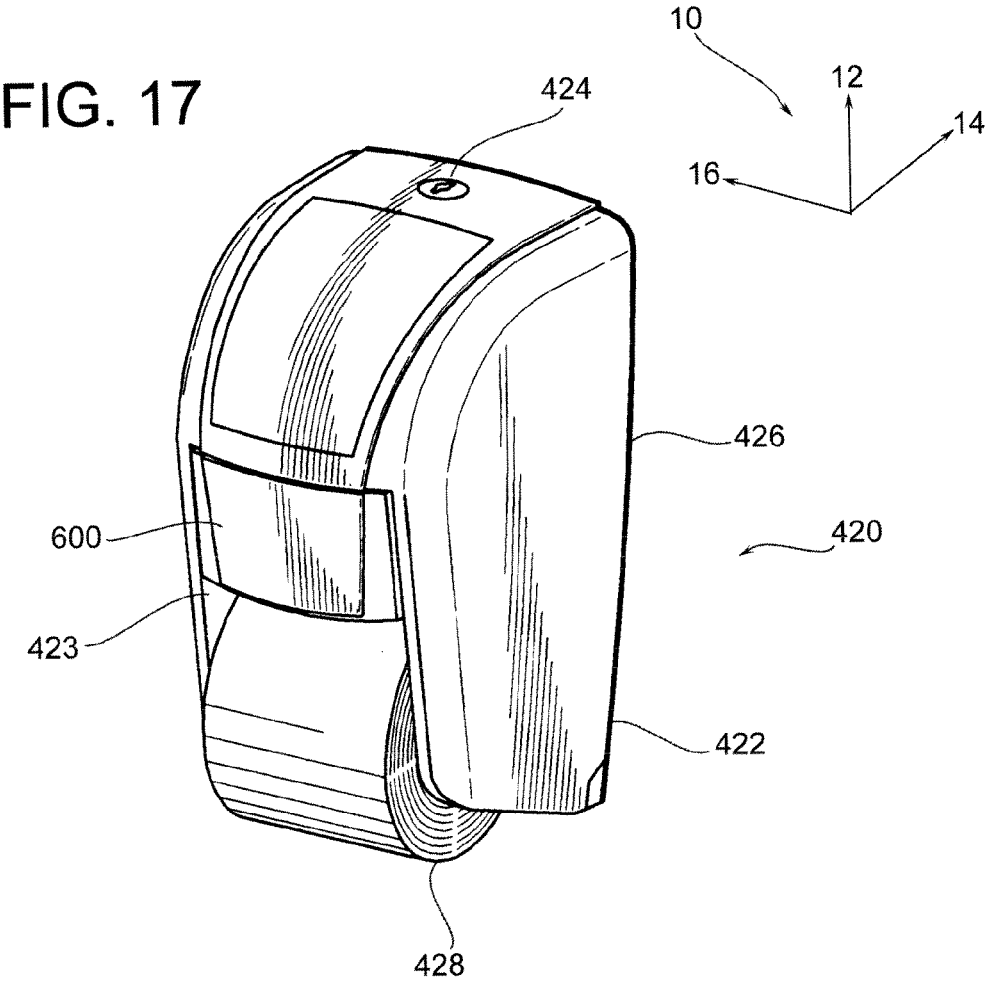
FIG. 17 is an isometric view of one embodiment of the disclosure in a closed position.

Looking at FIG. 17 is shown another embodiment of a dispenser 420, including a casing 422 and a latching mechanism 424. As shown, the dispenser 420 is in the closed position and is ready for operation. The back side 426 of the casing 422 could be attached to a structure such as a wall or door. A casing door 600 is provided, partially covering an opening 423 in the casing which controls access to a secondary roll of product. A product roll 428 is shown which in one form is a roll of toilet paper. Obviously, the dispenser 420 can be scaled to fit other rolls such as paper towels or the like.

Figure 18:
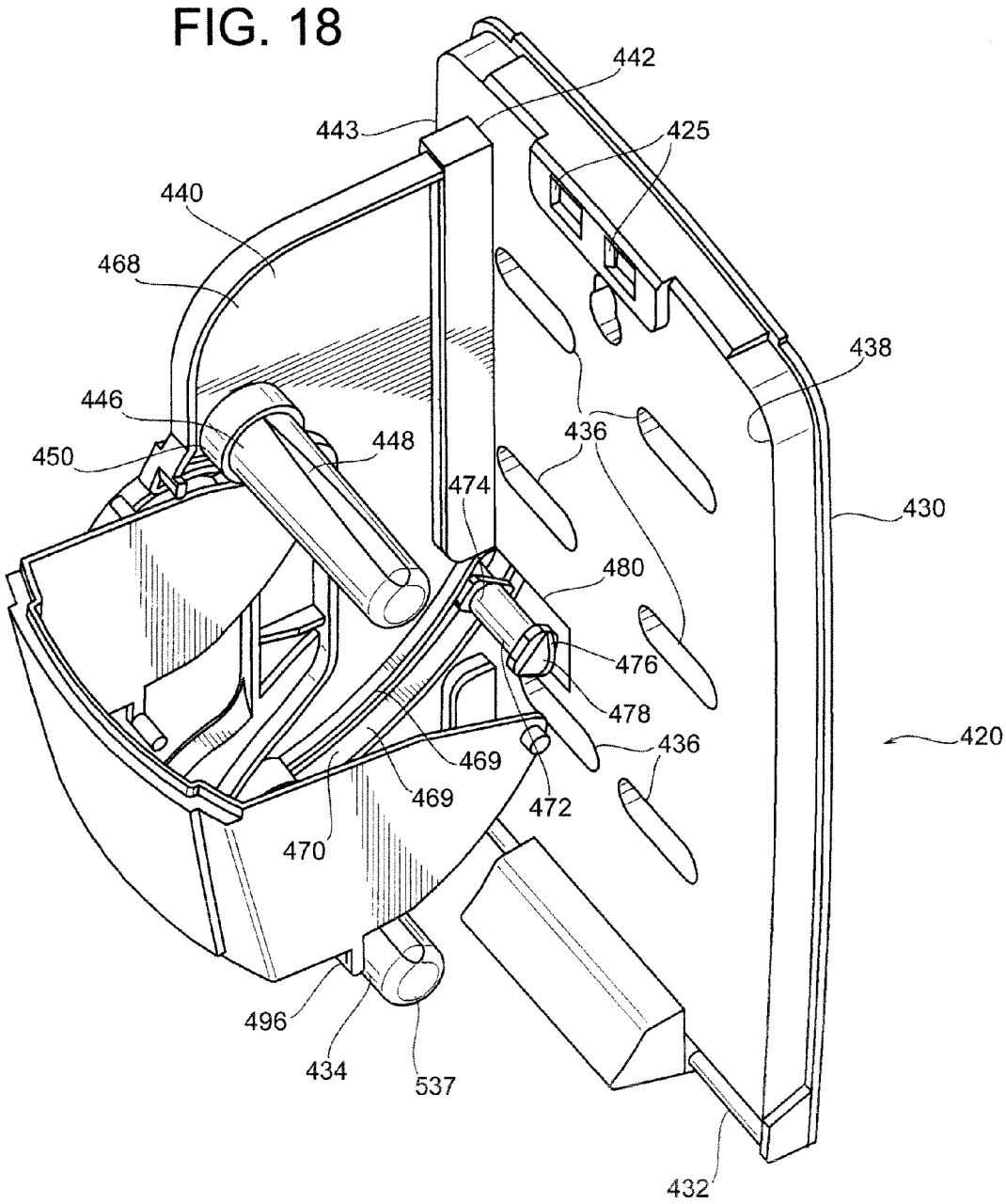
FIG. 18 is an isometric view of one embodiment of the disclosure from the left side with the casing and product rolls removed to show the mechanism.

Looking at FIG. 18, there is shown the dispenser 420 in one form with the casing 422 and product roll 428 removed. The casing in one form could normally be rotatably attached to the frame 430 at the casing pivot 432. In one form the casing pivot 432 is at the vertically lowermost extreme of the frame 430. The product roll 428 could be disposed upon the primary roll support 434. As previously mentioned, a latching mechanism 424 is shown (in FIG. 17) at the vertically upward portion of the frame 430. The latching mechanism 424 engages the surfaces defining openings 425 near the topmost portion of the frame 430. As such latching mechanisms are known in the art, many such latching mechanisms could be made to operate as desired. A plurality of mounting holes 436 are shown in FIG. 18 which could be utilized to couple the frame 430 to a structure such as a wall or door by way of fasteners such as screws, nails and the like.

One embodiment of the frame 430 includes a face side 438. Attached to the face side 438 of frame 430 is a lateral extension 440. The lateral extension is substantially a vertical wall-like structure having a first end 442 coupled to the face side 438 of frame 430. In the embodiment shown in FIG. 18, the lateral extension 440 is attached via a box-like portion 443. The lateral extension 440 may be coupled to the face side 438 by way of frictional engagements, adhesive, or may conceivably be formed as a unitary structure. The lateral wall extension 440 provides a structure for supporting the primary roll support 434, the secondary roll support 446, and other elements. The primary roll support 434 may be formed as part of the lateral extension 440 or may be attached thereto by way of frictional engagements or adhesives.

Figure 20:
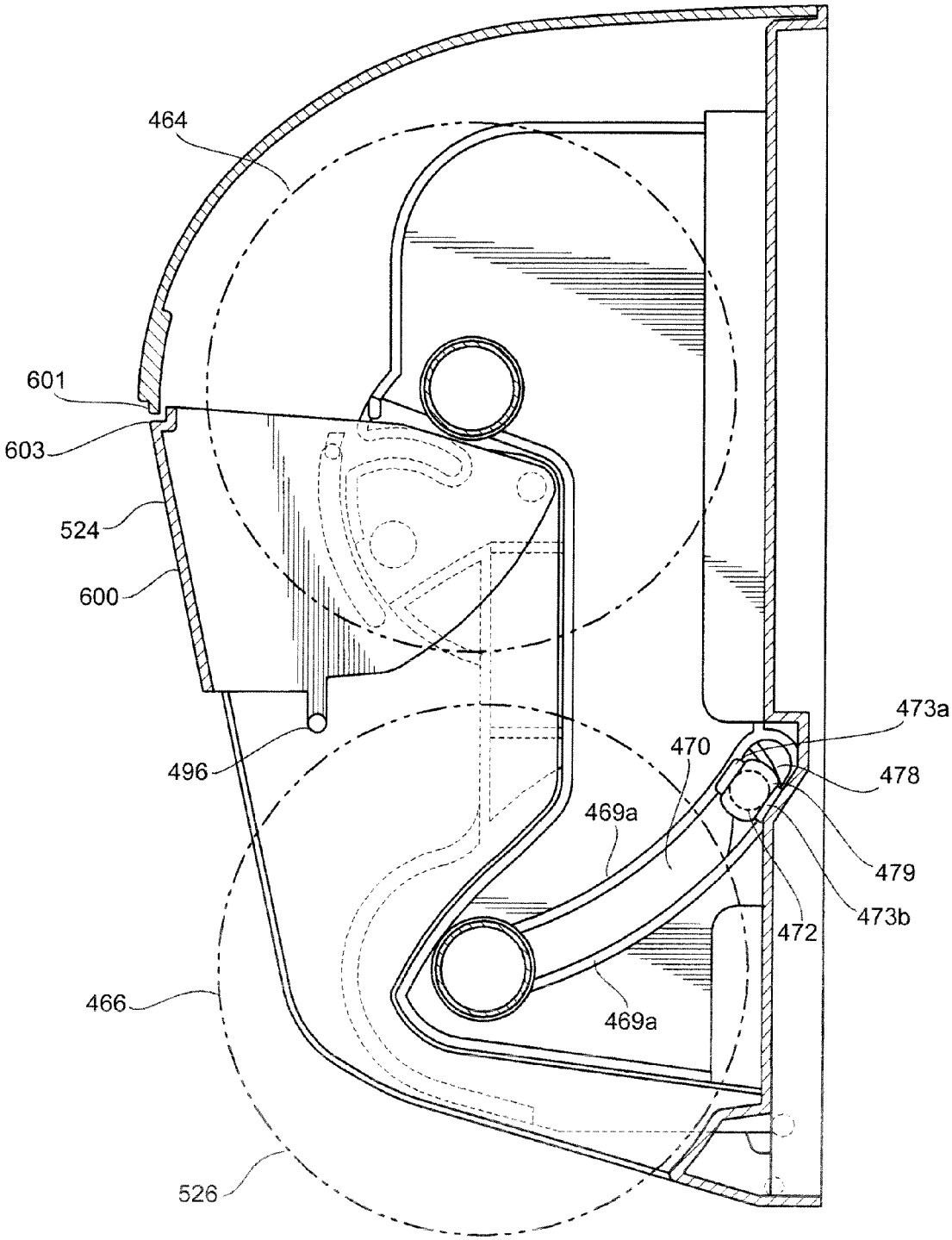
FIG. 20 is a hidden line side view of the left side of one embodiment of the disclosure in a reserve position with the primary and secondary rolls complete.

A secondary roll support 446 is also provided which extends transversely from the lateral extension 440 and in one form is substantially a cylinder. The secondary roll support 446 includes an extension 448 which is coupled to a secondary roll support base 450. The secondary roll support 446 is configured to support a secondary product roll 464 as shown in FIG. 20. Similarly, the primary roll support 434 is configured to support a primary product roll 466. Referring back to FIG. 18, a plurality of surfaces 469 defining a channel 470 may be disposed in the lateral extension 440 configured to allow passage and movement of a swing arm 472. Referring to FIG. 5, as the swing arm 472 is attached to the upper member 484, which exhibits about an upper member pivot 488, it may be convenient to have these surfaces 469 form and arc centered about the center of the upper member pivot 488. Looking again at FIG. 2, the swing arm 472 having a first end 474 near the face side 468 of lateral extension 440, and a second end 476 substantially distant from the face side 468 of lateral extension 440. The swing arm 472 furthermore has an engagement portion 478 configured to ride on the outer surface of the primary product roll 466 as the primary product roll 466 is being used. The frame 430 may also include a recess 480 disposed within the face side 438 configured to accept a portion of the swing arm 472 when it is in position furthermost from the primary roll support 434.

The primary roll support 434 of one embodiment may also include a channel 82 as shown in FIG. 2 configured to receive a portion of the swing arm 472 when the swing arm 472 is in position closest to the primary roll support 434. As will be discussed later, when a primary product roll 466 (see FIG. 20) is used having a partial or split core as is known in the art, the engagement portion 478 of the swing arm 472 will ride along on the outer portion of the primary product roll 466 until the primary product roll 466 is substantially consumed, at which point the engagement portion 478 will press past the end of the partial core and set substantially within the channel. The end result of this operation will be discussed in detail.

Figure 19:
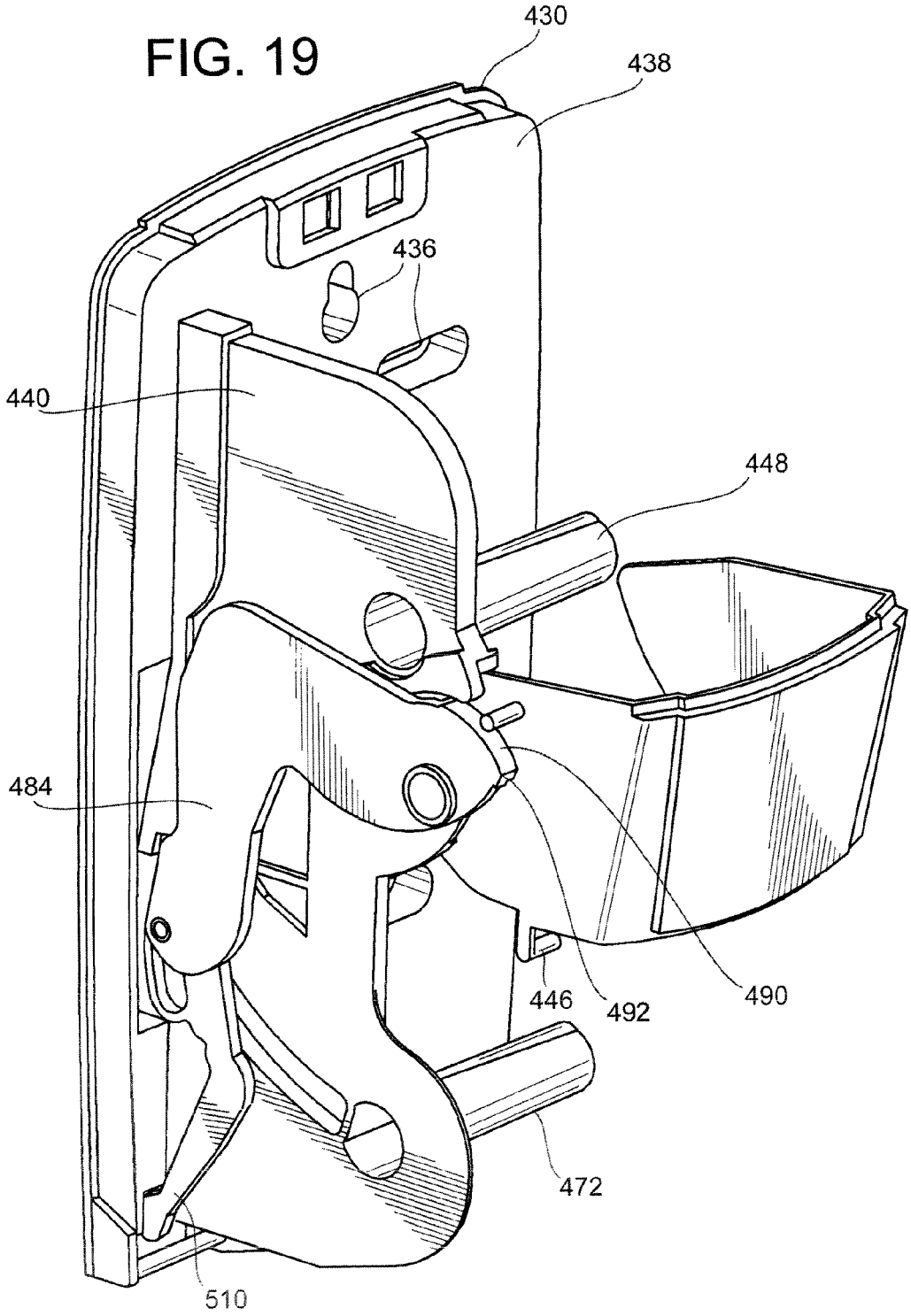
FIG. 19 is an isometric view of one embodiment of the disclosure from the right side with the casing removed to show the mechanism.
Figure 21:
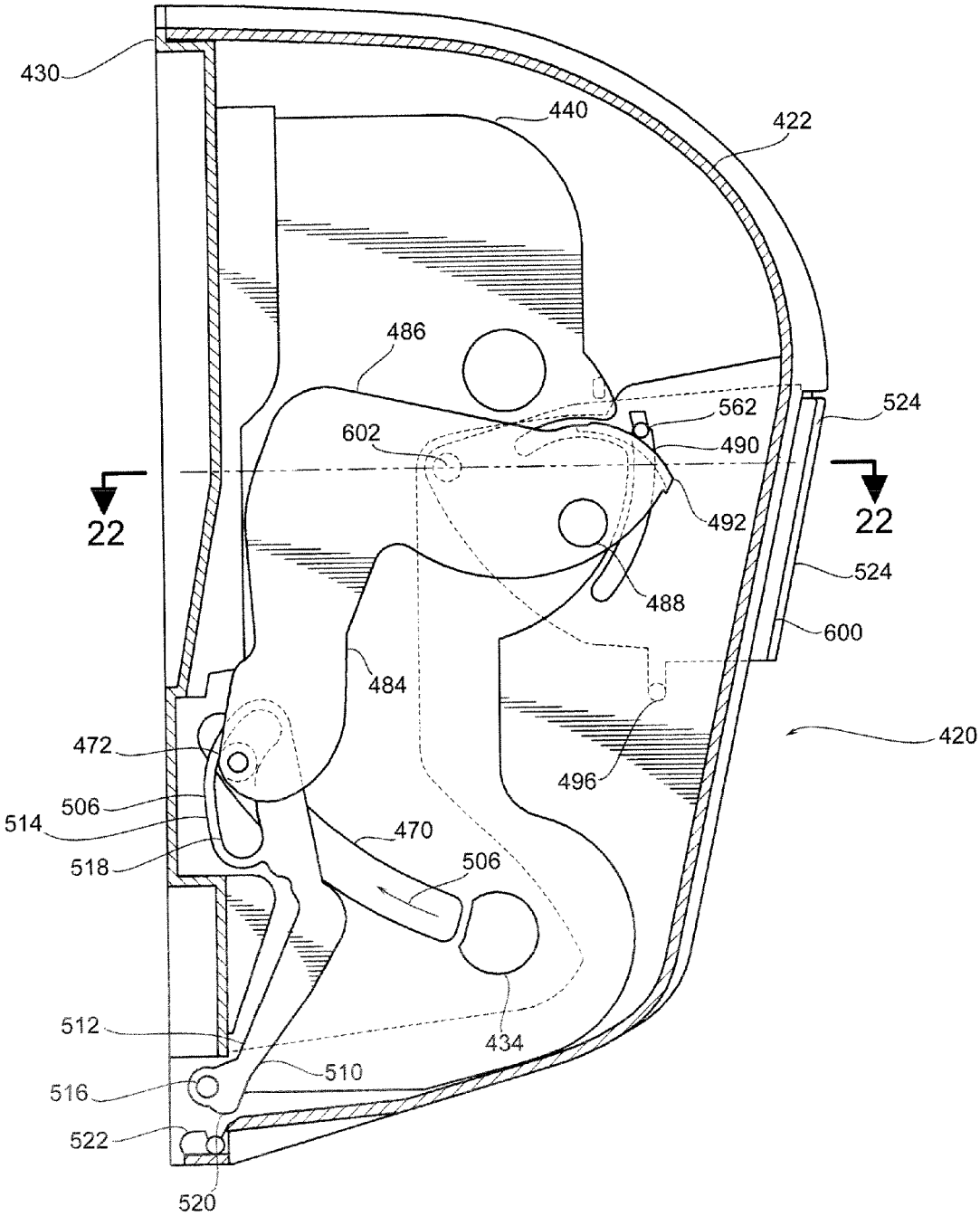
FIG. 21 is a hidden line view of the right side of one embodiment of the disclosure in a reserve position.
Figure 31:
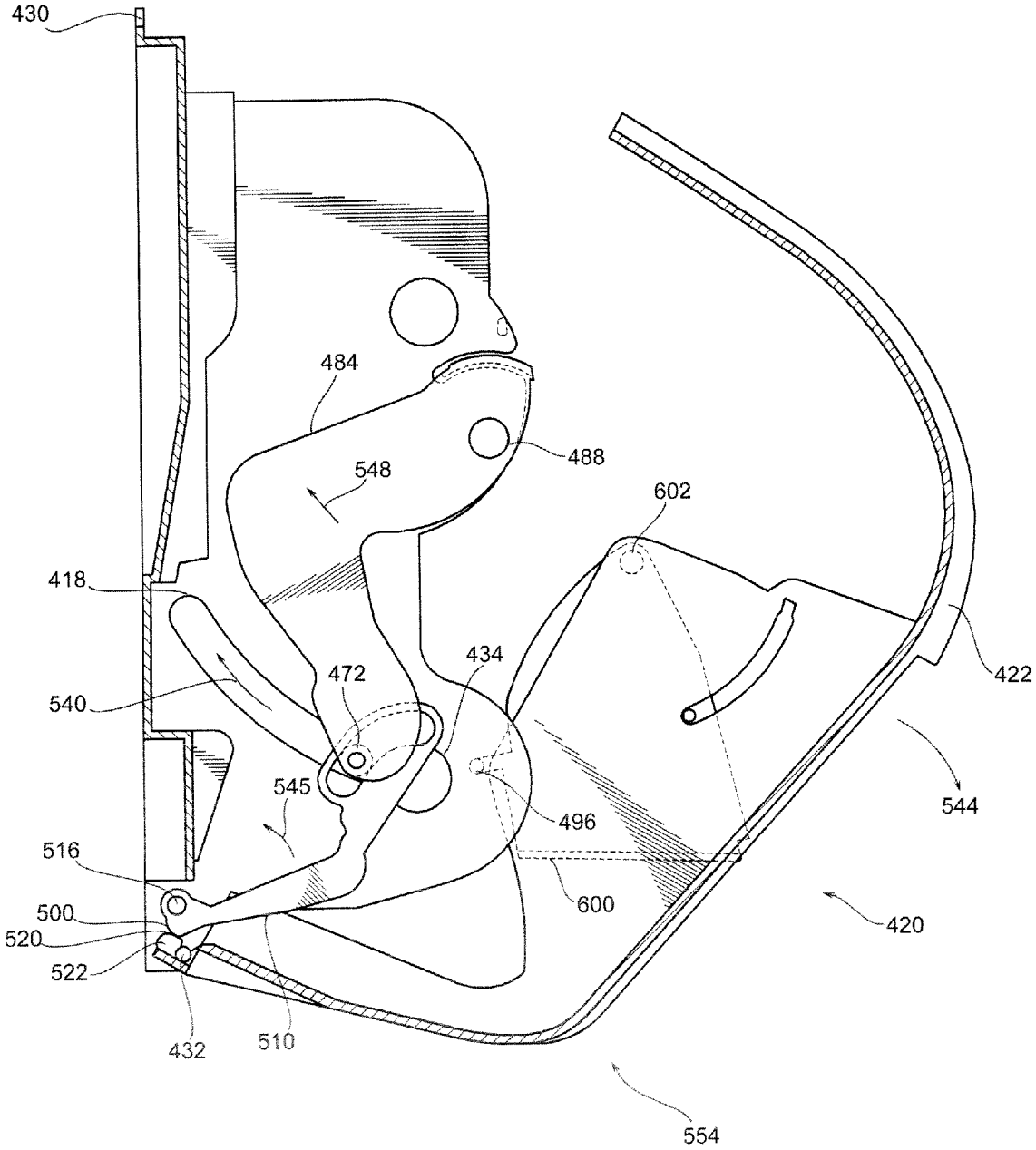
FIG. 31 is a hidden line side view of the right side of one embodiment of the disclosure in a partially open position.
Figure 33:
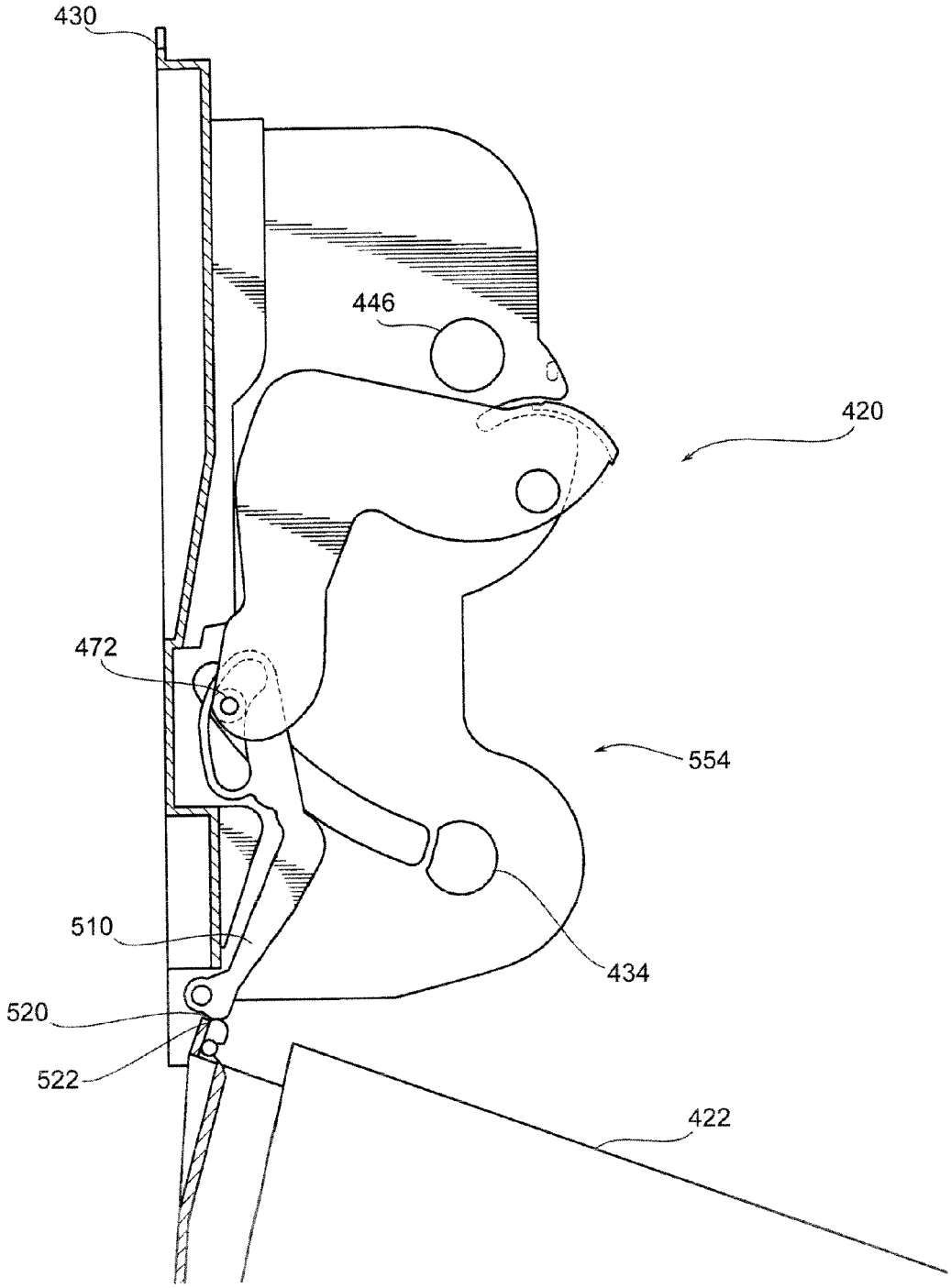
FIG. 33 is a hidden line side view of the right side of one embodiment of the disclosure in an open position with the seer mechanism reset.

Now looking at FIG. 21, a hidden line view of one embodiment of the dispenser 420 in one form is shown including the casing 422 and the frame 430, As stated before, as the primary product roll is consumed, the swing arm 472 will slide along channel 470 towards the primary roll support 434. The swing arm 472 extends from the upper member 484. The upper member 484 is shown in a reserve position 486, and is coupled to the lateral extension 440 at an upper member pivot 488. The upper member 484 further includes a cam surface 490 and a seer point 492. These can also be seen in FIG. 19 from a different angle. A lower member 510 is also shown in FIG. 21 having a first end 512 and a second end 514. The lower member 510 is coupled to the frame 430 at a lower member pivot 516. The lower member 510 could also be coupled to the lateral extension 440. The lower member 510 further comprises a plurality of surfaces forming a channel 518 configured to engage the swing arm 472. Furthermore, the lower member 510 comprises a reset surface 520 configured to frictionally engage a reset tab 522 when the casing is substantially opened as is shown in FIGS. 31 and 33.

Figure 22:
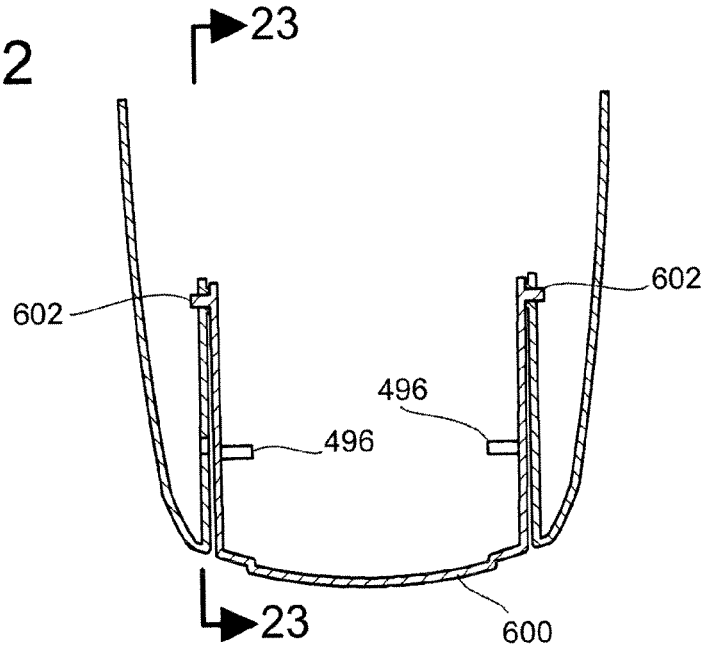
FIG. 22 is a cutaway view of one embodiment taken along line 22 of FIG. 21.
Figure 23:
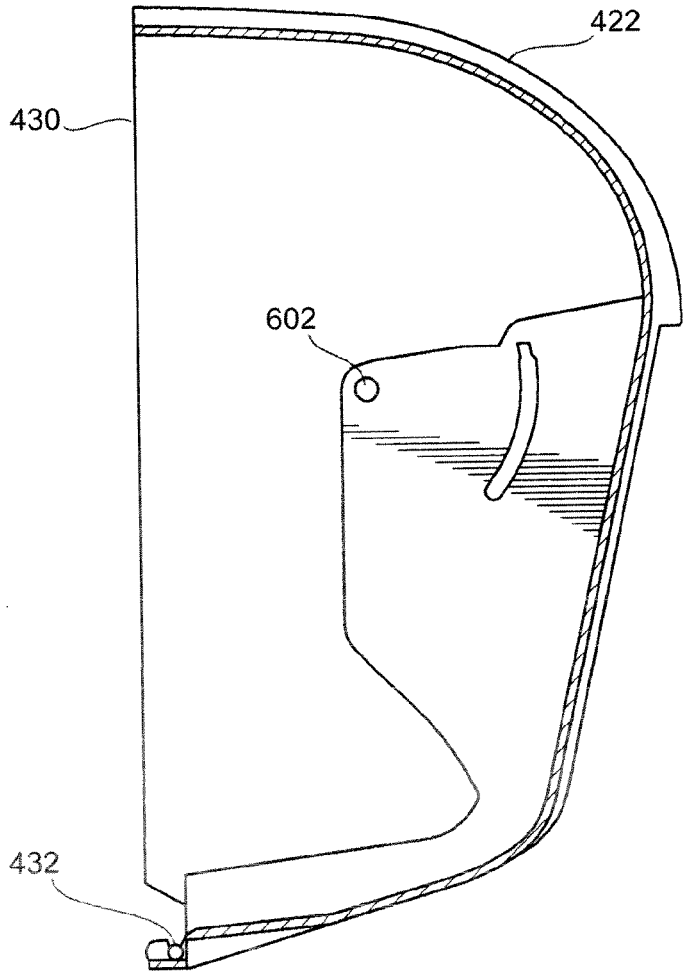
FIG. 23 is a side view of the right side of one embodiment of the disclosure.
Figure 28:
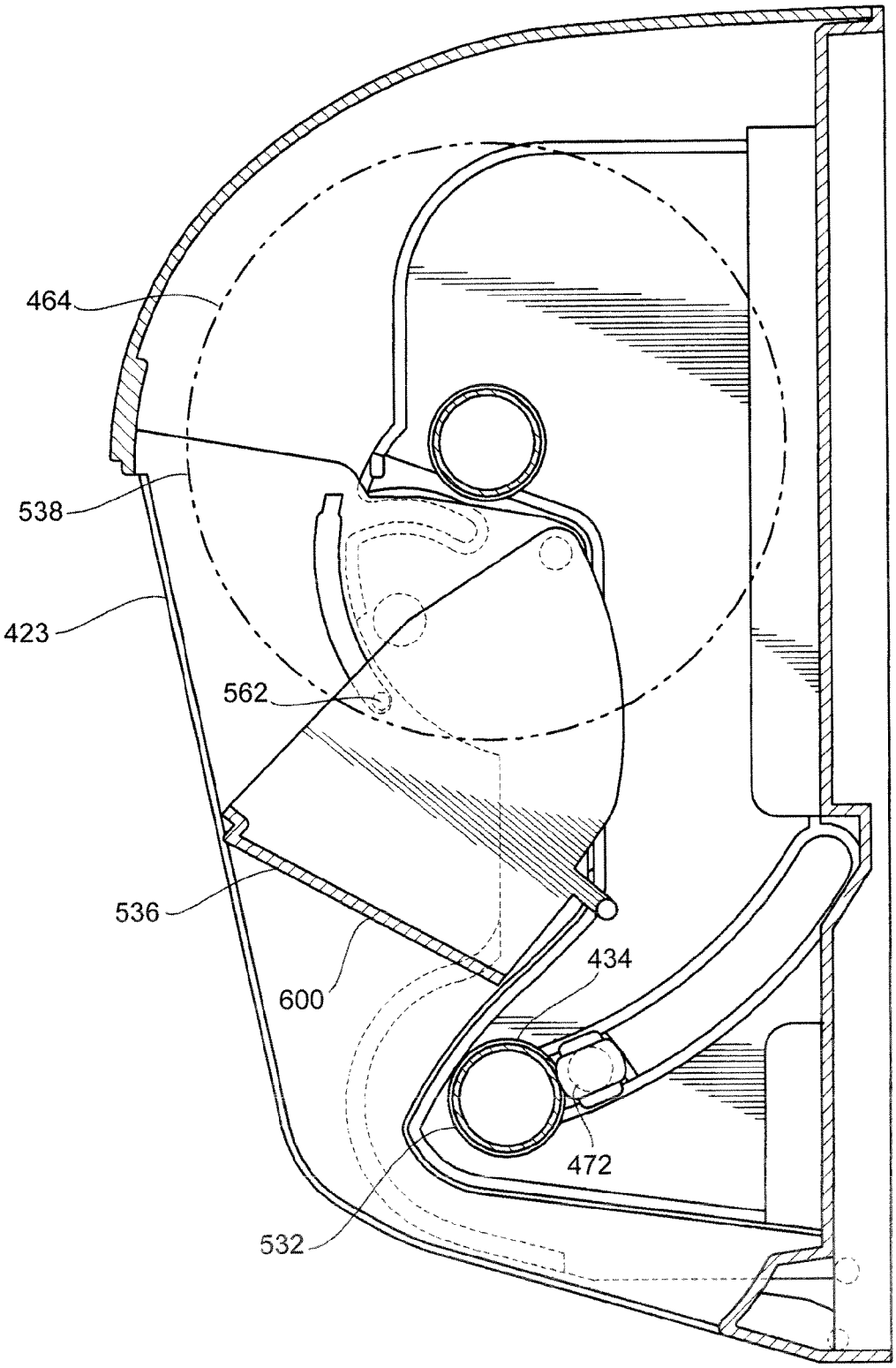
FIG. 28 is a hidden line side view of the left side of one embodiment of the disclosure in an open position with the primary roll removed, and the secondary roll accessible to be utilized.
Figure 36:
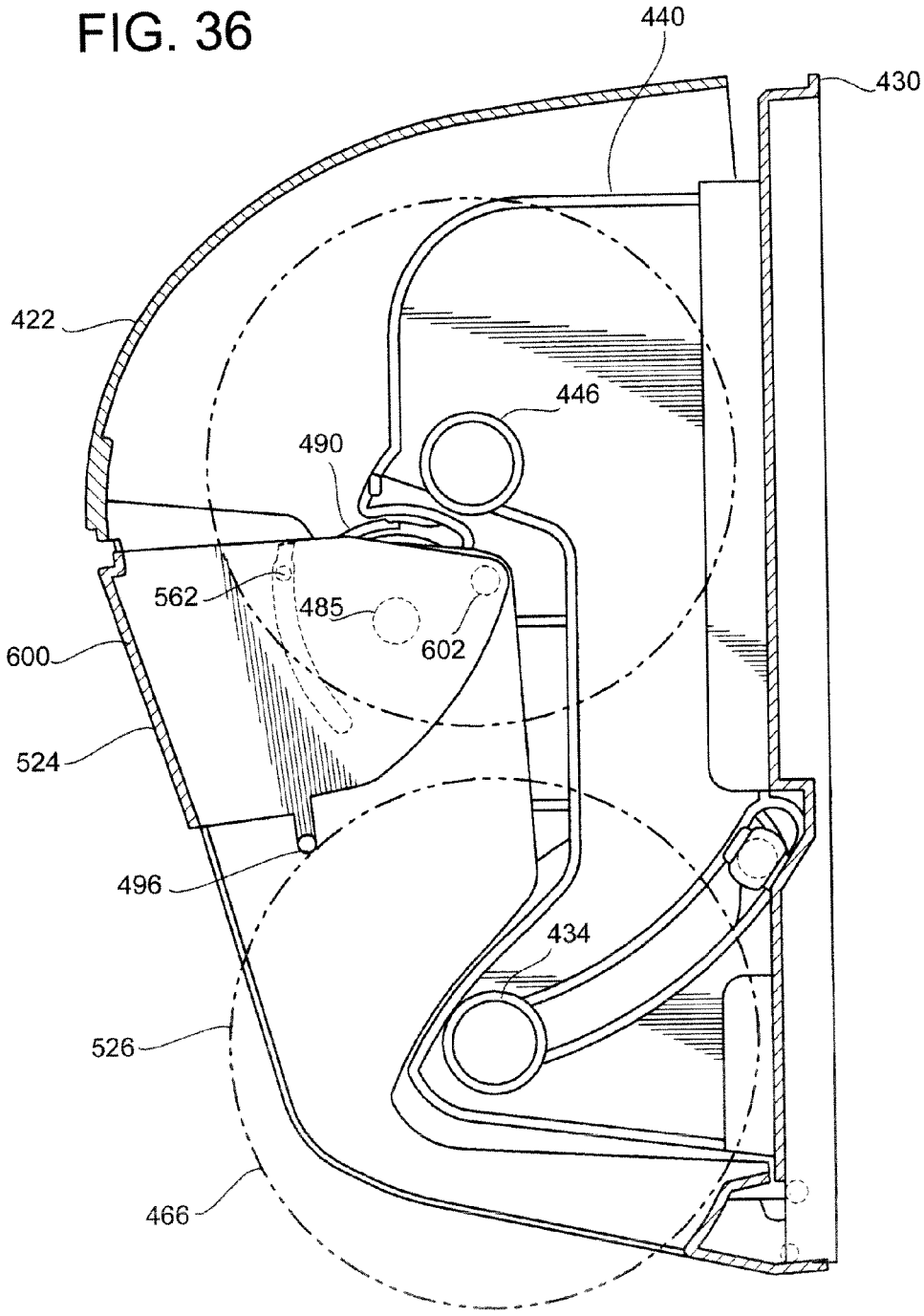
FIG. 36 is a hidden line side view of the left side of one embodiment of the disclosure substantially re-closed.

Many prior art product roll dispensers require that a person attempting to restock one or more of the product rolls would first need to reset a release (seer) latch which controls access to a secondary roll of product, reset the mechanism which releases the secondary roll, and then replace either the primary and/or the secondary rolls of product. In one embodiment of this disclosure, a dispenser 420 is provided as shown in FIG. 31 wherein releasing a latching mechanism and opening the casing 422 about the casing pivot 432 engages the reset tab 522 against the reset surface 520 of the lower member 510. This pressure tends to rotate the lower member 510 away from the primary roll support 434 in the direction indicated at 506. The motion of the lower member 510 repositions the swing arm 472 away from the primary roll support 434, allowing the primary roll to be replaced without necessitating an additional movement of a user manually repositioning the swing arm 472. Additionally, the dispenser 420 can be configured such that a lifting member 496 engages the outer surface 526 of the primary product roll 466 as in FIG. 36 which tends to rotate a casing door 600 from an open position 536 as shown in FIG. 28, to a reserve position 524 as shown in FIG. 36. Looking at FIG. 22, it can be seen how the lifting member 496 may extend from the right and/or the left transverse portion of the casing door 600. The casing pivots 602 can also be seen clearly and are furthermore shown in FIG. 23 rotatably coupled to the casing 422. A casing door pivot 602 is provided which rotationally couples the casing door 600 to the lateral extension 440. As such, if the secondary product roll 464 and/or primary product roll 466 is substantially consumed, a user could replace it with a new unused roll. At this point the casing 422 could be closed, reengaging the latching mechanism at which point the apparatus is once again ready for use. This reset mechanism would save a considerable amount of time and effort as the motion of opening and re-closing the casing 422 repositions the seer mechanism and the casing door 600 to a reserve position 524.

Looking at FIGS. 20, 24, 26, 28, 30, 32, 34, and 36, a progression of one embodiment is shown beginning with FIG. 20, wherein the primary product roll is consumed, the mechanisms are engaged, and upon complete consumption of the primary product roll, the casing door is opened providing access to a secondary product roll 464, the consumed product rolls are replaced, and the casing is re-closed. These actions reset the apparatus of the dispenser 420. Looking at FIG. 20, a primary product roll 466 is shown being a substantially new roll. The casing door 600 is closed and thus, the secondary product roll 466 is not available for use by a consumer. This can be seen by looking at FIG. 1, and at FIG. 4 where the casing door 600 is in the closed or reserve position 524 and the lip 601 of the casing 422 overlaps the recess 603 of the casing door 602. Also shown is the swing arm 472 including the engagement portion 478 which is in position to frictionally engage the outer surface 526 of the primary product roll 466. Obviously, friction reducing agents such as Teflon, plastic, a wheel, or other mechanism can also be employed to reduce friction between the swing arm 472 and the outer surface 526 of the primary product roll 466. A plurality of tabs 473*a* and 473*b* may also be utilized to maintain the swing arm 472 upon the plurality of surfaces 469*a* and 469*b* to maintain their position upon the channel 470.

Figure 24:
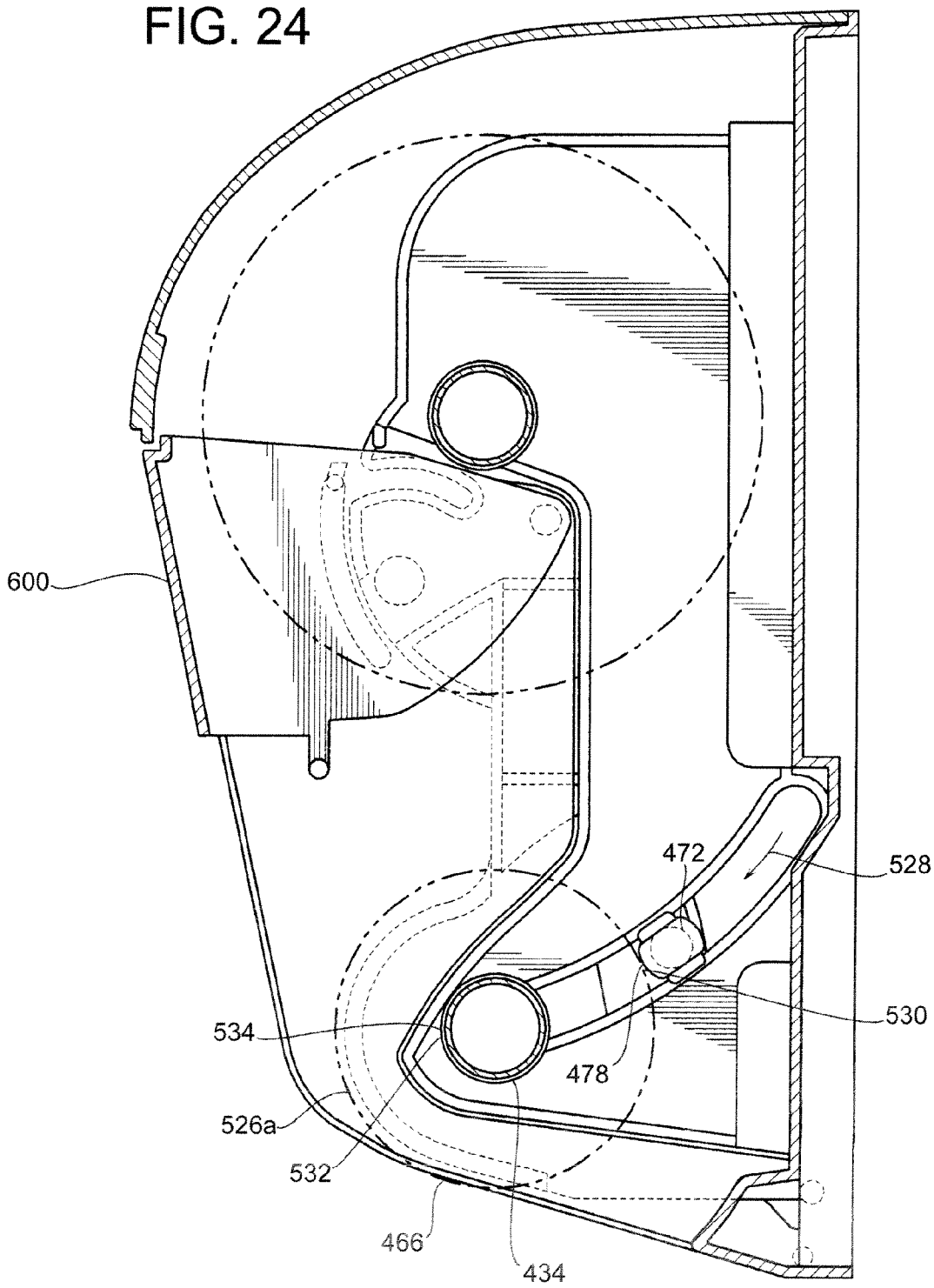
FIG. 24 is a hidden line side view of one embodiment from the left side.
Figure 25:
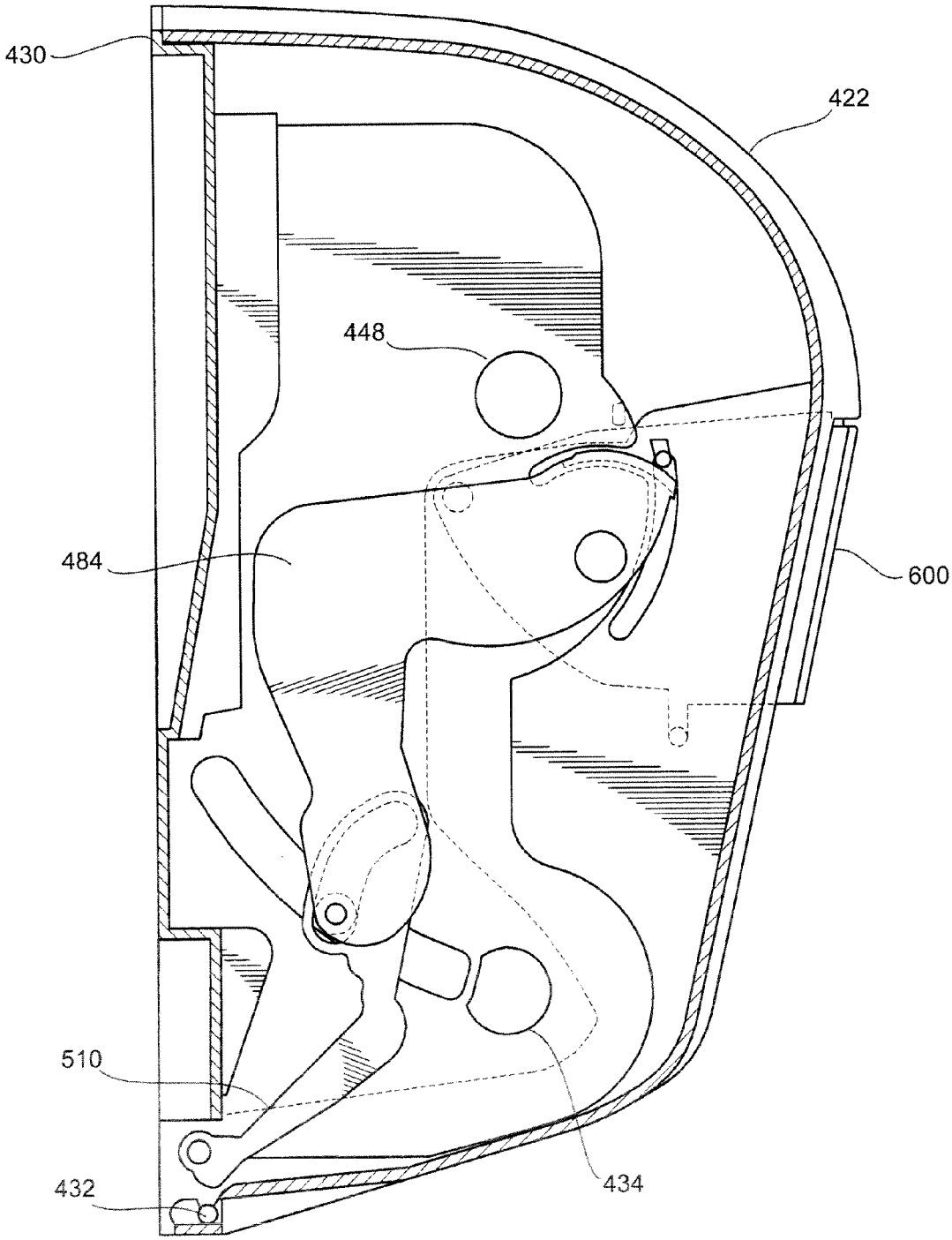
FIG. 25 is a hidden line side view of the right side of one embodiment of the disclosure in a reserve position with the primary roll substantially utilized.
Figure 26:
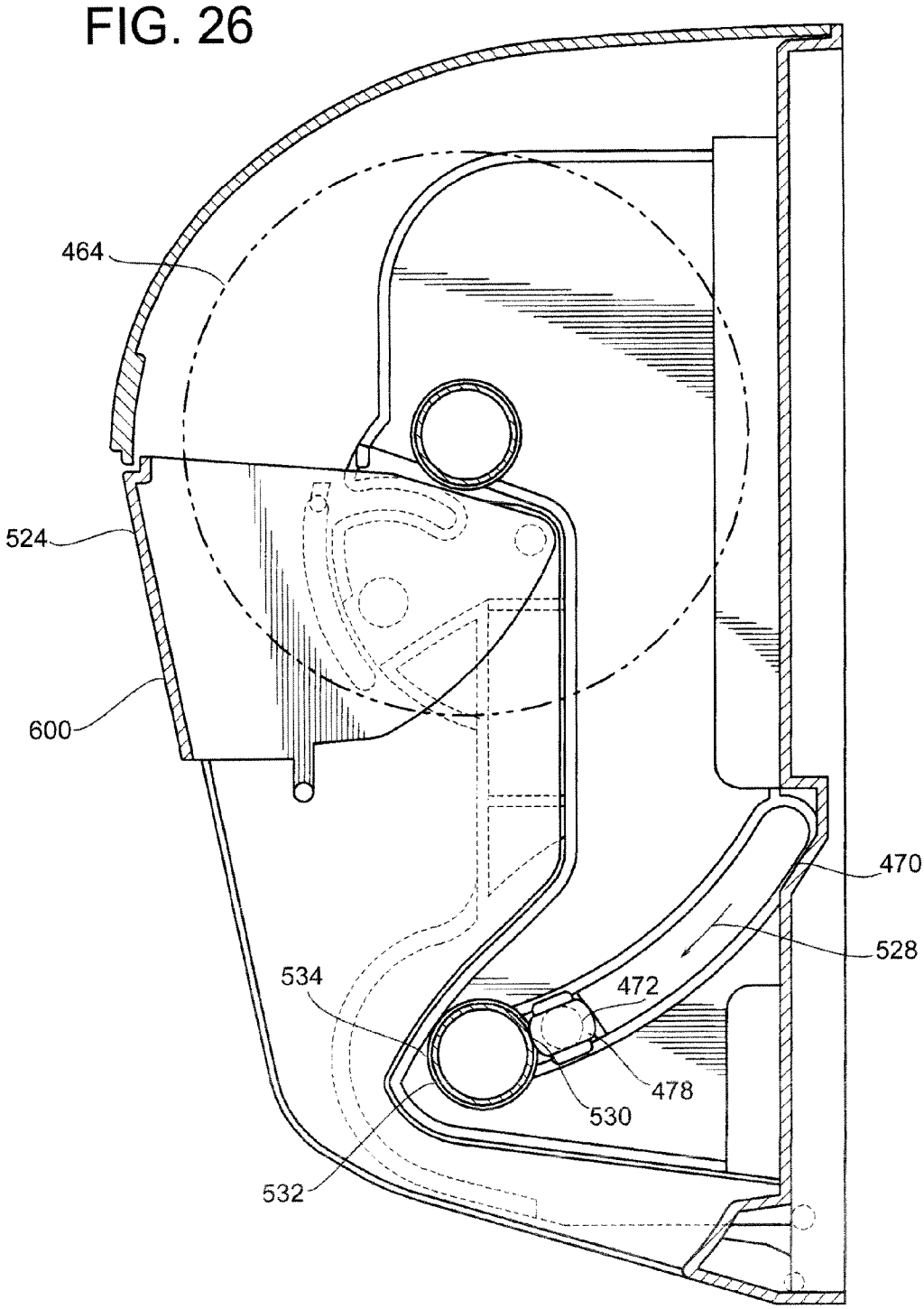
FIG. 26 is a hidden line side view of the left side of one embodiment of the disclosure in a closed and operational position with the primary roll substantially utilized showing the secondary lifting mechanism.

Looking at FIG. 24, it can be seen how the swing arm 472 moves in the direction of travel 528 as the outer surface 526*a* reduces in diameter when the primary product roll 466 is consumed. As shown, the engagement portion 478 is engaging the outer surface 526*a* at point 530. As shown, the primary product roll 466 includes a core 532 having an outer diameter 534. In one form, the core 532 is a partial or split core wherein one portion of the core is supported by the primary roll support 434 and any other portions of the core extend from the transverse end 537 of the primary roll support 434 as shown in FIG. 18. Thus, as shown in FIG. 26 wherein the casing door 600 is still in the reserve position 524, the swing arm 472 has traveled in the direction of travel 528 along channel 470 beyond the outer diameter 534 of the core 532. The majority of the swing arm 472 would, of course, not extend beyond the outer diameter 534 of the core 532, however, the engagement portion 478 would extend beyond the outer diameter 534.

As the primary product roll 466 s substantially consumed, the casing door 600 of one embodiment of the disclosure is released as shown in FIG. 28, and from the reserve position 524 as shown in FIG. 26 to the open position 536 as shown in FIG. 28. In this position, a consumer would have access to the outer surface 538 of the secondary product roll 464 through the opening 423.

At this stage it would be inconvenient to replace the primary product roll with a new roll as the swing arm 472 could interfere with such action. Thus, an embodiment is disclosed wherein as shown in FIG. 31, as the casing 422 is opened about pivot point 432 in direction of travel 544, the reset tab 522 engages the reset surface 520 of the lower member 510, which forces the lower member 510 to pivot about the lower member pivot 516 in direction of travel 545 and repositions the swing arm 472 in the direction of travel as shown at 540. This provides sufficient space between the primary roll support 434 and the swing arm 472 to replace the consumed core with a new primary roll of product.

Figure 30:
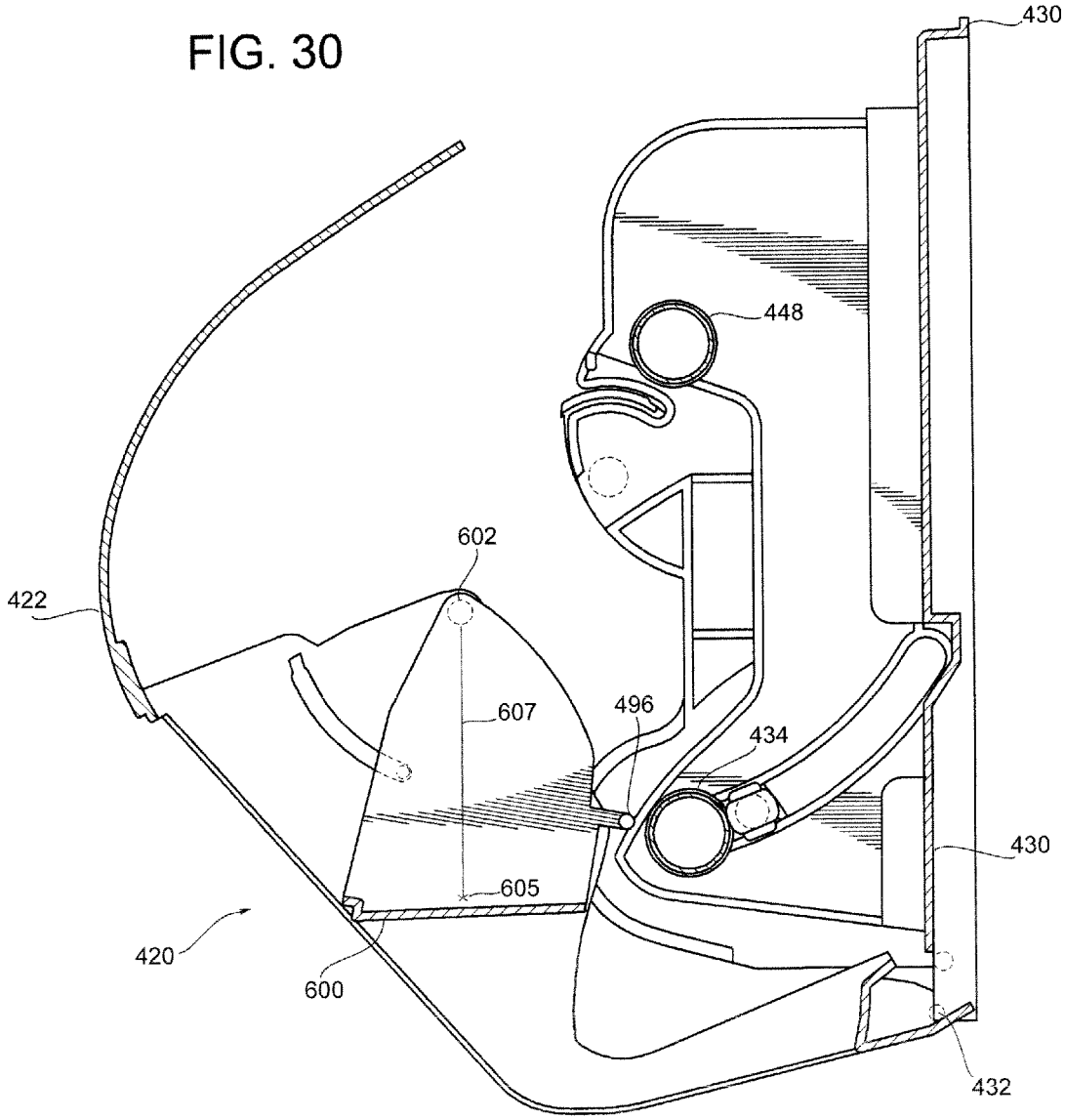
FIG. 30 is a hidden line side view of the left side of one embodiment of the disclosure in a partially open position.

Now looking at the embodiment shown in FIG. 30, the latching mechanism has been released, and the casing 422 has been partially opened, and rotated about casing pivot 432.

FIG. 31 shows the dispenser 420 in the same position as FIG. 30, but from the right side. In both of these views, it can be seen is how the lifting member 496 has moved a short distance away from the primary roll support 434 as the casing 422 is opened. As the casing 422 continues to rotate to a more open position, the casing door pivot 602 will thus be caused to move further from the casing frame 430. Looking at FIG. 30, it can be seen how as the casing door 600 is allowed to freely pivot about the casing door pivot 602. The center of gravity 605 of the casing door 600 will tend to remain vertically below the casing pivot 602 as the casing 422 is opened and closed. As the casing 422 is opened about casing pivot 432, and the casing pivot 602 moves laterally away from the frame 430, the center of gravity 605 of the casing door 600 will remain in a line 607 which is substantially vertically below the casing pivot 602. Thus the lifting member 496 will tend to be repositioned away from the primary roll support 434. This allows for a primary roll of product to be positioned on the primary roll support 434 without the additional effort of moving the casing door 600 nor the lifting member 496.

Figure 34:
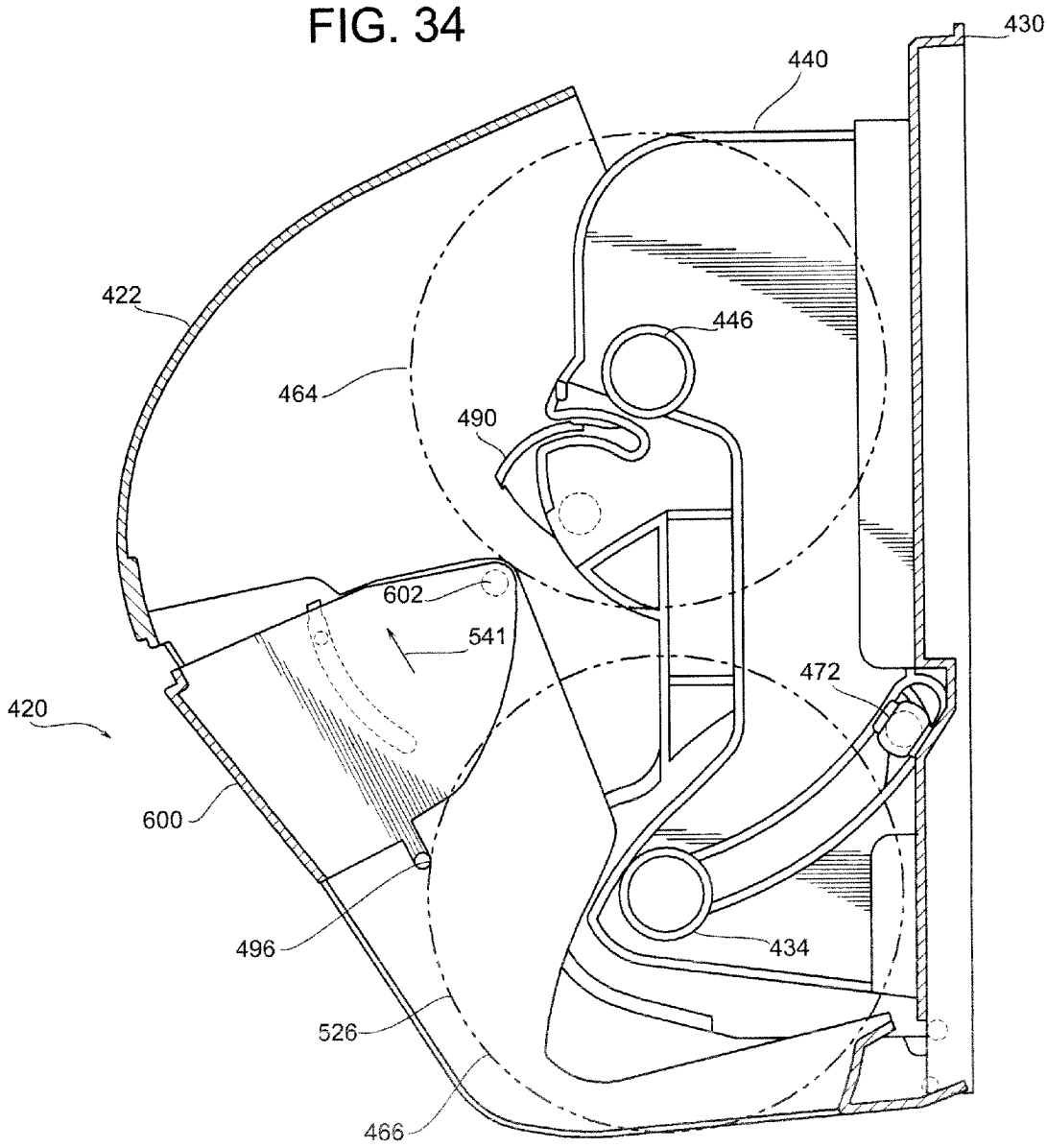
FIG. 34 is a hidden line side view of the left side of one embodiment of the disclosure partially re-closed.
Figure 35:
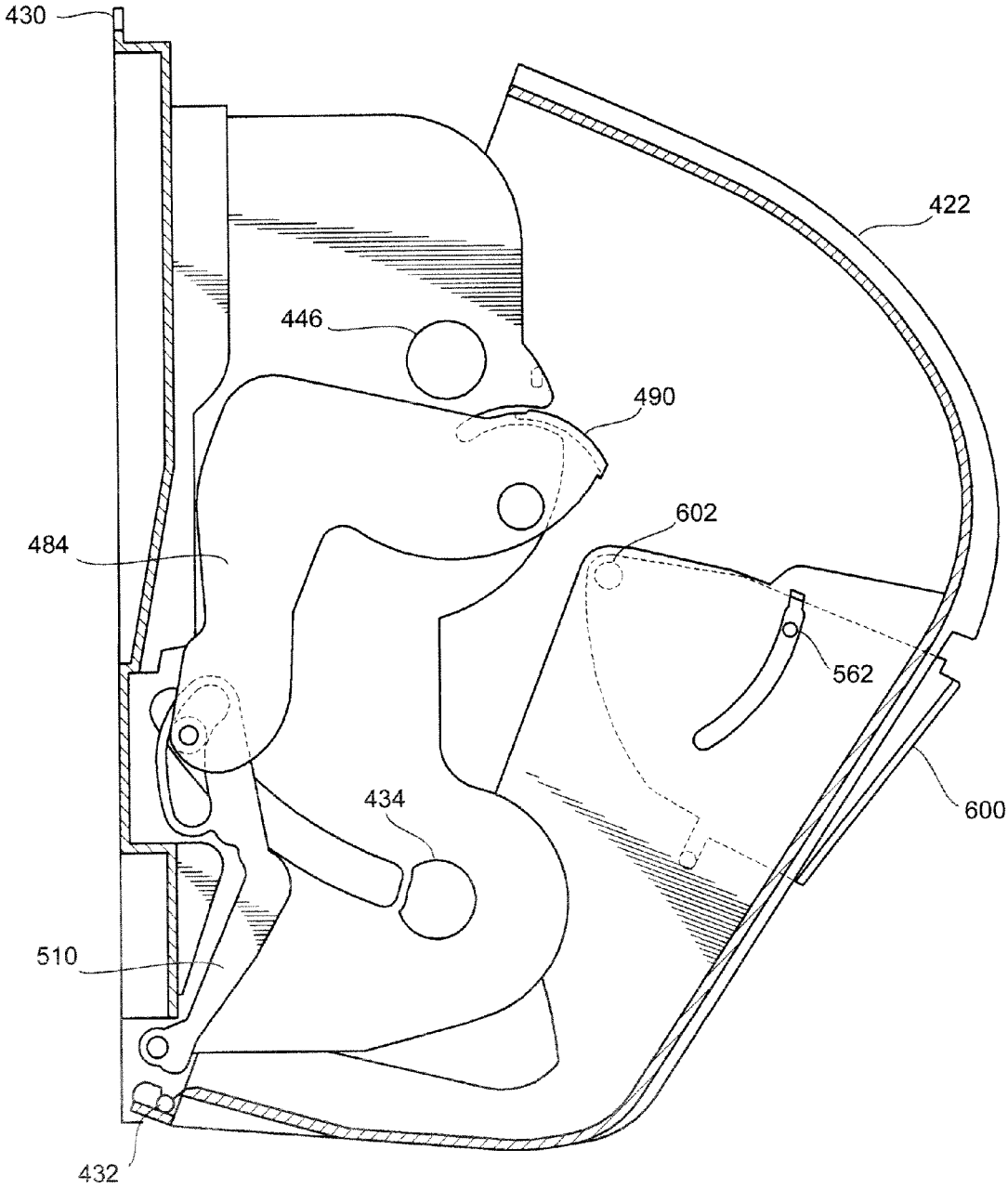
FIG. 35 is a hidden line side view of the right side of one embodiment of the disclosure partially re-closed.

As shown in FIG. 34, the dispenser 420 in one form can be configured such that a lifting member 496 engages the outer surface 526 of the primary product roll 466 which tends to rotate the casing door 600 from an open position 536 as shown in FIG. 28 towards a reserve position 524 as further shown in FIG. 36. Referring back to FIG. 34, casing door pivot 602 is provided which rotationally couples the casing door 600 to the lateral extension 440. At this point, the casing 422 could be closed, reengaging the latching mechanism at which point the apparatus is once again ready for use. Thus, the motion of opening and re-closing the casing 422 repositions the seer mechanism, and the casing door 600 to a reserve position 524 as shown in FIG. 36.

Figure 32:
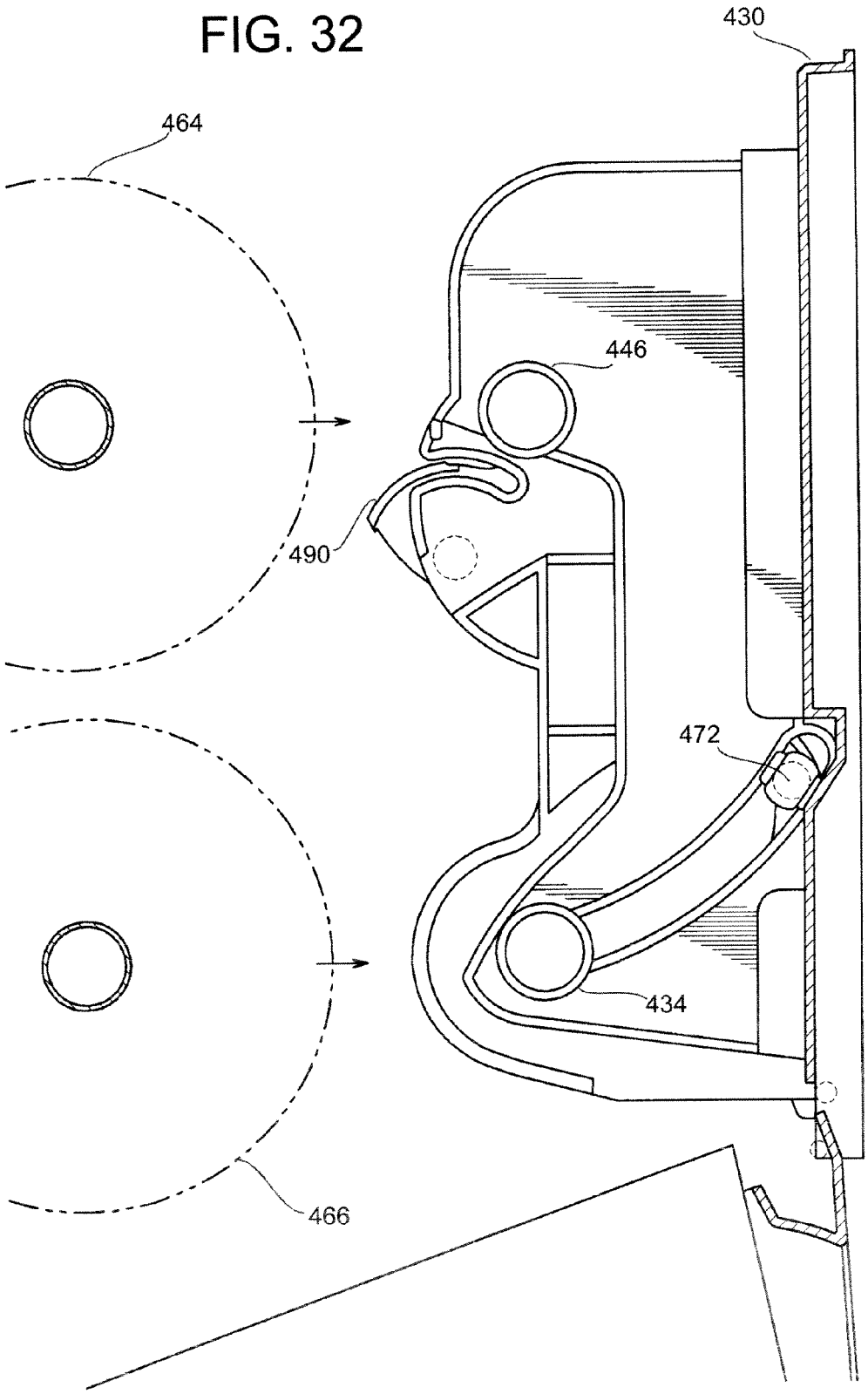
FIG. 32 is a hidden line side view of the left side of one embodiment of the disclosure in a substantially open position and new replacement rolls of product positioned to be inserted in the apparatus.
Figure 37:
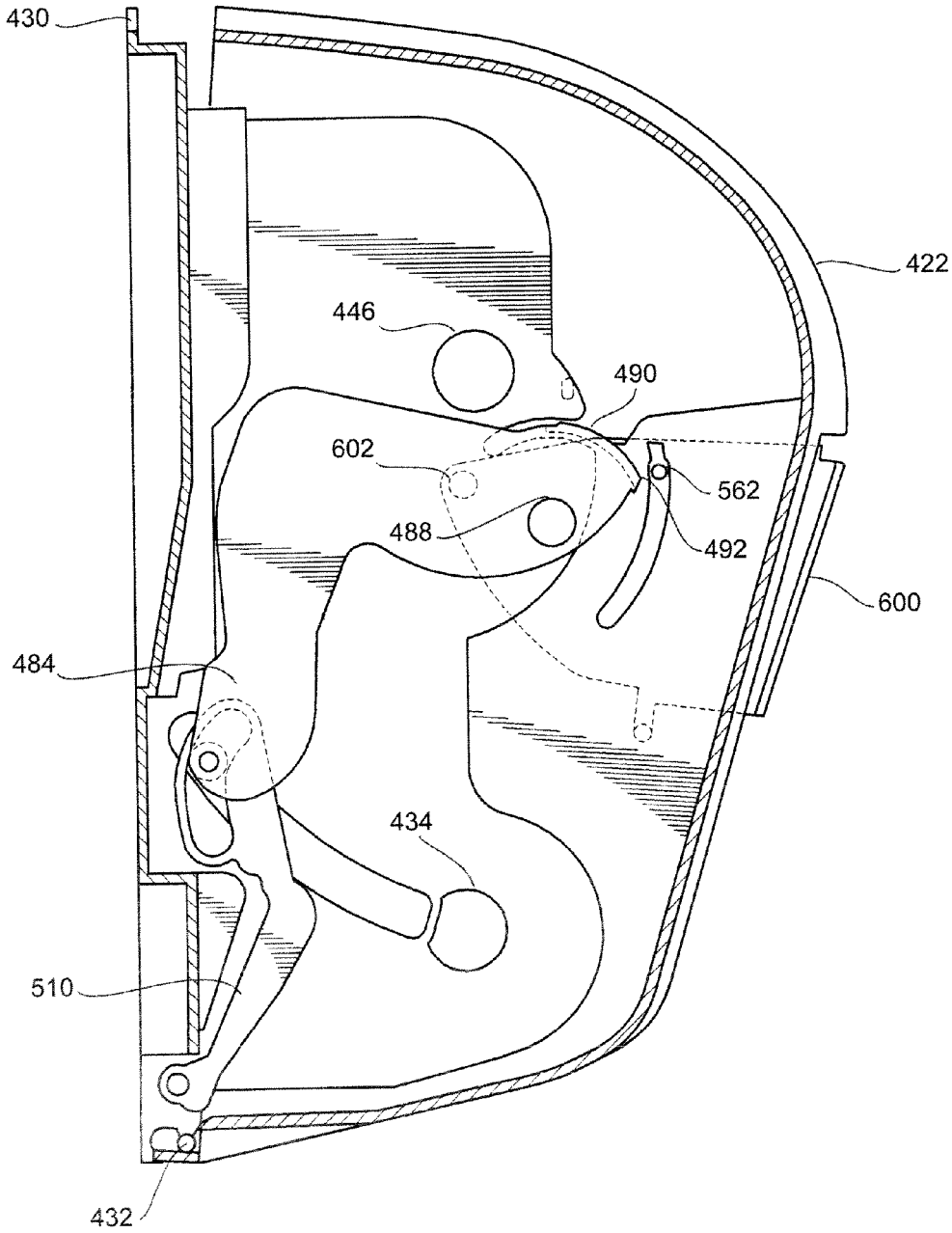
FIG. 37 is a hidden line side view of the right side of one embodiment of the disclosure substantially re-closed.

The specific sequence as shown in FIG. 31, of one embodiment of the disclosure, is that as the casing 422 rotates about case pivot 432 in the direction as indicated at 544, pressure is put upon the lower member 510. The pressure exerted by the casing 422 against the lower member 510 rotates the lower member 510 about lower member pivot 516 in the direction as indicated at 545. This rotation of the lower member 510 exerts force against the swing arm 472 along the channel 418 in the direction of travel 540. As the swing arm 472 in one form is connected to the upper member 484, this force tends to rotate the upper member 484 about the upper member pivot 488 in the direction as indicated at 548. A new primary roll 466 is then positioned upon the primary roll support 434 as shown in FIG. 32. As the casing 422 is re-closed, the lifting member 496 engages the outer surface 526 of the primary roll 466 as shown in FIG. 34. This repositions the casing door 600 to the reserve position 524 of FIG. 36 wherein the secondary product roll 464 is no longer accessible. Looking at FIG. 37, it can be seen how as the casing 422 is re-closed, the seer latch 562 moves past the upper member 484 without engaging the seer point 492, nor the cam surface 490. As shown, the casing door 600 is substantially closed. As the new primary roll is consumed, the lifting member 496 continues to ride on the outer surface 526 of the primary roll 466 as shown in FIG. 36, until the seer latch 562 once again engages the cam surface 490 as shown in FIG. 21. At this point the primary roll 466 no longer engages the lifting member 496, and the secondary product roll 466 is still not available for use (see FIG. 20) until the primary roll 466 is substantially consumed. Thus, the two operations of the reset mechanism are achieved. These operations are: repositioning the swing arm 472 such that a new roll can be placed upon the primary roll support 434 with a minimum of effort and also the casing door 600 is moved from an operational position 536 as shown in FIG. 28 to a reserve position 524 as shown in FIG. 20. Should the secondary product roll need to be replaced at the same time, that can easily be achieved.

It is also conceived that whereas it may be beneficial to provide the primary product roll with a split or partial core, it may also be desirable to provide the secondary product roll 464 with a full-length core.

Figure 27:
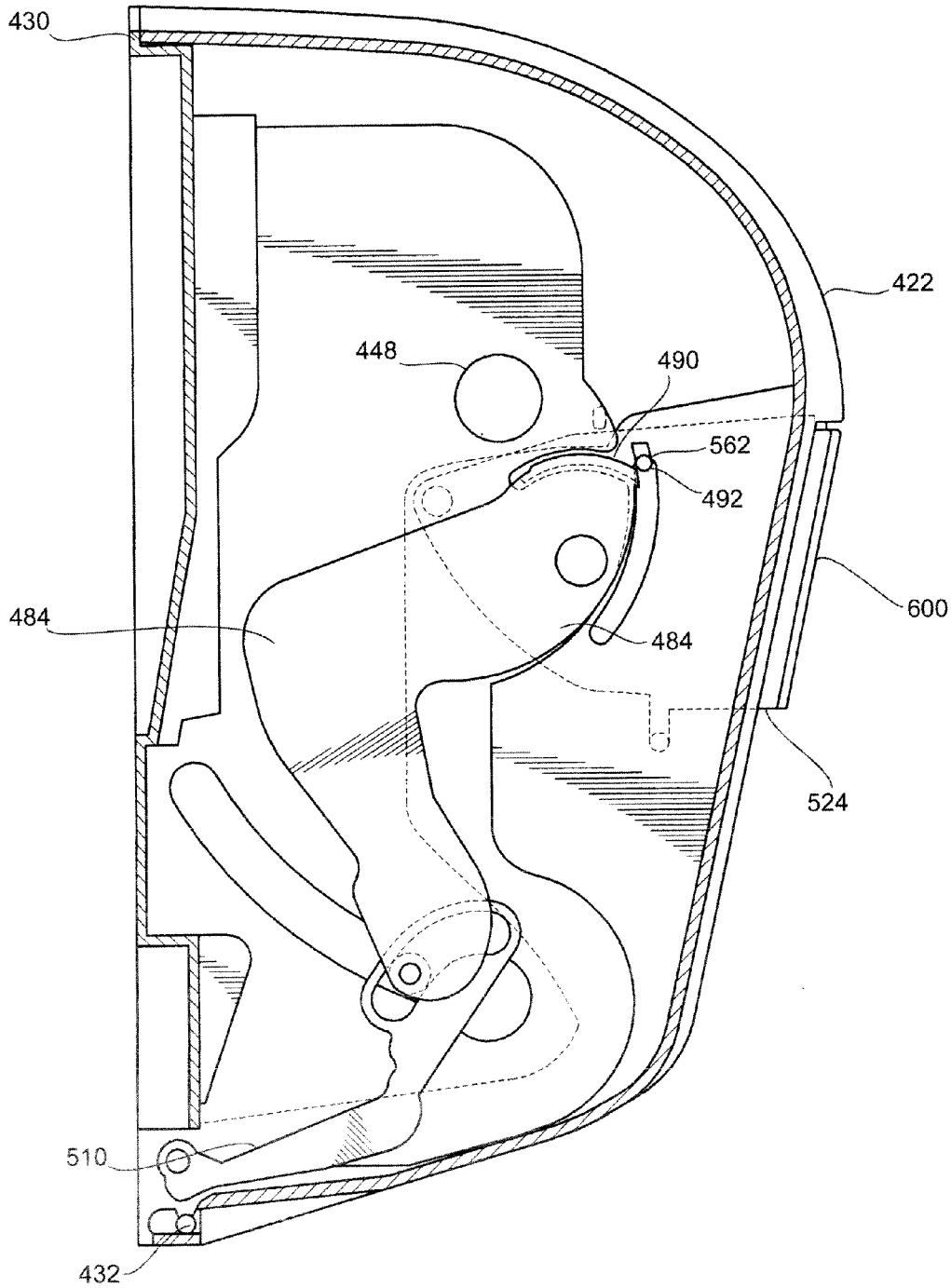
FIG. 27 is a hidden line side view of the right side of one embodiment of the disclosure in a reserve position with the primary roll substantially removed.
Figure 29:
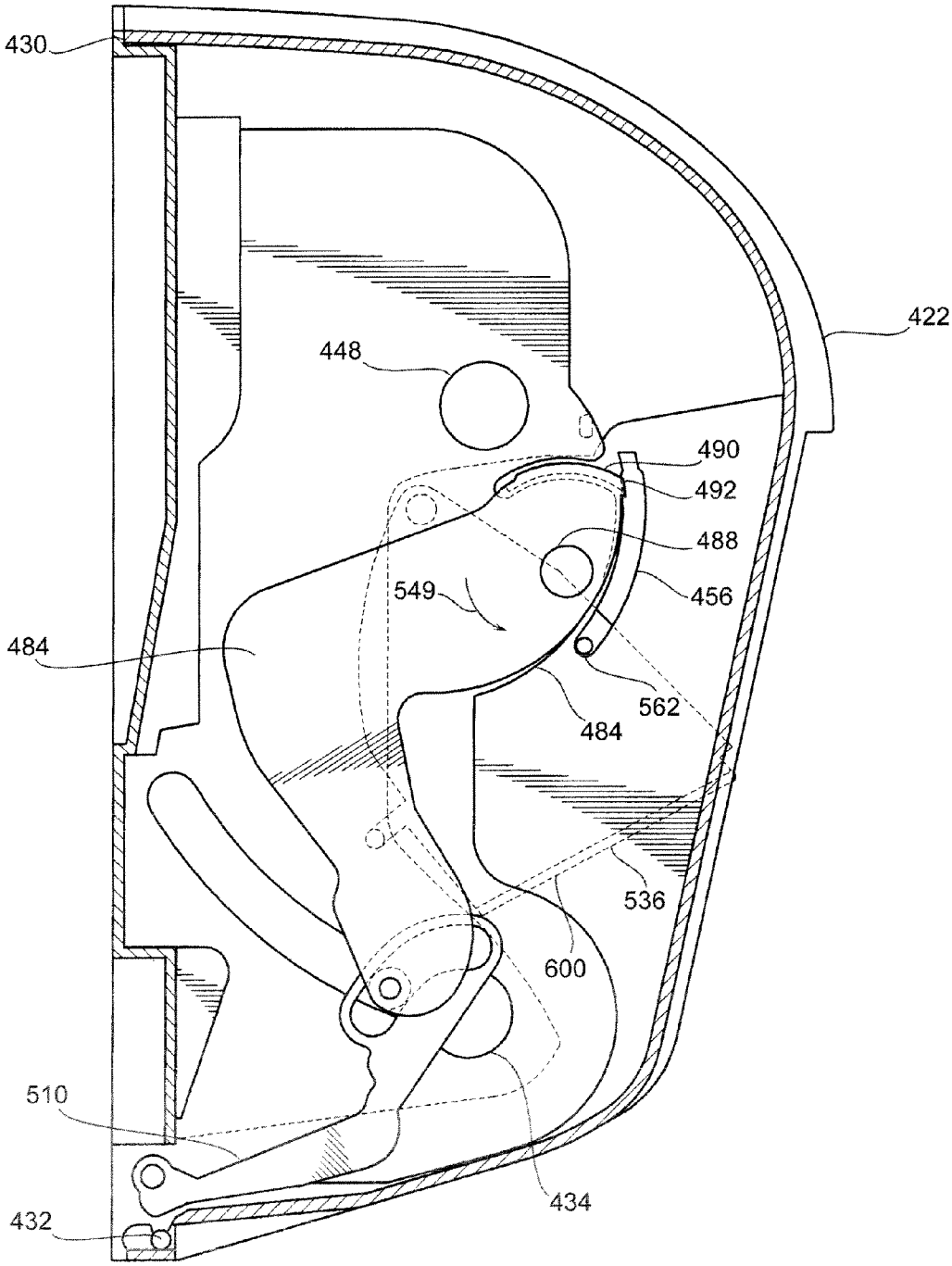
FIG. 29 is a hidden line side view of the right side of one embodiment of the disclosure in a closed and operational position with the primary roll utilized, and the secondary roll accessible to be utilized.

This particular embodiment of a seer mechanism can further be seen in FIGS. 27 and 29, wherein at FIG. 27 the primary roll is not completely consumed and the casing door 600 is still in its reserve position 524. In FIG. 29 however, the seer latch 562 is no longer in contact with the cam surface 490 and the upper member 484 is rotated in direction of travel 549 such that the seer point 492 has passed beyond the seer latch 562 and has dropped along the channel 456 causing the casing door 600 to pivot from the reserve position 524 of FIG. 27 to the operational position 536 of FIG. 29.

Now looking at FIG. 33, the reset mechanism 554 as previously discussed is shown from the right transverse side. As has been previously discussed, the casing 422 is rotated to an open position, forces are exerted upon the lower member 510 and other associated portions of the reset mechanism 554 to reposition the swing arm 472 to a position furthest from the primary roll support 434 and functionally reset the apparatus. In this form, a primary roll of product is easily positioned upon the primary roll support 434. And a secondary roll of product is easily positioned upon the secondary roll support 446.

Figure 38:
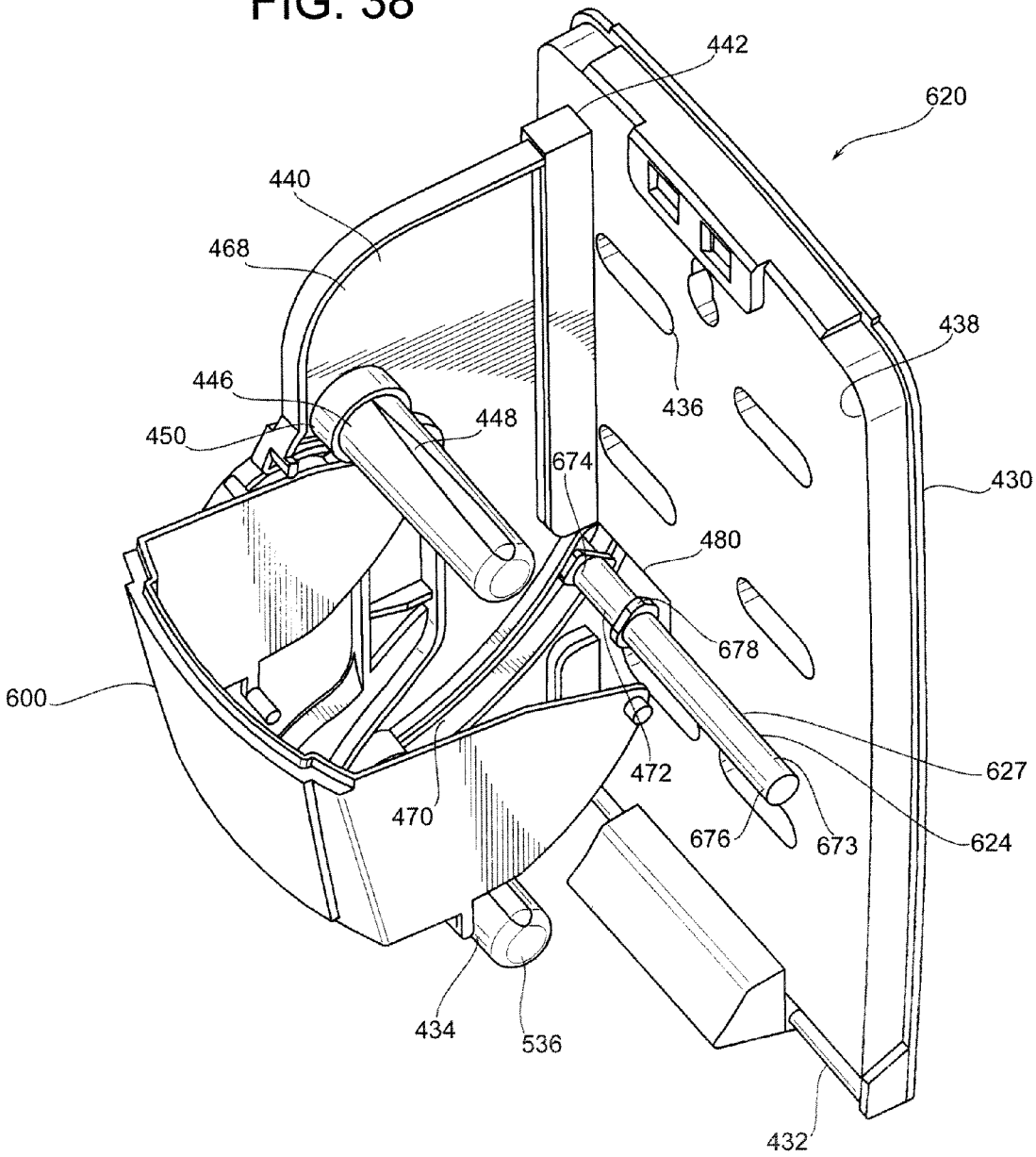
FIG. 38 is an isometric view of one embodiment of the disclosure from the left side with the casing and product rolls removed to show the mechanism.

Looking at FIG. 38, an embodiment of the dispenser 620 is disclosed comprising a swing arm 673 which is considerably longer than previously disclosed embodiments. A secondary roll support 446 is also provided which extends transversely from the lateral extension 440 and in one form is substantially a cylinder. The secondary roll support 446 includes an extension 448 which is coupled to a secondary roll support base 450. The secondary roll support 446 is configured to support a secondary roll of product. Similarly, the primary roll support 434 is configured to support a primary roll of product. A plurality of surfaces defining a channel 470 are also disposed in the lateral extension 440 configured to allow passage and movement of a swing arm 673. The swing arm 673 has a first end 674 near the face side 468 of the lateral extension 440, and a second end 676 substantially distant from the face 468 of lateral extension 440. The swing arm 673 furthermore has an engagement portion 678 configured to ride on the outer surface of the primary product roll as the primary product roll 466 is consumed. The frame 430 may also include a recess 480 upon the face side 438 configured to accept a portion of the swing arm 673 when it is in position furthermost from the primary roll support 434.

The primary roll support 434 of one embodiment may also include a channel (not shown) configured to receive a portion of the swing arm 673 when the swing arm 673 is in position closest to the primary roll support 434. As will be discussed later, when a primary product roll is used having a partial or split core as is known in the art, the engagement portion 678 of the swing arm 673 will ride along on the outer portion of the primary product roll until the primary product roll is substantially consumed at which point the engagement portion 478 will press past the end 536 of the primary roll support. The end result of this operation will be discussed in detail.

The swing arm 673 as shown is substantially longer than the primary roll support 434. Furthermore, the swing arm 673 includes a reset extension 624 which extends transversely beyond the end 536 of the primary roll support 434. Furthermore, the reset extension 644 includes an outer surface 627 adapted to engage the outer surface of the primary roll of product as will be discussed in detail. The user exerting force upon the reset extension 624 functions to reposition the swing arm 673 away from the primary roll support 434 to position a primary roll of product thereupon.

Figure 39:
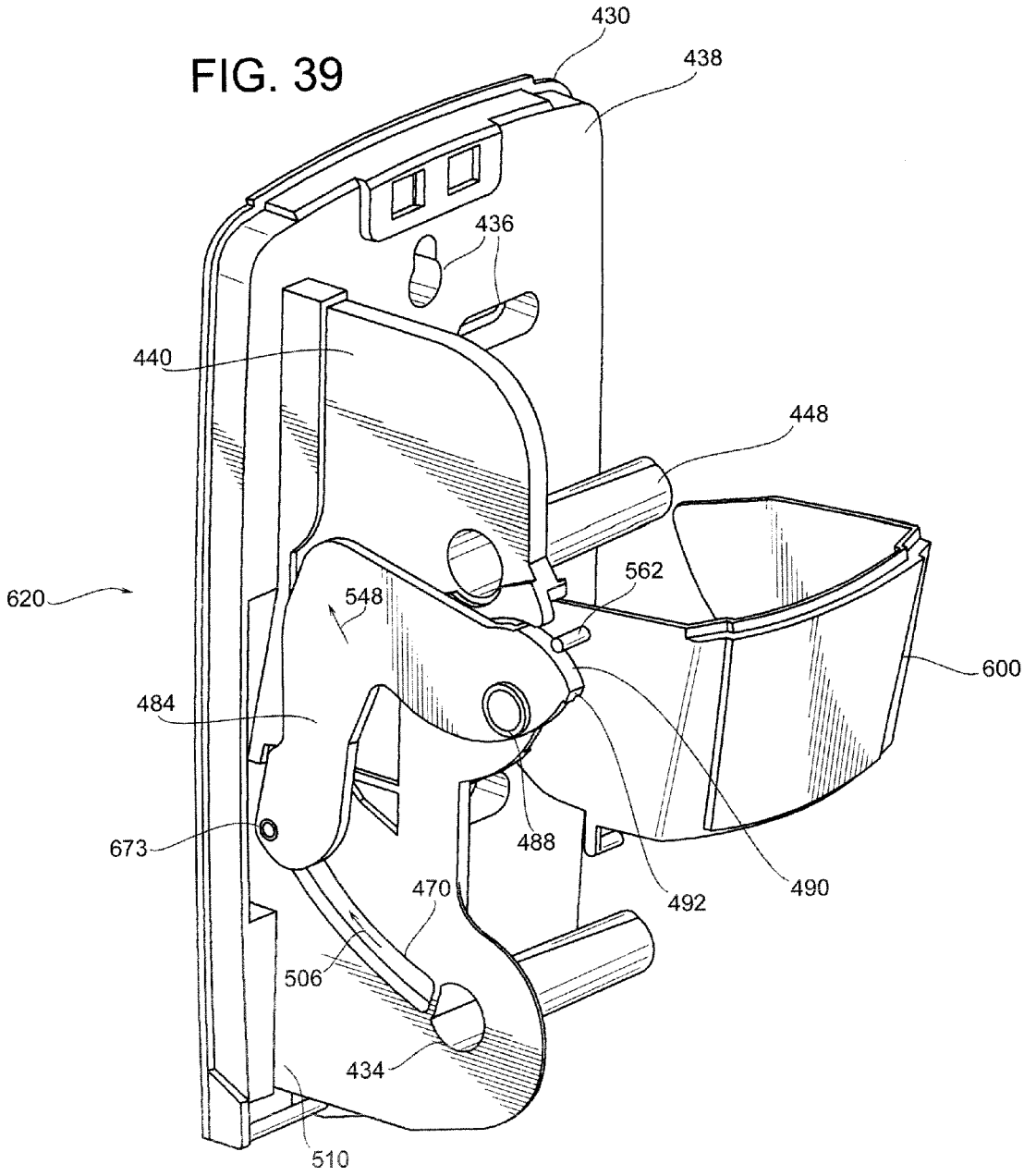
FIG. 39 is an isometric view of one embodiment of the disclosure from the right side with the casing removed to show the mechanism.
Figure 40:
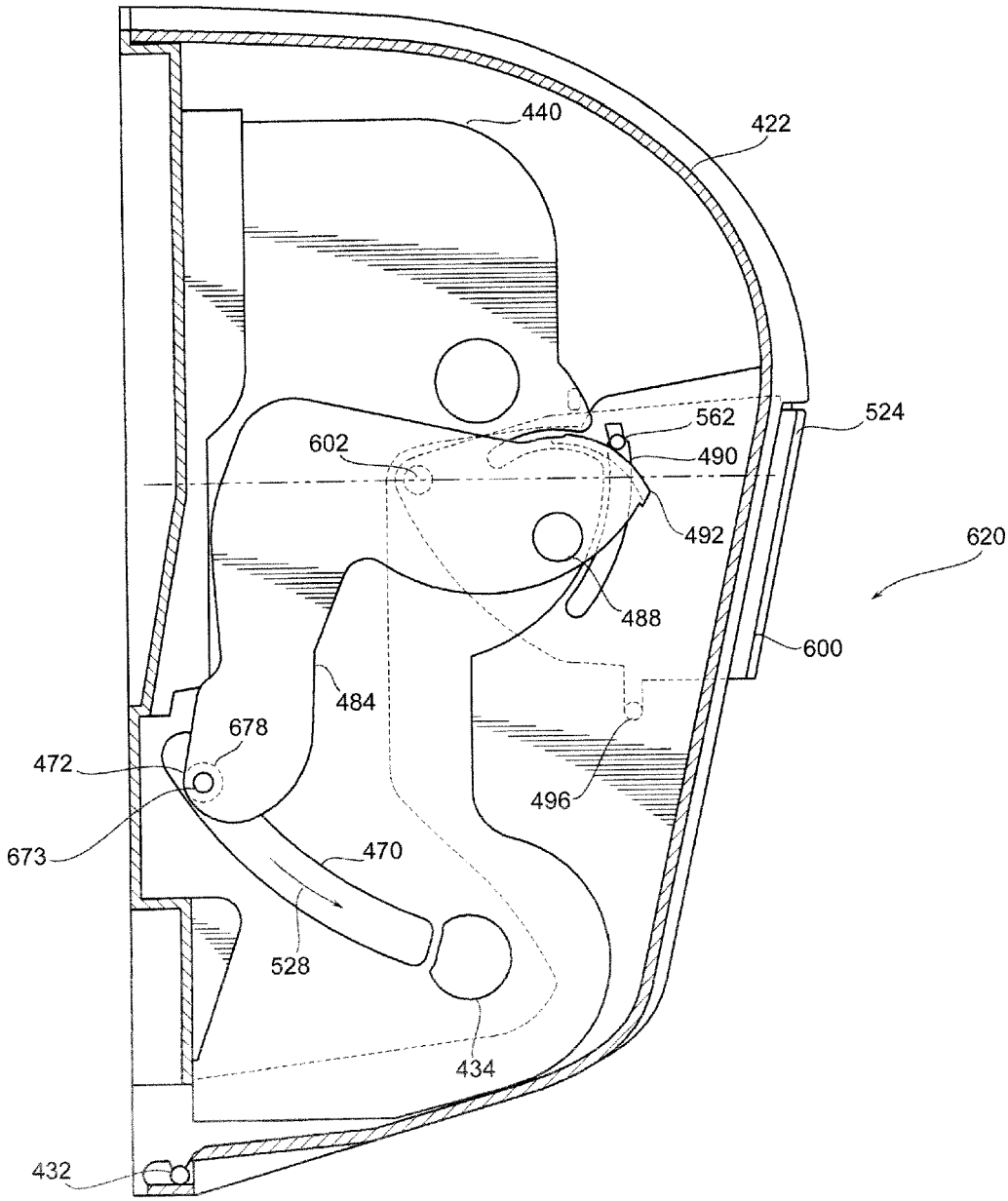
FIG. 40 is a hidden line view of the right side of one embodiment of the disclosure in a reserve position.
Figure 41:
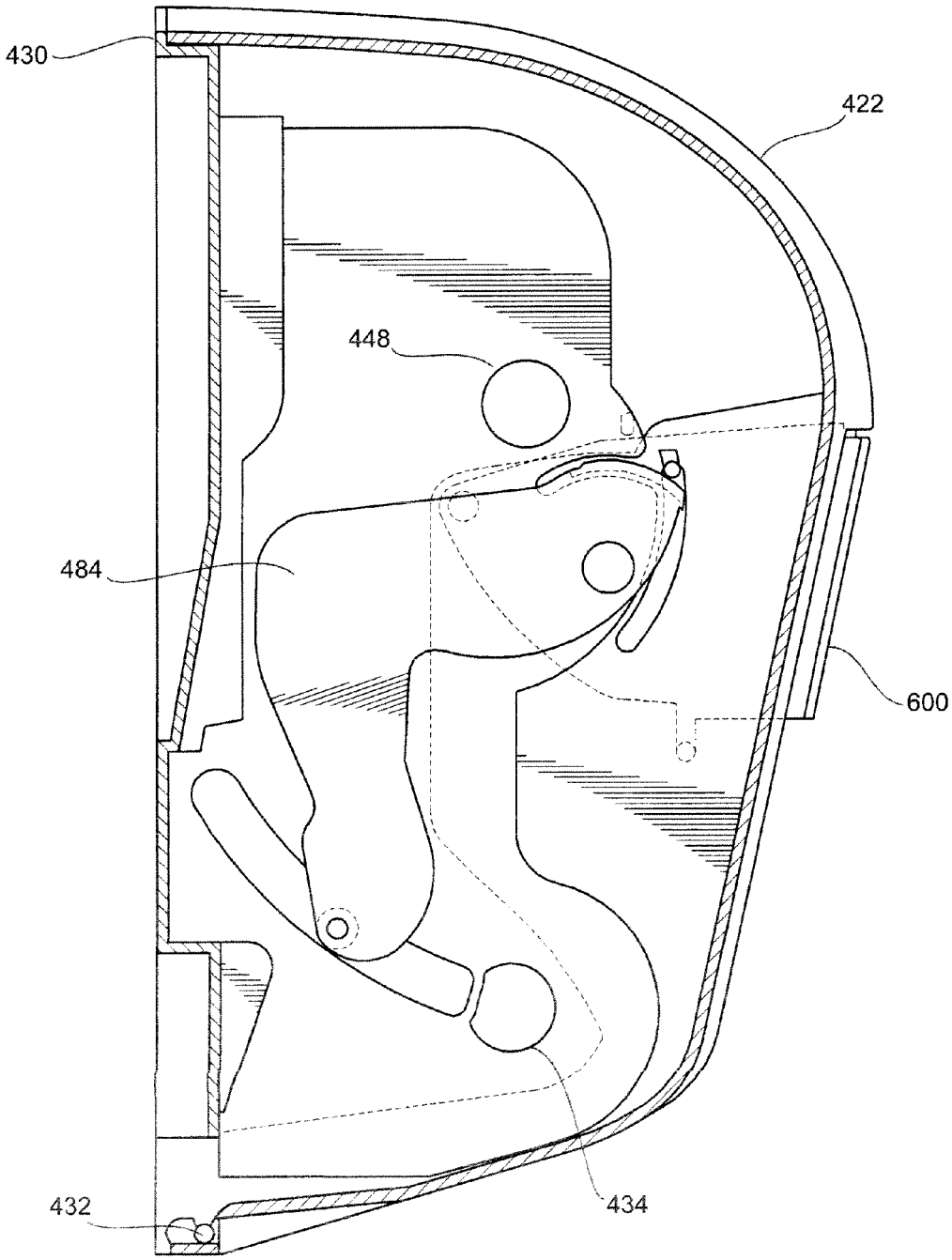
FIG. 41 is a hidden line side view of the right side of one embodiment of the disclosure in a reserve position with the primary roll substantially utilized.
Figure 42:
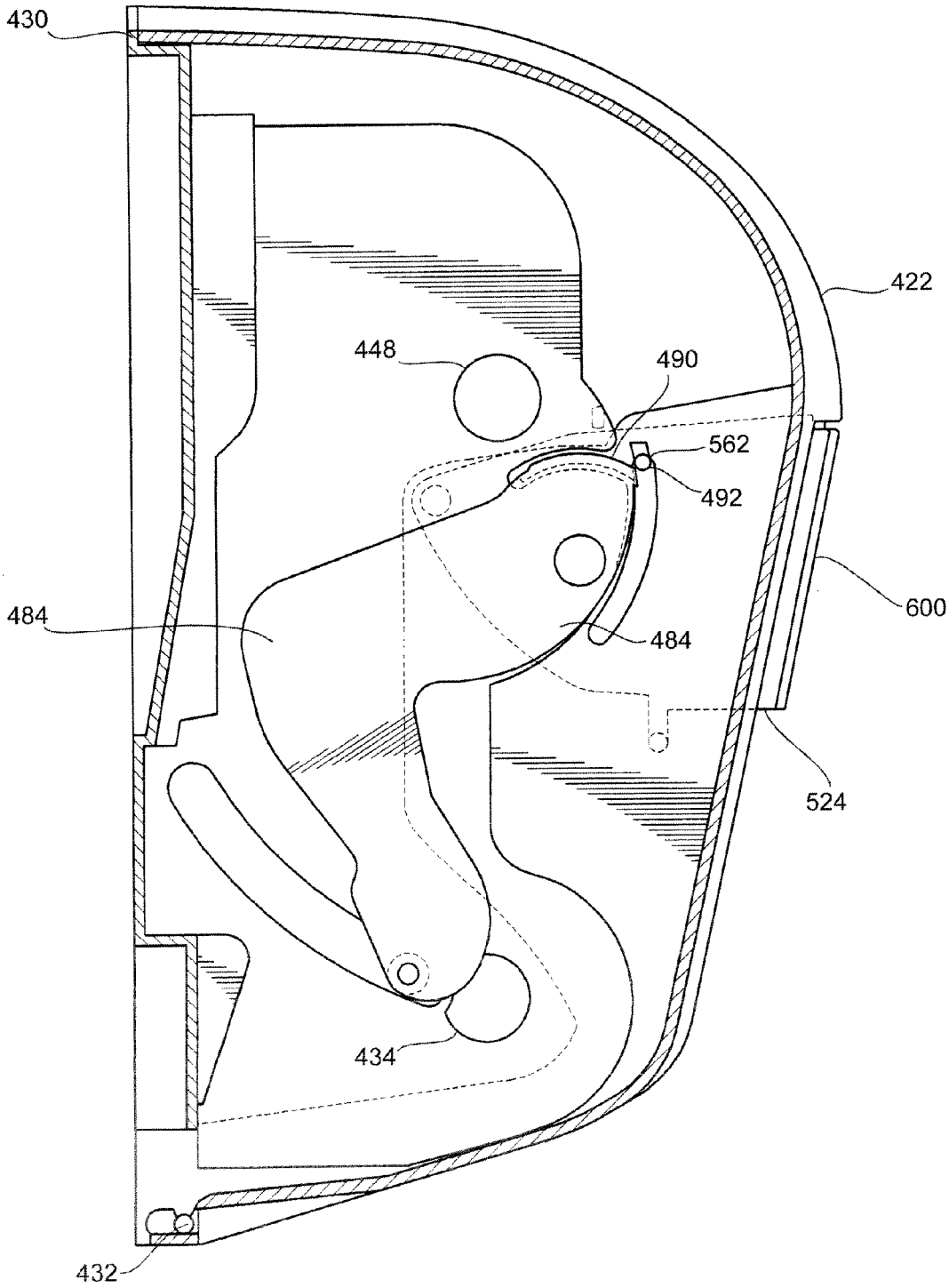
FIG. 42 is a hidden line side view of the right side of one embodiment of the disclosure in a reserve position with the primary roll substantially utilized.
Figure 43:
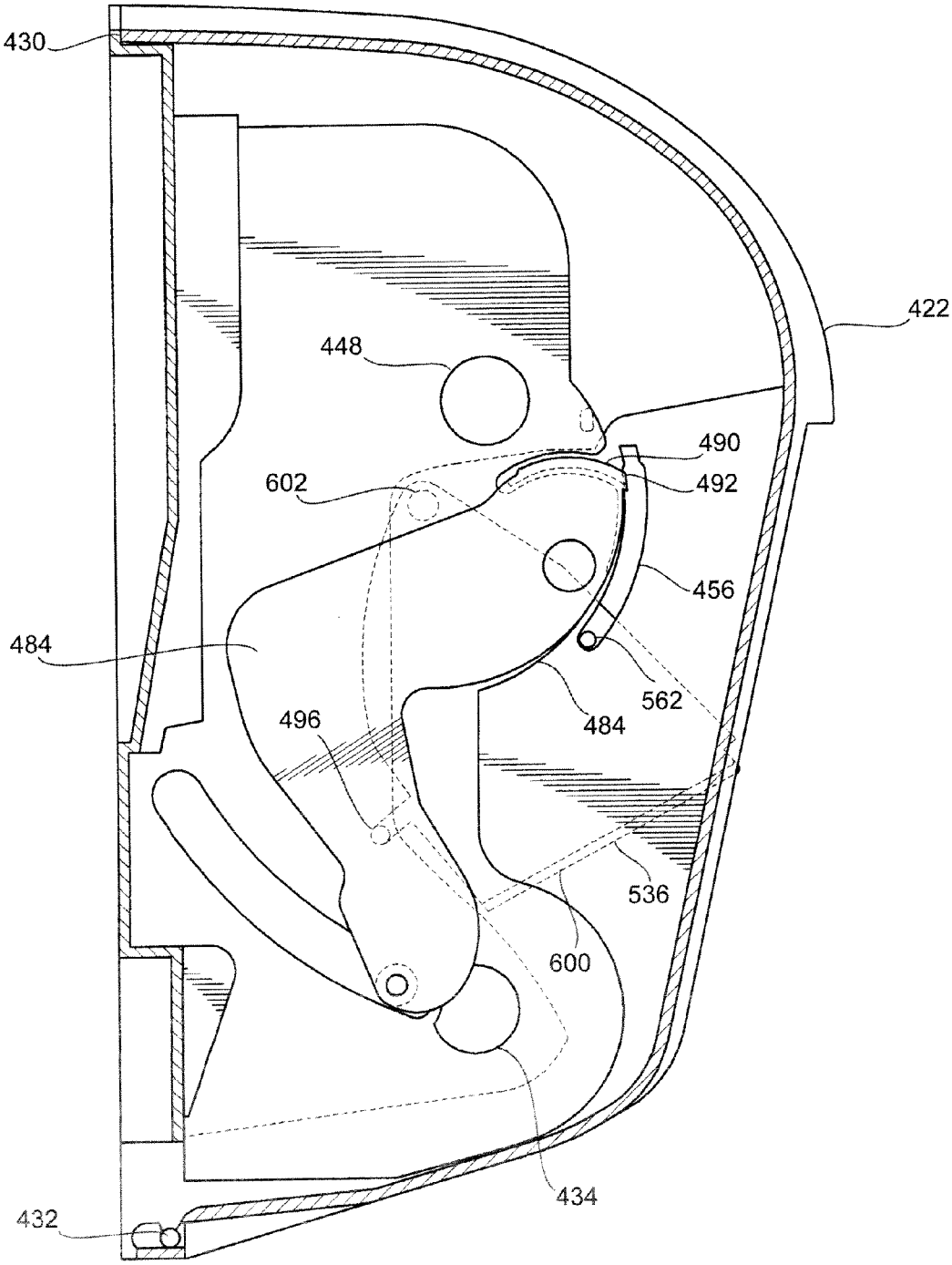
FIG. 43 is a hidden line side view of the right side of one embodiment of the disclosure in a closed and operational position with the primary roll substantially utilized and the secondary roll accessible to be utilized.

Looking at FIG. 39, it can be seen how force exerted upon the swing arm 673 away from the primary roll support 434 will cause the upper member 484 to rotate about the upper member pivot 488 in the direction as indicated at 548. This will rotate the cam surface 490, and the adjacent seer point 492 to a position to engage the seer latch 562 when the casing is re-closed, as has been previously discussed. Looking at FIG. 40 it can be seen how as the primary roll of product is consumed, the swing arm 673 will ride upon the outer surface of the primary roll of product, and reposition the swing arm 473 in the direction as indicated at 528 towards the primary roll support 434. FIG. 41 shows the upper member 484 repositioned closer to the primary roll support 434 as shown in FIG. 40. FIG. 42 shows the last moment in which the seer latch 562 is engaged by the cam surface 490, and any further rotation of the upper member 484 towards the primary roll support 434 will result in the seer point 492 passing beyond the seer latch 562 releasing it to an operational position 536 as shown in FIG. 43.

Figure 44:
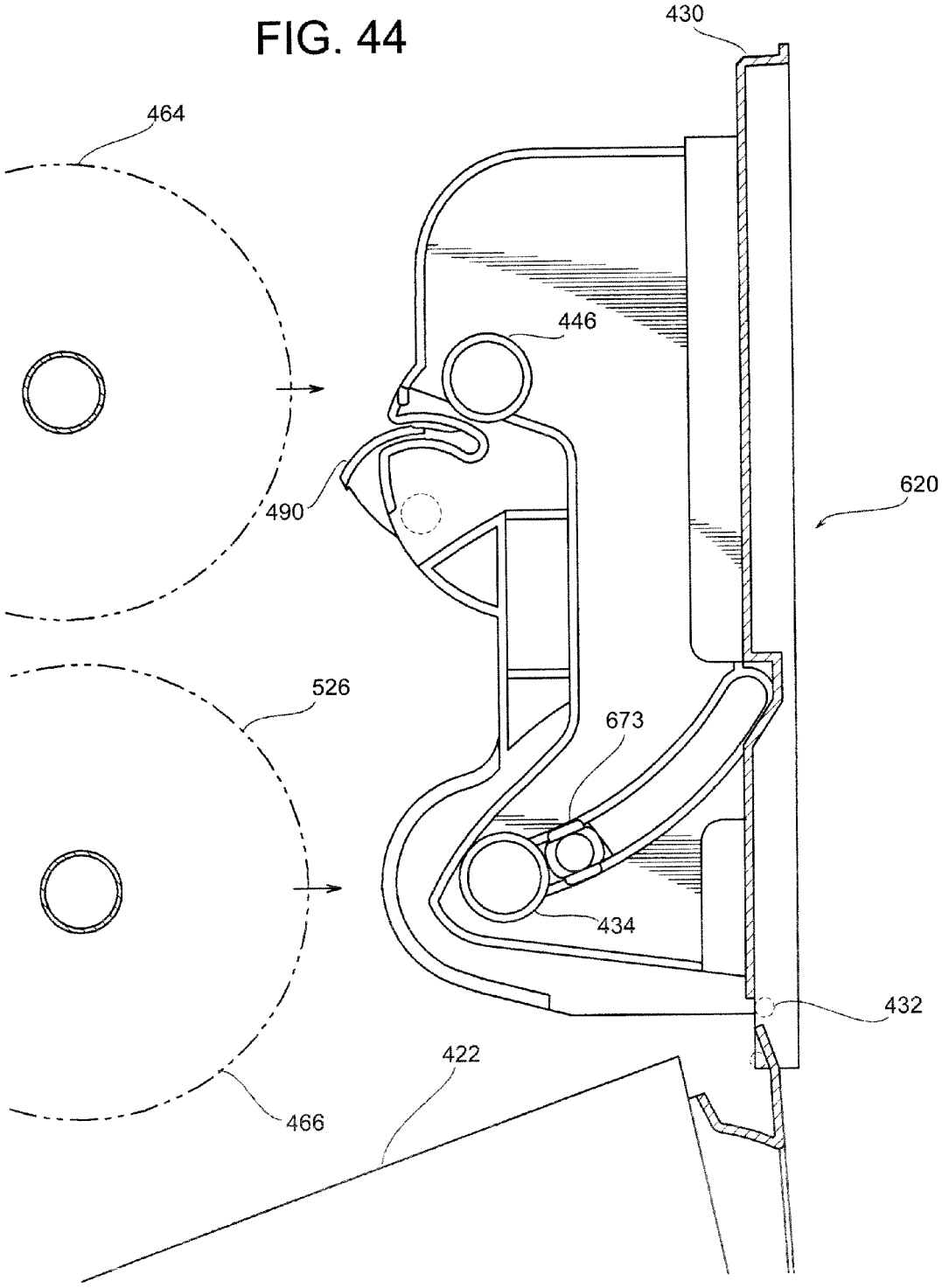
FIG. 44 is a hidden line side view of the left side of one embodiment of the disclosure in an open position and new replacement rolls of product positioned to be inserted in the apparatus.
Figure 45:
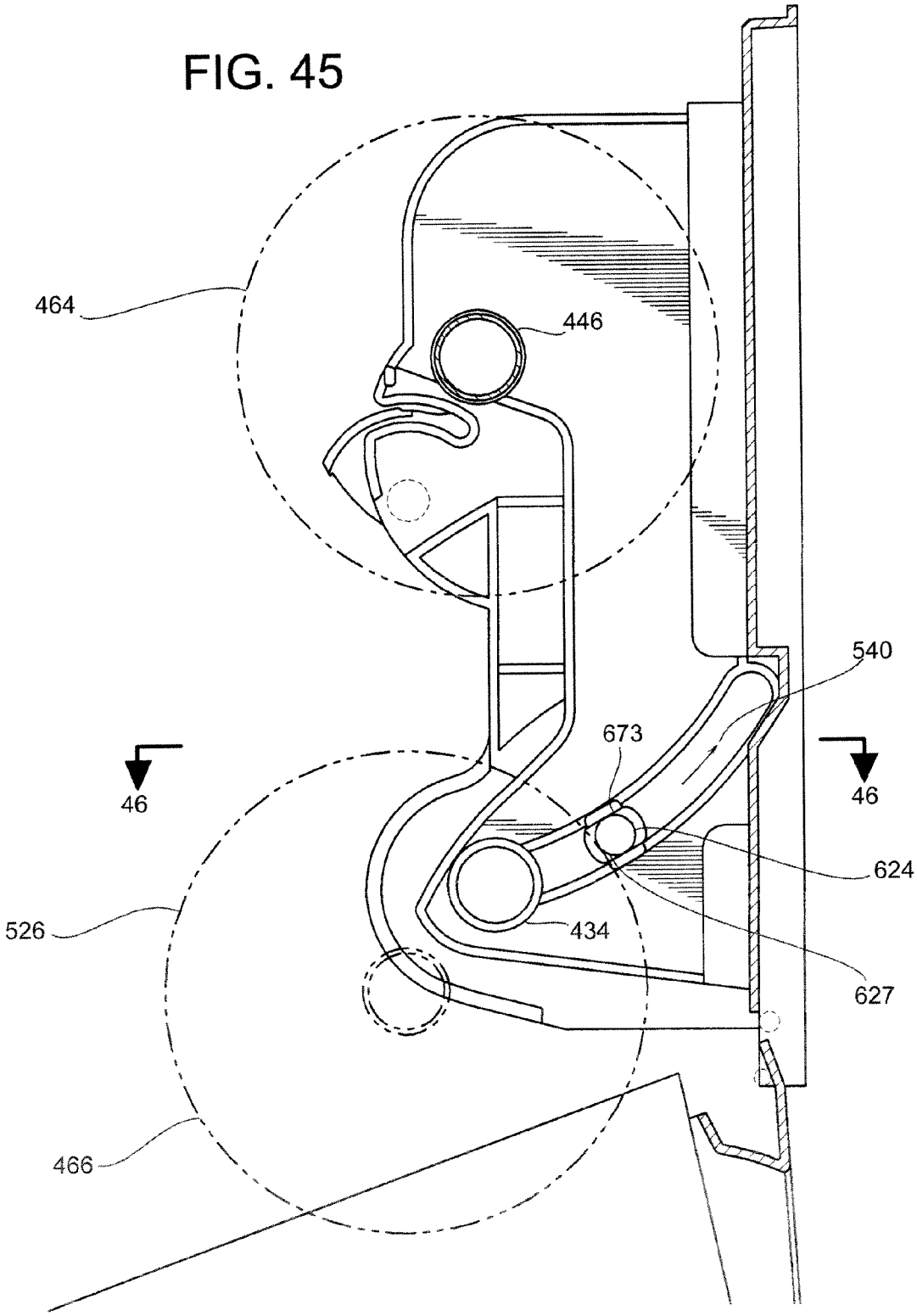
FIG. 45 is a hidden line side view of the left side of one embodiment of the disclosure in an open position and new primary replacement roll of product positioned to be inserted in the apparatus.
Figure 46:
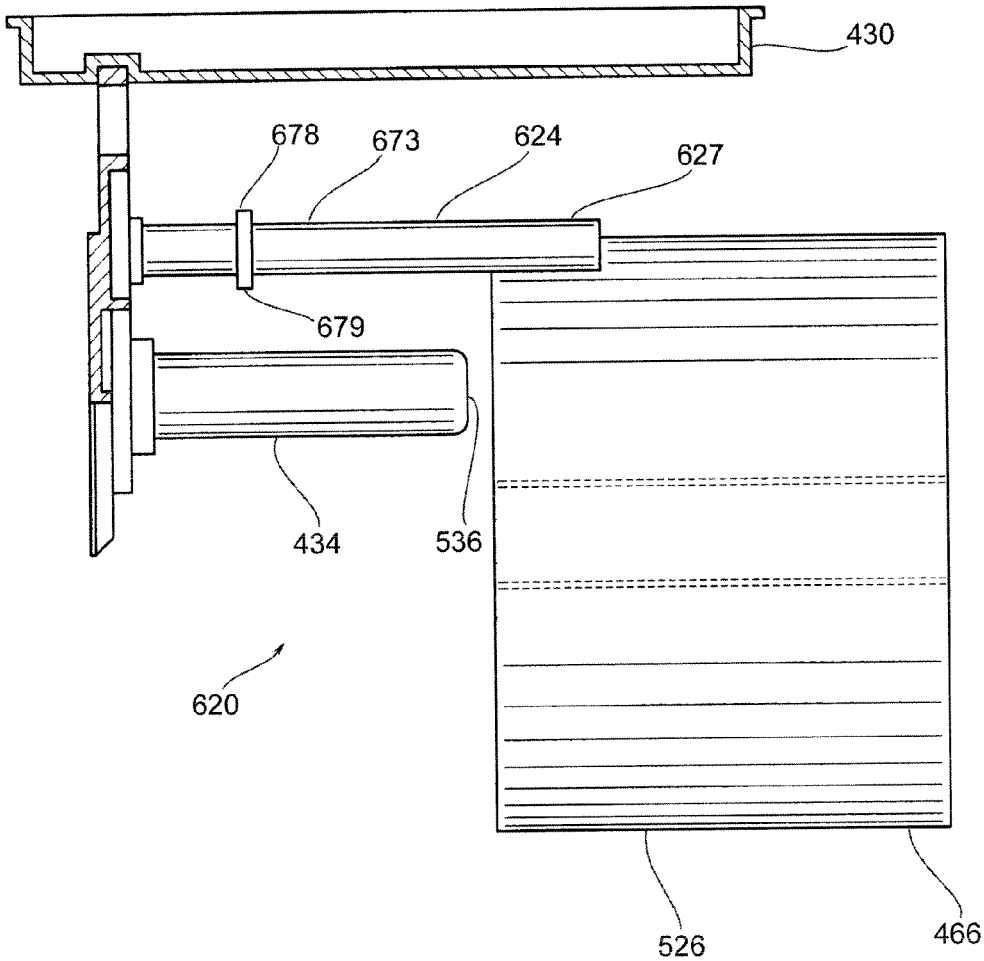
FIG. 46 is a cutaway view taken along line 46 of FIG. 45.
Figure 48:
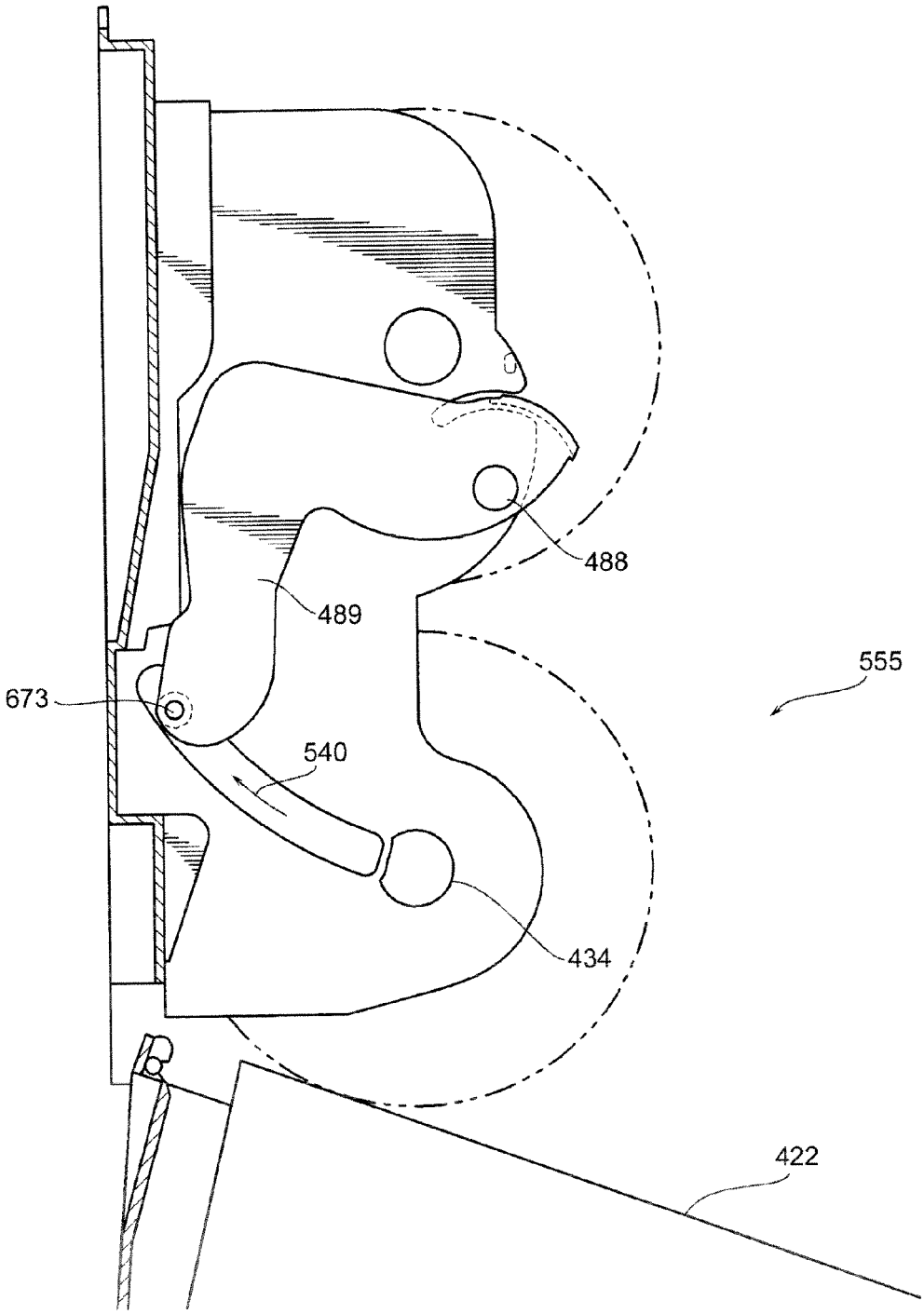
FIG. 48 is a hidden line side view of the right side of one embodiment of the disclosure in an open position with the seer mechanism reset.

As shown in FIG. 44, the casing 422 has been opened about casing pivot 432 which provides for replacement of a primary roll of product 466 upon the primary roll support 434, and a secondary roll of product 464 upon the secondary roll support 446. As shown in FIG. 45, the secondary roll of product 464 is positioned upon the secondary roll support 446 and the primary roll of product 466 is positioned beyond the end 536 (see FIG. 38) of the primary rolled support 434. Thus the outer surface 526 has engaged the outer surface 627 of the reset extension 624 and is thus repositioning the swing arm 673 in the direction as indicated at 540. Looking at FIG. 48, it can be seen how as the swing arm 673 (which is attached to the upper member 484) is repositioned in the direction indicated at 540, the upper member 484 rotates about the upper member pivot 488. FIG. 46, which is taken along line 46 of FIG. 45, shows a cut away end view of the dispenser 620 and shows in much better detail how the primary roll of product is positioned past the end 536 of the primary roll support 434. This figure further shows how the outer surface 526 of the primary roll of product 466 engages the outer surface 627 of the swing arm 673. Once the primary roll of product 466 has sufficiently repositioned the swing arm 673, the core of the primary roll of product 466 can be positioned upon the outer surface of the primary roll support 434. It can then be repositioned transversely along the outer surface 627 of the swing arm 673 into its final position. In its final position, the engagement portion 678 will ride upon the outer surface 526 of the primary roll of product 466. The engagement portion 678 may comprise friction reducing elements as previously discussed and may further comprise a flat spot or a recess 679. As the primary roll of product 466 is positioned transversely upon the outer surface of the primary roll support 434, the recess 679 ensures that the engagement portion 678 will not "catch" on the primary roll of product 466.

Figure 47:
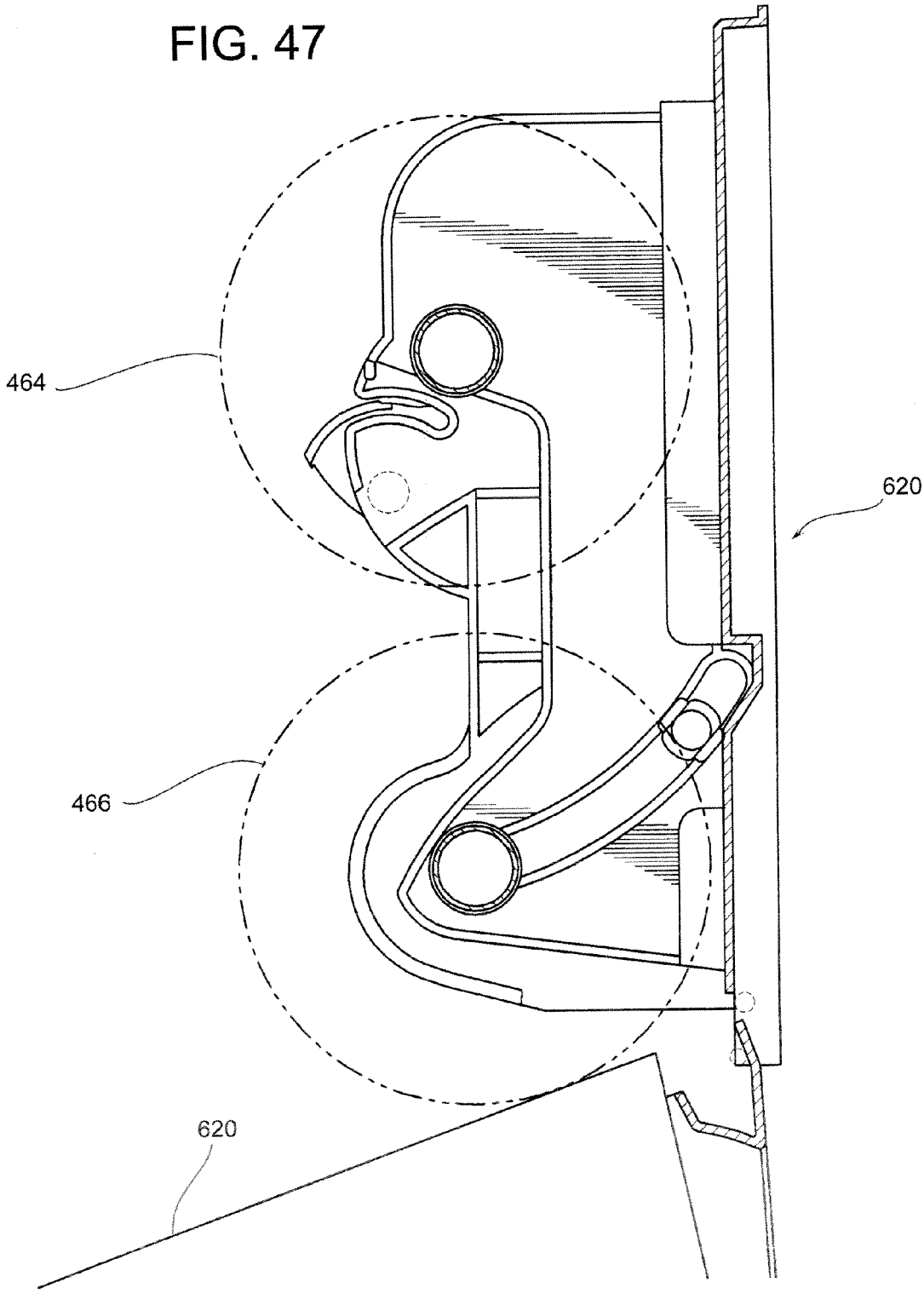
FIG. 47 is a hidden line side view of the left side of one embodiment of the disclosure in an open position with the seer mechanism reset.
Figure 49:
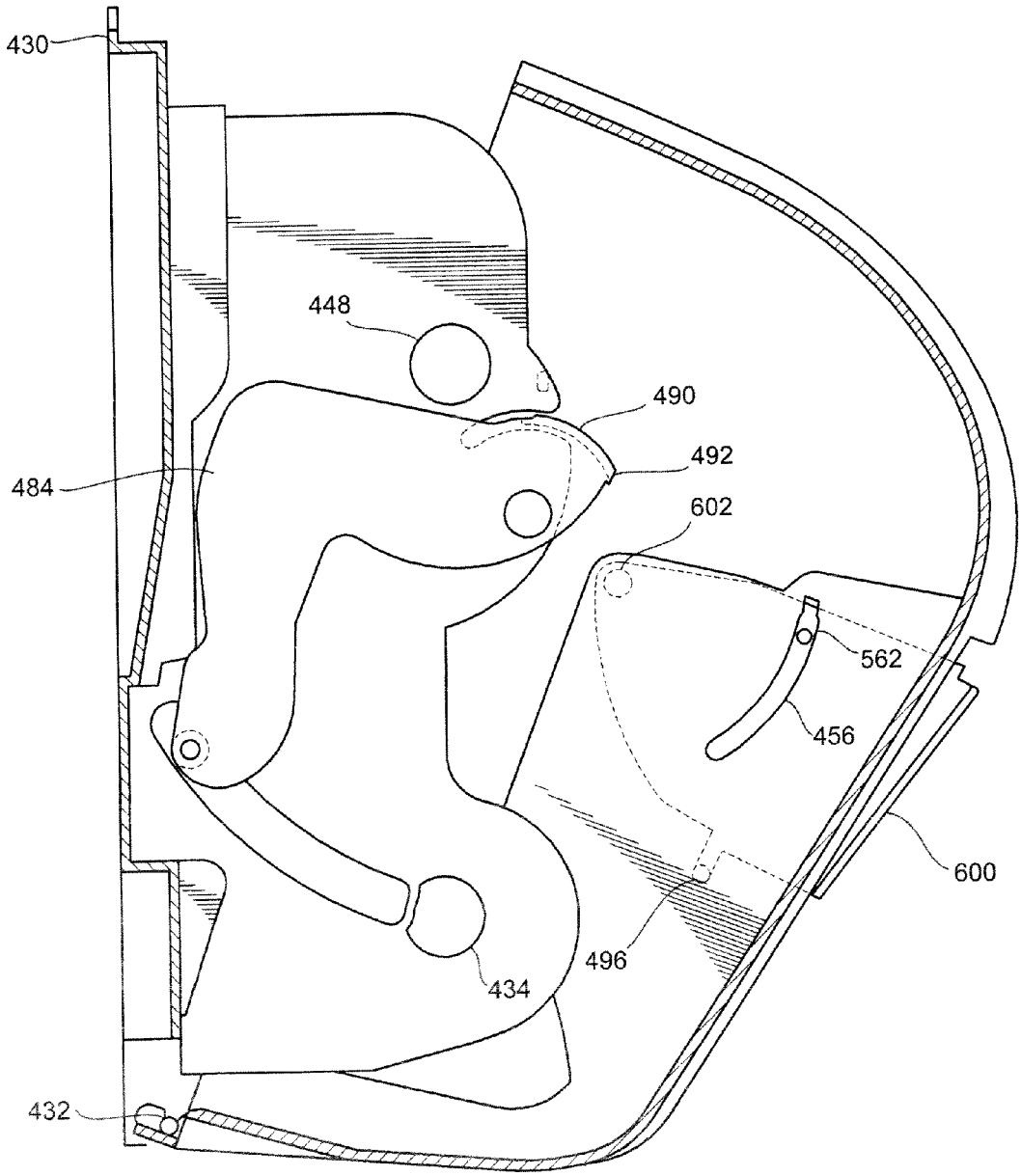
FIG. 49 is a hidden line side view of the right side of one embodiment of the disclosure partially re-closed.
Figure 50:
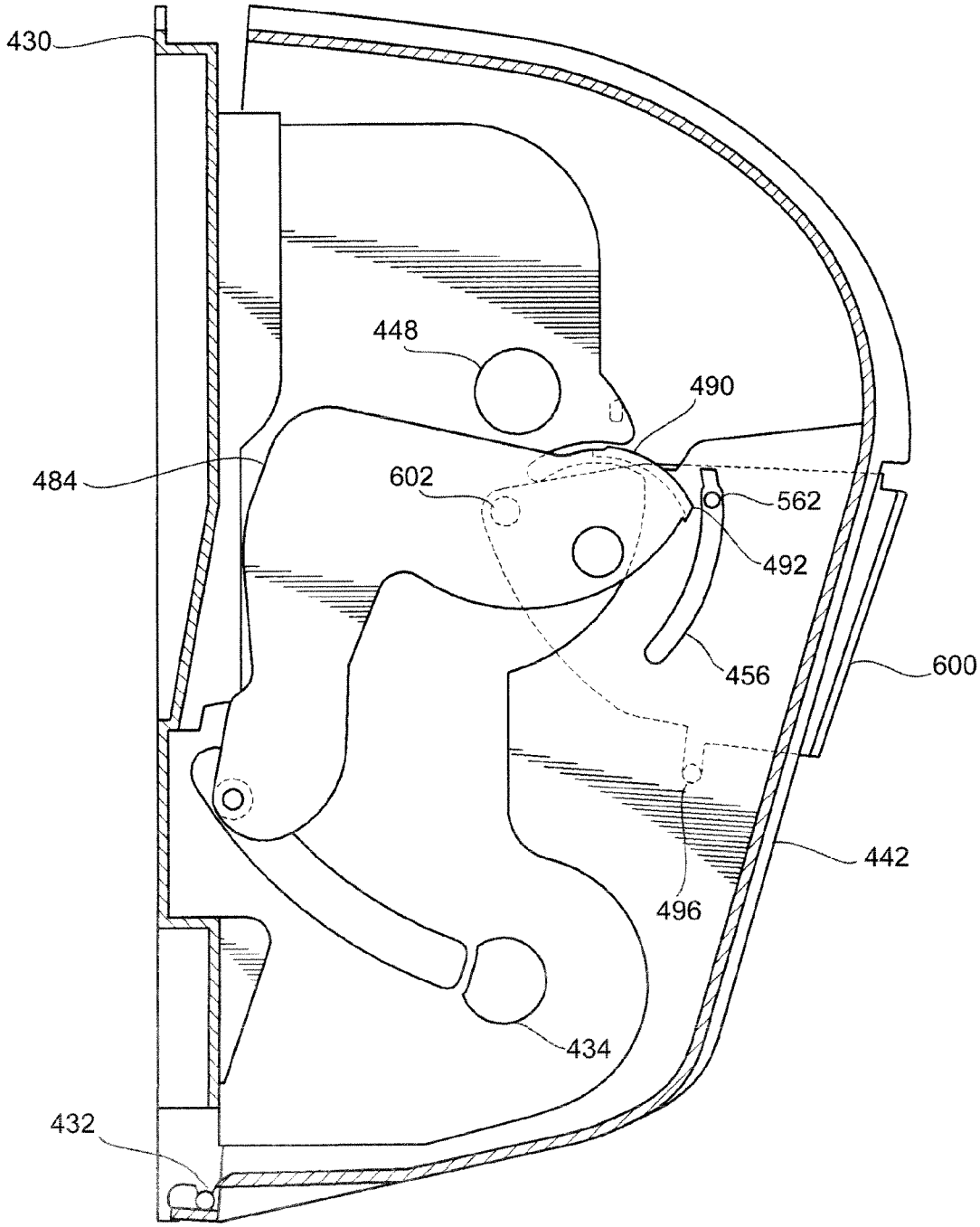
FIG. 50 is a hidden line side view of the right side of one embodiment of the disclosure substantially re-closed.

Once the above mentioned steps have been accomplished, as shown in FIG. 47, the casing 620 may be re-closed as shown in FIG. 49 functionally resetting the dispenser 620. As previously discussed, the lifting member 496 will engage the outer surface 526 of the primary roll of product 466, closing the casing door 600.

At this stage it would be inconvenient to replace the primary product roll 466 with a new roll, as both the secondary product roll 464 and the swing arm 673 could interfere with such action. Thus, an embodiment is disclosed wherein as shown in FIG. 44-50, as the casing 422 is opened about pivot point 432 a new primary roll 466 is positioned past the primary roll support 434, such that the outer surface 526 of the primary roll 466 presses upon the outer surface 627 of the reset extension 624 of the swing arm 673. The pressure exerted by the outer surface 526 of the primary roll 466 rotates the lower number 510 about lower member pivot 516 in the direction as indicated at 540. Once the swing arm 673 has been repositioned a substantial distance from the primary roll support 434, the primary roll 466 can be positioned upon the primary roll support 434. Thus it is provided that the swing arm 673 can be repositioned and the primary roll 466 replaced very easily and quickly may be accomplished using only one hand.

The individual elements of this disclosure may be formed of machined or molded polymer, metals, resins, similar materials, or a combination thereof.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

The invention claimed is:

1. A paper product dispenser for dispensing toilet paper rolls comprising a primary roll having an outer surface and a secondary roll wherein the dispenser comprises:

a) a frame comprising a face side;

b) a lateral extension having a face side, a back side, and a first end, the lateral extension coupled at the first end to the face side of the frame;

c) a primary roll support fixedly coupled to the lateral extension and extending transversely from the face side of the lateral extension, operatively configured to support the primary roll;

d) a secondary roll support coupled to the lateral extension, configured to support the secondary roll, wherein the secondary roll support extends transversely from the face side of the lateral extension;

e) a swing arm extending transversely from the lateral extension wherein the swing arm is configured to engage the outer surface of the primary roll positioned upon the primary roll support and reposition toward the radial center of the primary roll of product as the product disposed upon the primary roll is consumed;

f) a release latch coupled to the swing arm and operatively configured to deny a user access to the secondary roll until the primary roll is substantially consumed; and g) further comprising a casing, wherein the swing arm is operatively configured to be repositioned to a reserve position, functionally resetting the dispenser automatically as the casing is opened.

2. The paper product dispenser of claim 1 wherein a) the secondary roll support is movably coupled to a vertical channel disposed on the lateral extension wherein the secondary roll support extends transversely from the face of the lateral extension; and b) wherein the secondary roll support interoperates with the release latch.

3. The paper product dispenser of claim 2, wherein the swing arm is operatively configured to be repositioned to the reserve position, followed by repositioning the secondary roll support to a reserve position, functionally resetting the dispenser automatically as the casing is opened.

4. The paper product dispenser of claim 2 wherein the swing arm further comprises an engagement portion operatively configured to engage the outer surface of the primary product roll until the primary product roll is substantially consumed at which point a seer latch is released and the secondary product roll is repositioned to a usable position.

5. The paper product dispenser of claim 4 wherein the swing arm further comprises the engagement portion operatively configured to release the seer latch and thus release a vertically sliding member and thus release the secondary roll product roll to an operational position only when the primary roll is completely utilized.

6. The paper product dispenser of claim 1 further comprising a casing door configured to deny access to the secondary roll of product until the primary roll of product is substantially consumed, and wherein the casing door comprises a release latch.

7. The paper product dispenser of claim 6 further comprising a casing, wherein the swing arm is operatively configured to be repositioned to a reserve position, followed by repositioning the casing door to a reserve position, functionally resetting the dispenser automatically as the casing is opened.

8. The paper product dispenser of claim 1 further comprising a) a lower member having a first end and a second end, b) an upper member, c) wherein the swing arm is rotatably coupled to the frame at a first end of the lower member via a lower member pivot and the lower member further comprises a channel substantially at the second end of the lower member configured to slidably engage the upper member wherein the channel of the lower member directly engages the swing arm.

9. The paper product dispenser of claim 8 wherein the casing is rotatably attached to the frame at a casing pivot and further comprising a repositioning tab operatively configured to engage a repositioning surface on the first end of the lower member when the casing is opened to a substantially fully open position, wherein pressure against the repositioning surface of the lower member by the repositioning tab will rotate the lower member about the lower member pivot which will in turn rotate the upper member about an upper member pivot operatively configured to functionally reset the dispenser as the casing is opened.

10. The paper product dispenser of claim 9 wherein a lifting member is configured to exert force against a vertically sliding member repositioning the secondary roll support to a reserve position.

11. The paper product dispenser of claim 9 wherein the lifting member is configured to engage the outer surface of the primary roll as the casing is closed.

12. The paper product dispenser of claim 9 wherein the swing arm further comprises an engagement portion operatively configured to engage the outer surface of the primary product roll until the primary product roll is substantially consumed at which point the seer latch is released and a casing door is repositioned to an open position.

13. The paper product dispenser of claim 1 further comprising an upper member rotatably coupled to the back side of the lateral extension and comprising a cam surface slidably engaging the release latch, the upper member comprising the cam surface and a seer point which are configured to slidably engage a seer latch while the primary product roll is not substantially consumed.

14. The paper product dispenser of claim 1 wherein the swing arm extends transversely from an upper member through a surface defining a channel disposed upon the lateral extension.

15. The paper product dispenser of claim 1 further comprising a lifting member coupled at a first end to a lifting member pivot which extends from the lateral extension, the lifting member comprising an engagement surface substantially positioned at the second end of the lifting member which is operatively configured to slidably engage a vertically sliding member, and comprises a surface defining a channel positioned between the lifting member pivot and the engagement surface operatively configured to engage a sliding bar extending transversely from the upper member.

16. A paper product dispenser for dispensing product disposed on a plurality of hollow cores wherein the dispenser comprises:

a) a frame;

b) a casing pivotally coupled to the lower portion of the frame;

c) a primary roll support fixedly coupled to the frame and is operatively configured to extend into a central portion of a product roll;

d) a secondary roll support coupled to the frame;

e) wherein a seer mechanism is coupled to the casing and operatively configured to reset the secondary roll support from a position wherein the secondary product roll is accessible to a user via a dispensing opening to a position wherein the secondary product roll is inaccessible to a user via the dispensing as the casing is opened.

17. The paper product dispenser as disclosed in claim 16 further comprising:

a) a swing arm coupled to the seer mechanism and configured to engage the outer surface of the primary roll while a primary roll is being utilized and operatively configured to engage the seer mechanism and release the secondary roll support when the primary roll is substantially consumed; and b) a lower member coupled to the frame and engaging a portion of the casing configured to reposition the swing arm when the casing is substantially opened.

18. A paper product dispenser for dispensing products wherein the dispenser comprises:

a) a frame;

b) a casing pivotally coupled to the lower portion of the frame;

c) a primary roll support coupled to the frame;

d) a swing arm coupled to the frame and configured to engage the outer surface of a primary roll of product while the primary roll is being utilized; and e) the swing arm further coupled to the casing and operatively configured to reset to a first position as the casing is opened by way of mechanical force exerted upon the swim arm by the casing.

* * * * *